US006102393A

United States Patent [19]

Kida et al.

[11] Patent Number: 6,102,393

[45] Date of Patent: Aug. 15, 2000

[54] SHEET DISCHARGE PROCESSING DEVICE

[75] Inventors: Hiroshi Kida, Yamatokoriyama; Norio Hontani; Masanori Kato, both of Hiroshima; Masanori Takeda, Fukuyama; Kiyohide Ochi, Hiroshima, all of Japan

[73] Assignee: Sharp Kabushiki Kaisha, Osaka, Japan

[21] Appl. No.: 09/376,187

[22] Filed: Aug. 17, 1999

Related U.S. Application Data

[62] Division of application No. 08/732,984, Oct. 16, 1996, Pat. No. 5,971,394.

[30] Foreign Application Priority Data

Oct. 17, 1995 [JP] Japan ..... 7-268555
Oct. 25, 1995 [JP] Japan ..... 7-277509

[51] Int. Cl.[7] ..... B65F 29/00

[52] U.S. Cl. ..... 271/303; 271/185; 271/286; 271/195; 271/176; 271/188; 271/65

[58] Field of Search ..... 271/303, 185, 271/186, 195, 176, 188, 69

[56] References Cited

U.S. PATENT DOCUMENTS

| | | | |
|---|---|---|---|
| 3,867,026 | 2/1975 | Ogawa | 355/8 |
| 4,026,543 | 5/1977 | Leclere . | |
| 4,040,616 | 8/1977 | Clarkson et al. | 271/65 |
| 4,220,323 | 9/1980 | Smith | 271/65 |
| 4,277,061 | 7/1981 | Nagei et al. . | |
| 4,387,890 | 6/1983 | Lampe | 271/228 |
| 4,443,101 | 4/1984 | Sakurai et al. . | |
| 4,858,909 | 8/1989 | Stemmle . | |
| 4,945,390 | 7/1990 | Hasegawa et al. | 355/321 |

(List continued on next page.)

FOREIGN PATENT DOCUMENTS

| | | | |
|---|---|---|---|
| 416633A2 | 3/1991 | European Pat. Off. . | |
| 566279A1 | 10/1993 | European Pat. Off. . | |
| 0576235 | 12/1993 | European Pat. Off. . | |
| 0576235 A1 | 12/1993 | European Pat. Off. | B65H 29/58 |
| 576235A1 | 12/1993 | European Pat. Off. . | |
| 60-12454 | 1/1985 | Japan . | |
| 6012454 | 1/1985 | Japan . | |
| 1-271361 | 10/1989 | Japan | B65H 29/60 |
| 3-272976 | 12/1991 | Japan | B65H 83/02 |
| 4247993 | 9/1992 | Japan . | |
| 5-217658 | 8/1993 | Japan | H01R 43/20 |
| 5310357 | 11/1993 | Japan . | |
| 6-175534 | 6/1994 | Japan | G03G 15/20 |

OTHER PUBLICATIONS

Patent Abstracts of Japan, vol. 14, No. 39 (M–924), Jan. 24, 1990, & JP 01 271361A Canon, published Oct. 30, 1989.

Patent Abstracts of Japan, vol. 15, No. 283 (M–1137), Jul. 18, 1991, & JP 03 098948A, Koufu Nippon Denki KK, published Apr. 24, 1991.

*Primary Examiner*—Christopher P. Ellis
*Assistant Examiner*—Michael E. Butler

[57] ABSTRACT

A sheet conveyed into a sheet discharge processing device is conveyed through a straight convey path by first convey rollers and then is discharged onto a first discharge tray by second convey rollers and first discharge rollers. Second discharge rollers are arranged on a reverse convey path. A second discharge tray and a fan for applying an external force to the rear surface of a sheet are placed below the reverse convey path. When the trailing end of a sheet is detected by a second detection sensor, the fan is driven for a predetermined period of time to blow air against the rear surface of the discharged sheet. When sheets conveyed into the sheet discharge processing device are guided to a post-processing convey path by the first convey rollers so as to be subjected to post-processing, and are sequentially conveyed to a sheet stored section by convey rollers from the last or start page, the sheets are guided along one of guide plates constituting the sheet storing section to be aligned. A stapler for stapling a bundle of sheets aligned in the sheet storing section is placed below the sheet storing section.

12 Claims, 28 Drawing Sheets

U.S. PATENT DOCUMENTS 5,013,021 5/1991 Johdai et al. .
5,060,921 10/1991 Higashio et al. .
5,166,739 11/1992 Katsuki et al. ..... 355/319
5,172,905 12/1992 Vanous et al. .
5,201,517 4/1993 Stemmle .
5,215,298 6/1993 Stemmle et al. .
5,769,412 6/1998 Takemoto et al. .
5,852,764 12/1998 Kida et al. ..... 399/401
5,854,965 12/1998 Kasiwabara et al. ..... 399/381
5,855,367 1/1999 Inoue et al. ..... 271/186
5,868,387 2/1999 Kida et al. ..... 271/304
5,887,867 3/1999 Takahashi et al. ..... 271/117
5,913,268 6/1999 Jackson et al. ..... 101/420

SHEET DISCHARGE PROCESSING DEVICE

This application is a divisional of application Ser. No. 08/732,984, filed on Oct. 16, 1996 now U.S. Pat. No. 5,971,394, issued on Oct. 26, 1999, the entire contents of which are hereby incorporated by reference.

BACKGROUND OF THE INVENTION (1) Field of the Invention

The present invention relates to a sheet discharge processing device which can discharge sheets on which images are formed by a image forming apparatus, with the discharged pages being sorted in order.

The present invention also relates to a sheet discharge processing device which aligns discharged sheets in a state sorted in order of page while discharging the sheets on which images are formed by an image forming apparatus, and which performs post-processing for a bundle of the aligned sheets, e.g., stapling, punching, or pasting.

(2) Description of the Prior Art

Recently, a digital copying machine as an image forming apparatus has bee commercialized as a multi-function machine which operates in the printer mode, the facsimile mode, and the like as well as in the copy mode. In the general copy mode, sheets of paper are sequentially discharged facing up, i.e., with the image-bearing surfaces facing up. In the printer or facsimile mode, face-down paper discharge, i.e., paper discharge with each image-bearing surface facing down, in generally performed. More specifically, in the general copy mode, in consideration of the collation of image-bearing sheets to be discharged, an automatic document feeder or the like is used to feed originals so as to cause the machine to sequentially form images on sheets from the last page, thereby discharging image-bearing sheets in the collated or sorted state.

In contrast to this, when the machine operates as a printer or facsimile apparatus, since image data are sequentially transferred from an external device such as a wordprocessor and personal computer from the first page, image formation is performed from the first page. For this reason, in the copy mode, sheets must be discharged without changing their states. In the printer mode, sheets must be discharged onto a discharge tray after they are reversed, with the image-bearing surfaces facing down.

In order to realize this sheet discharge processing function, for example, Japanese Patent Application Laid-open Hei 5 No.310357 discloses a device. The arrangement of this device will be briefly described below. As shown in FIG. 27, when a toner image on a photoreceptor 101 is transferred onto a sheet fed from a paper feed tray 100, the sheet passes through a fixing device 102 and is discharged out of the device. A paper discharge processing unit 103 switches the sheet discharge modes in accordance with the copy mode or the printer mode.

When the image forming apparatus is in the copy mode, the sheet is discharged, with the recording surface facing up, onto a first discharge tray 105 through a paper outlet 104 via various convey rollers of a paper discharge processing unit 103. In the printer mode, the convey path is switched to temporarily guide the sheet to a switchback convey path 106 via various convey rollers, and the convey direction is switched by a switching means 107. Thereafter, the sheet is discharged, with the image-bearing surface facing down, onto a second discharge tray 109 through a paper outlet 108.

Referring to FIG. 27, reference numeral 110 denotes an intermediate unit for double-sided image formation which is detachably or integrally mounted on a digital image forming apparatus body 111. When the intermediate unit 110 is mounted on the image forming apparatus body 111, in forming images on the upper and lower surfaces of a sheet, the sheet is conveyed into an intermediate tray 112 via the paper discharge processing unit 103 and the switchback convey path 106, and is conveyed again from the intermediate tray 112 to the transfer position on the photoreceptor 101 on which a toner image is formed.

In order to form images, a laser beam irradiation unit 113 is placed above the photoreceptor 101, and a read unit (scanner) 114 for optically reading an image on an original is placed in the uppermost portion of the apparatus. An image on an original placed on a transparent original table 115 is formed on a CCD 117 as a read element by the scanner 114 through an optical system 116. The image is photoelectrically converted and read by the CCD 117. The semiconductor laser of the laser beam irradiation unit 113 is driven on the basis of the read image data to form an image on the photoreceptor 101.

Japanese Patent Application Laid-open Hei 4 No.247993 discloses a digital copying machine equipped with a sheet discharge processing device having a post-processing mechanism for stapling sheets on which images on originals are formed or sheets on which images received in the facsimile mode are formed. FIG. 28 shows the detailed structure of this copying machine. A toner image formed on a photoreceptor 121 is transferred onto a sheet fed from a paper feed cassette 120 by a transfer section 122. In the general copy mode, the sheet passes through a fixing device 123 and is conveyed onto a predetermined tray 125 in a sheet discharge processing device 124.

In the facsimile mode, it is checked whether a set of received images corresponds to a plurality of pages. If it corresponds to one page, the single-sided copy mode is set. If it corresponds to a plurality of pages, the double-sided copy mode is set. When the double-sided copy mode is selected, each of even-page images of the received images is formed on one surface of a sheet, the image-bearing sheet passes through the fixing device 123 and is caused to branch off by a switching pawl 126. The sheet is then guided to a reverse convey path 127. As a result, the feed direction of the sheet is reversed, and the sheet is guided onto a re-feed tray 128 with the image-bearing surface facing up. The second page, the fourth page, the sixth page, . . . are sequentially stacked on the re-feed tray 128 from the lowest portion. The sheets are sequentially fed from the re-feed tray 128 to the transfer section 122 again from the sheet of the last page (the uppermost sheet). As a result, each of odd-page images is sequentially formed on the other surface of a corresponding sheet. In this case, a (n−1)th-page image is formed on the surface opposite to the image-bearing surface of a last page n, and an (n−3)th-page image is formed on the surface opposite to the image-bearing surface of an (n−2)th page. These sheets, each having images formed on both sides, pass through the fixing device 123 and are conveyed onto a predetermined tray 125 with the odd-page surfaces facing up.

Assume that the above sheets are sequentially stacked on the tray 125 from the last page, and formation of one set of images is completed. In this case, when a staple switch 129 is operated, the sheets are stapled upon operation of a solenoid 130. A motor 131 serves to move the stapling mechanism. A bundle of sheets is stapled on the tray 125 upon operation of the solenoid 130.

In order to feed a sheet on which an image is formed in the above arrangement to the sheet discharge processing device, a switchback convey means is required to reverse the feed direction of the sheet through a switchback convey path. In order to prevent the leading and trailing ends of sheets from overlapping, the sheet convey cycle must be set on the basis of a value equal to or larger than the length of a sheet in the convey direction. As the speed of image formation on the image forming apparatus side increases, the convey speed of the switchback convey means must be set to be higher than the convey speed in the process of performing image formation. If, however, a switchback convey operation is performed at a high speed, a jam or the like may occur.

In addition, since the conventional sheet discharge processing device has paths and convey means for the above switchback convey operation, the overall size of the device increases, resulting in a disadvantage in terms of cost.

In the device disclosed in Japanese Patent Application Laid-open Hei 5 No.310357, when sheets are to be discharged with the image-bearing surfaces facing up or down to perform post-processing such as stapling, stapling mechanism must be mounted to be movable on the upper and lower discharge trays 105 and 109. Moving mechanisms are therefore required, and the arrangement of the device is complicated.

Furthermore, in stapling sheets, since the image-bearing surfaces are reversed, the stapling position becomes opposite, and the position of a staple is reversed. In order to make these positions uniform with respect to the image-bearing surfaces of sheets, the stapling mechanism portion becomes very complicated, resulting in a trouble or the like in a stapling operation.

In the copying machine disclosed in Japanese Patent Application Laid-open Hei 4 No.247993, when image data received in the facsimile mode are to be read out from the memory, conveyance of sheets and image formation must be performed in consideration of the read order such that sheets are sequentially stacked on the tray 125 of the sheet discharge processing device 124 from the last page. For this reason, when a sheet convey abnormality, especially a jam, occurs in the sheet convey path, jam recovery processing becomes very complicated. Furthermore, since all facsimile image data must be temporarily stored, a large-capacity storage medium is required, and a complicated address mead and the like are required to hold the stored state, resulting in an increase in cost.

SUMMARY OF THE INVENTION

It is an object of the present invention to provide a sheet discharge processing device which can satisfactorily cope with high-speed image formation in an image forming apparatus, eliminate the need for switchback conveyance, i.e., reverse conveyance, to simplify the sheet discharge processing mechanism, and perform discharge processing without upsetting the page order even if image formation is performed in the order of image data received.

It is another object of the present invention to provide a sheet discharge processing device which can satisfactorily cope with high-speed image formation in an image forming apparatus, simplify the post-processing mechanism for a bundle of sheets, and minimize the memory capacity for image data on the image forming apparatus side without upsetting the page order even if image formation is performed in the order of image data received so as to attain a reduction in cost.

It is still another object of the present invention to provide a sheet discharge processing device which performs post-processing for sheets from the same direction at the same position.

According to an aspect of the present invention, there is provided a sheet discharge processing device for sequentially discharging sheets, conveyed through image forming means for forming images on the sheets on the basis of image data, onto a discharge tray with image-bearing surfaces facing up or down, which comprises: a straight convey path for discharging sheets conveyed through the image forming means onto a first discharge tray, with image-bearing surfaces facing up, such that the sheets are stacked sequentially on each other from a last page; a reverse convey path for discharging the sheets conveyed through the image forming means onto a second discharge tray, with image-bearing surfaces facing dow, such that the sheets are stacked sequentially on each other from a start page, the reverse convey path branching from the straight convey path; reversing/biasing means, placed on the reverse convey path, for applying an external force to a rear surface of a sheet to reverse and discharge the sheet onto the second discharge tray; switching means for switching a convey route of a sheet to the straight convey path or the reverse convey path; and control means for controlling the switching means and the reversing/biasing means depending on whether an image-bearing surface of a sheet conveyed through the image forming means faces up or down.

The above reverse convey path is placed in a vertical direction perpendicular to the straight convey path, so that a sheet to be discharged is conveyed in the vertical direction. When the reversing/biasing means applies a external force to the rear surface of the sheet, the sheet falls onto the second discharge tray with the rear surface facing up, and the next sheet is sequentially stacked on the discharged sheet. If the rear surface of the sheet is a surface opposite to its image-bearing surface, the sheet is stacked on the discharge tray within the image-bearing surface opposing the discharge tray. When images are formed on sheets from the start page, sheets are discharged in the page order. In this case, since no switchback conveyance is required, reductions i the size and cost of the device can be attained.

If the reversing/biasing means comprises an air biasing means for blowing air or a rotating member, the air biasing means or the rotating member can be properly driven/controlled, and therefore a sheet discharged in a vertical posture can be caused to fall onto the second discharge tray by applying an external force to the rear surface of the sheet at a proper timing.

According to another aspect of the present invention, there is provided a sheet discharge processing device for sequentially discharging sheets, conveyed through image forming means for forming images on the sheets on the basis of image data, onto a discharge tray with image-bearing surfaces facing up or down, which comprises: a straight convey path for discharging sheets conveyed through the image forming means onto a first discharge tray, with image-bearing surfaces facing up, such that the sheets are stacked sequentially on each other from a last page; a reverse convey path for discharging the sheets conveyed through the image forming means onto a second discharge tray, with image-bearing surfaces facing down, such that the sheets are stacked sequentially on each other from a start page, the reverse convey path branching from the straight convey path; discharge rollers arranged on the reverse convey path to convey a sheet onto the second discharge tray; reversing/biasing means, arranged on the reverse convey path, for applying an external force to a rear surface of a sheet discharged through the discharge rollers to reverse and discharge the sheet onto the second discharge tray; detection means, arranged on the reverse convey path, for detecting a trailing end of a sheet which passes through the discharge rollers; and control means for controlling the switching means depending on whether an image-bearing surface of a sheet conveyed through the image forming means faces up or down, and controlling an operation of the reversing/biasing means in response to detection of a trailing end of a sheet by the detection means.

The distance between the discharge rollers and the second discharge tray is adjustable in accordance with the size of a sheet to be processed, and the distance between the discharge rollers and the second discharge tray is controlled/adjusted by the control means in accordance with the size of a sheet to be processed. Since the reversing/biasing means is operated at the timing when the trailing end of a sheet to be discharged by the discharge rollers passes therethrough, the sheet can be reversed/discharged more reliably.

In addition, since the distance between the discharge rollers and the second discharge tray is adjusted in accordance with the size of a sheet to be processed, the sheet can be reversed/rotated about the leading end of the sheet as a fulcrum to be discharged by operating the reversing/biasing means at the timing when the leading end of the sheet comes into contact with the discharge tray.

Furthermore, the reversing/biasing means uses an air blowing operation to blow air at a position near the middle of the distance between the discharge rollers and the second discharge tray. With this operation, a sheet can be reversed/rotated about the leading end as a fulcrum. If air is blown downward, a sheet can be reversed more reliably.

According to still another aspect of the present invention, there is provided a sheet discharge processing device for sequentially discharging sheets, conveyed through image forming means for forming images on the sheets to the basis of image data, onto a discharge tray with image-bearing surfaces facing up or down, which comprises: a straight convey path for discharging sheets conveyed through the image forming means onto a first discharge tray, with image-bearing surfaces facing up, such that the sheets are stacked sequentially on each other from a last page; a reverse convey path for discharging the sheets conveyed through the image forming means onto a second discharge tray, with image-bearing surfaces facing down, such that the sheets are stacked sequentially on each other from a start page, the reverse convey path branching from the straight convey path; discharge rollers arranged on the reverse convey path to convey a sheet onto the second discharge tray; air biasing means, arranged on the reverse convey path, for blowing air against a rear surface of a sheet discharged through the discharge rollers to reverse and discharge the sheet onto the second discharge tray; detection means, arranged on the reverse convey path, for detecting leading and trailing ends of a sheet which passes through the discharge rollers; and control means for controlling the switching means depending on whether a image-bearing surface of a sheet conveyed through the image forming means faces up or down, and controlling the air biasing means to draw a sheet in response to detection of the leading end of the sheet by the detection means and to blow air against a rear surface of the sheet in response to detection of the trailing end of the sheet by the detection means.

According to this arrangement, the leading end of a sheet can be reliably discharged along the vertical direction, and air can be blown against the rear surface of the sheet while the leading end of the sheet is in contact with the second discharge tray, so that the sheet can be easily reversed/rotated about the leading end as a fulcrum. A reversing operation can therefore be reliably performed.

In addition, correction means for forming wavy recesses/projections on a sheet in a direction perpendicular to the sheet convey direction is placed so as to increase the stiffness of the sheet discharged by the discharge rollers along the convey direction, thereby preventing the leading end of the sheet from becoming unstable because of bending of the sheet. This improves the effect of reliably reversing a sheet.

According to still another aspect of the present invention, there is provided a sheet discharge processing device for sequentially discharging sheets, conveyed through image forming means for forming images on the sheets on the basis of image data, onto a discharge tray, which comprises: a sheet storing section for sequentially storing image-bearing sheets conveyed through the image forming means; sheet alignment means for aligning sheets sequentially conveyed to the sheet storing section from a last page or a start page with image-bearing surfaces facing in one direction; post-processing means for performing post-processing for a bundle of sheets aligned in the sheet storing section; and control means for controlling an operation of the sheet alignment means depending on whether sheets are conveyed through the image forming means from a last page or a start page.

The above sheet storing section comprises two guide plates opposing each other, and notched portions are formed in the guide plates at a position where the notched portions oppose the sheet alignment means. Also, an edge of each notched portion is formed at a position where the trailing end of a sheet stored in the sheet storing portion protrudes.

The sheet alignment means comprises an alignment member having: a rotating member which rotates in the forward and reverse directions; and paddles which are integrally formed with the rotating member to guide sheets into the storing section and align the stored sheets by shifting the sheets to one of the guide plates constituting the sheets storing section. The paddles of the alignment guide members are arranged such that one of the paddles comes into contact with the trailing end of a sheet that protrudes from an edge of each of the notched portions formed in the guide plates.

According to the sheet discharge processing device having the above arrangement, when image-bearing sheets are conveyed into the sheet storing section, and image formation is performed from, e.g., the last page, the sheets are guided to one of the guide plates by the alignment guide member as the sheet alignment means, and the already stored sheets are stored to be shifted to the other guide plate so as to be aligned. In contrast to this, if image formation is performed from the start page, sheets are guided to the other guide plate by the paddles of the alignment guide member as the sheet alignment means, while the already stored sheets are stored to be shifted to another guide plates so as to be aligned. When this alignment is completed, post-processing is performed by the post-processing means.

According to still another aspect of the present invention, there is provided a sheet discharge processing device for sequentially discharging sheets, conveyed through image forming means for forming images on the sheets on the basis of image data, onto a discharge tray, which comprises: a sheet storing section for sequentially storing image-bearing sheets conveyed through the image forming means; sheet alignment means for aligning sheets sequentially conveyed to the sheet storing section from a last page or a start page with image-bearing surfaces facing in one direction; post-processing means for performing post-processing for a bundle of sheets aligned in the sheet storing section; and control means for controlling an operation of the sheet alignment means depending on whether sheets are conveyed through the image forming means from a last page or a start page, wherein the sheet storing section comprises two guide plates opposing each other, and the guide plates have guide pieces for separating stored sheets from the guide plates.

According to this arrangement, since sheets are stored while they are separated from the guide plates of the sheet storing section, the sheets can be reliably aligned by the sheet alignment means.

The sheet alignment means comprises an alignment guide member obtained by forming paddles on a rotating member which is driven to rotate in the forward and reverse directions. The paddles serve to guide sheets into the sheet storing section and align the stored sheets stored by shifting them to one side. The control means rotates the alignment guide member in a given direction in accordance with the page order of the sheets conveyed from a last page or a start page, so that the sheets can be sorted and aligned in one sheet storing section with the image-bearing surfaces facing in one direction in the page order.

In addition, each of the paddles constituting the alignment guide member is made of an elastic member which is transformable, and the paddle for guiding a sheet into the sheet storing section and the paddle for shifting sheets stored in the sheet storing section to one side are formed on the rotating member to be symmetrical about the rotation axis. With this structure, when the alignment guide member rotates through 180°, a sheet is guided, and at the same time, stored sheets are shifted and aligned. That is, since the rotation time is shortened, the device can satisfactorily cope with a short sheet convey cycle.

Since the guide pieces are arranged on the respective opposing guide plates of the sheet storing section so as not to overlap each other, the frictional resistance between a sheet conveyed into the sheet storing section and the guide pieces is reduced. The sheet can therefore be smoothly stored.

In addition, since the device comprises the correction means for increasing the stiffness of a sheet conveyed to the sheet storing section in the sheet convey direction, occurrence of jams of sheets conveyed to the sheet storing section can be suppressed. Sheets can therefore be reliably stored in the storing section.

If the correction means and the alignment guide member of the sheet alignment means are arranged so as not to overlap each other in the sheet convey direction, an increase in the frictional resistance between theses means and a sheet can be suppressed. Sheets can therefore be reliably stored in the sheet storing section.

If the correction means and the guide pieces arranged on the respective guide plates constituting the sheet storing section are positioned so as not to overlap each other in the sheet convey direction, an increase in the frictional resistance between these means and pieces and a sheet can be suppressed. Sheets can therefore be reliably stored in the sheet storing section.

According to still another aspect of the present invention, there is provided a sheet discharge processing device for sequentially discharging sheets, conveyed through image forming means for forming images on sheets on the basis of image data, onto a discharge tray, which comprises: a sheet storing section for sequentially storing image-bearing sheets conveyed through the image forming means; sheet alignment means for aligning sheets sequentially conveyed to the sheet sorting section from a last page or a start page with image-bearing surfaces facing in one direction; post-processing means for performing post-processing for a bundle of sheets aligned in the sheet storing section; and control means for controlling an operation of the sheet alignment means depending on whether sheets are sequentially conveyed through the image forming means from a last page or a start page, wherein the sheet storing section is divided into upper and lower sections, and one of the upper and lower sheet storing sections is vertically movable.

The post-processing means is placed on the vertically movable lower sheet storing section side, and the vertical position of the vertically movable lower sheet storing section is adjusted in accordance with the size of a sheet. With this operation, sheet alignment can be reliably performed in accordance with the size of a sheet to be processed, and the post-processing can be also reliably performed after the alignment. That is, in addition to processing for sheets of the same size, processing for sheets of various sizes can be performed. At the same time, this processing can be reliably performed.

If guide pieces for guiding a sheet are arranged in the vertically movable sheet storing section and the fixed sheet storing section, a sheet can be reliably transferred to the lower sheet storing section and stored therein owing to the function of the guide pieces even though the sheet storing section is vertically movable.

According to still another aspect of the present invention, there is provided a sheet discharge processing device for sequentially discharging sheets, conveyed through image forming means for forming images on the sheets on the basis of image data, onto a discharge tray, which comprises: a sheet storing section for sequentially storing image-bearing sheets conveyed through the image forming means; sheet alignment means for aligning sheets sequentially conveyed to the sheet storing section from a last page or a start page with image-bearing surfaces of the sheets facing in one direction, the sheet alignment means being rotatable in the forward and reverse directions; detection means for detecting a trailing end of a sheet conveyed into the sheet storing section; post-processing means for performing post-processing for a bundle of sheets aligned in the sheet storing section; and control means for controlling rotation of the sheet alignment means in response to detection of a trailing end of a sheet by the detection means, and driving the post-processing means when a last sheet is stored in the sheet storing section.

According to this arrangement, since rotation of the sheet alignment means is controlled in response to detection of the trailing end of a sheet, the trailing end of the sheet stored in the sheet storing section can be struck downward. The sheet can therefore be reliably stored in the sheet storing section without being stopped halfway. In addition, since storage of the last sheet can be reliably detected due to the sheet detection, the post-processing for the sheets, e.g., stapling, can be reliably performed at a proper timing.

The above control means stops rotation of the sheet alignment means while stored sheets are shifted to one or the other side by the sheet alignment means with the last sheet being stored in the sheet storing section, and operates the post-processing means in this state, thereby reliably performing the post-processing without causing ay displacement of the sheets.

Assume that the device comprises a convey means for conveying a sheet into the sheet storing section, and the convey speed of the convey means is set to be higher than a convey speed at which a speed is conveyed through the image forming means. In this case, even if the sheet alignment means is driven for a long period of time, the overall sheet discharge processing device described above can satisfactorily cope with high-speed processing.

In addition to the sheet storing section for aligning sheets in the page order to perform the post-processing for the sheets described above, each of the sheet discharge processing devices described above further comprises a straight convey path, for conveying a sheet to the first discharge tray which receives the sheet with the image-bearing surface facing up, which branches off from a convey route for conveying a sheet to the sheet storing section, and a reverse convey path, for conveying a sheet to the second discharge tray with the image-bearing surface facing down, which branches off from the straight convey path, and is placed to be substantially parallel to the sheet storing section. With this arrangement, sheets can be stored and discharged in the page order even if no post-processing is performed. In this case, since the reverse convey path is placed to be parallel to the sheet storing section, the overall sheet discharge processing device can be reduced in size.

According to still another aspect of the present invention, there is provided a sheet discharge processing device for sequentially discharging sheets, conveyed through image forming means for forming images on the sheets on the basis of image data, onto a discharge tray, which comprises: a sheet storing section for sequentially storing image-bearing sheets conveyed through the image forming means; sheet alignment means for aligning sheets sequentially conveyed to the sheet storing section from a last page or a start page with image-bearing surfaces of the sheets facing in one direction; post processing means for performing post-processing for a bundle of sheets aligned in the sheet storing section; and control means for controlling an operation of the sheet alignment means depending on whether sheets are sequentially conveyed through the image forming means from a last page or a start page.

If the above post-processing means comprises a stapling mechanism for driving a staple into a bundle of sheets, in particular, since sheets stored in the sheet storing section are always aligned in the same direction, staples are drive at the same position. For this reason, the stapling mechanisms need not be moved.

In addition, if each of the above sheet discharge processing devices comprises a failure detection means for detecting a convey failure of a sheet stored in the sheet storing section, the posture of the sheet alignment means is changed from the aligning state in response to detection by the failure detection means. In particular, if a convey failure of a sheet is detected while it is conveyed to the sheet storing section, the sheet alignment means is retracted from the alignment posture to a position where it does not regulate the trailing end portion of the sheet. If a sheet convey failure is detected after the post-processing for a sheet, the sheet alignment means is retracted to a position where it doest no regulate the trailing end of the sheet. With this operation, a jammed sheet or the like can be easily removed without damaging the sheet alignment means.

According to each of the sheet discharge processing devices having the above arrangements, sheets can be sorted in the above manner regardless of whether images are formed on the sheets in the order in which the sheets are transferred or originals are read. In addition, since all the image formation contents need not be stored, it suffices if the storage means on the image forming apparatus side have a small memory capacity.

Further advantages and features of the invention as well as the scope, nature and utilization of the invention will become apparent to those skilled in the art from the description of the preferred embodiments of the invention set forth below.

BRIEF DESCRIPTION OF THE DRAWINGS

FIG. 6 is a perspective view showing an example of how sheet guide pieces are arranged in a sheet storing section in the present invention, in which

FIG. 12 is a perspective view for explaining the aligned state of sheets and the stapled state of the sheets after alignment in the sheet discharge processing device of the present invention, in which

FIG. 16 shows the state of a sheet convey failure in the sheet storing section, in which

DESCRIPTION OF THE PREFERRED EMBODIMENTS

Embodiments of the sheet discharge processing device of the present invention which receives sheets having undergone image formation in an image forming apparatus, ad has means for performing post-processing for the sheets, that is, the post-performing means for binding the respective sheets, e.g., stapling, pasting, and punching, especially which has a stapling mechanism will be described with reference to the accompanying drawings.

Figure 1:
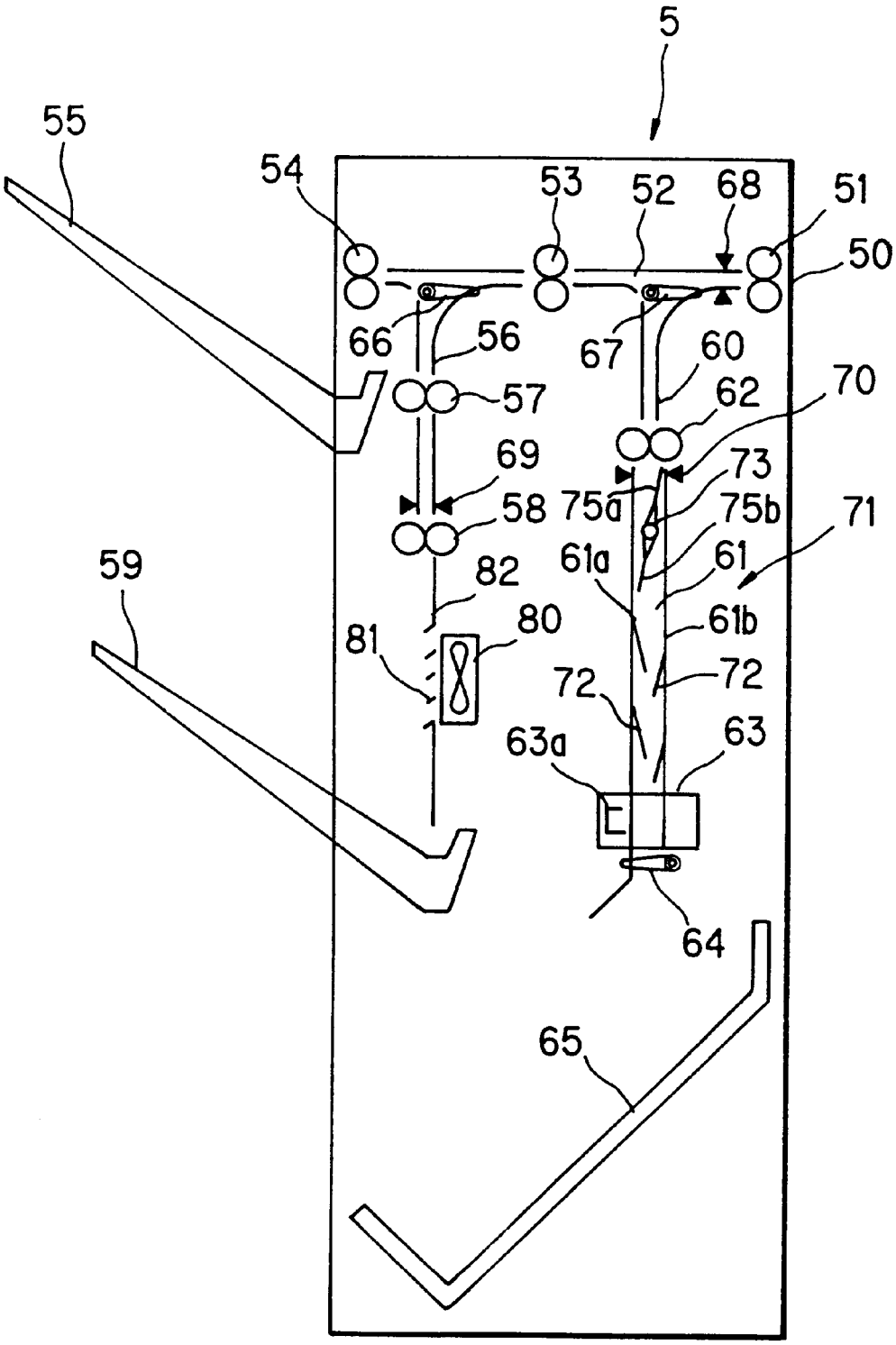
FIG. 1 is a front longitudinal sectional view showing the internal structure of a sheet discharge processing device according to an embodiment of the present invention.
Figure 2:
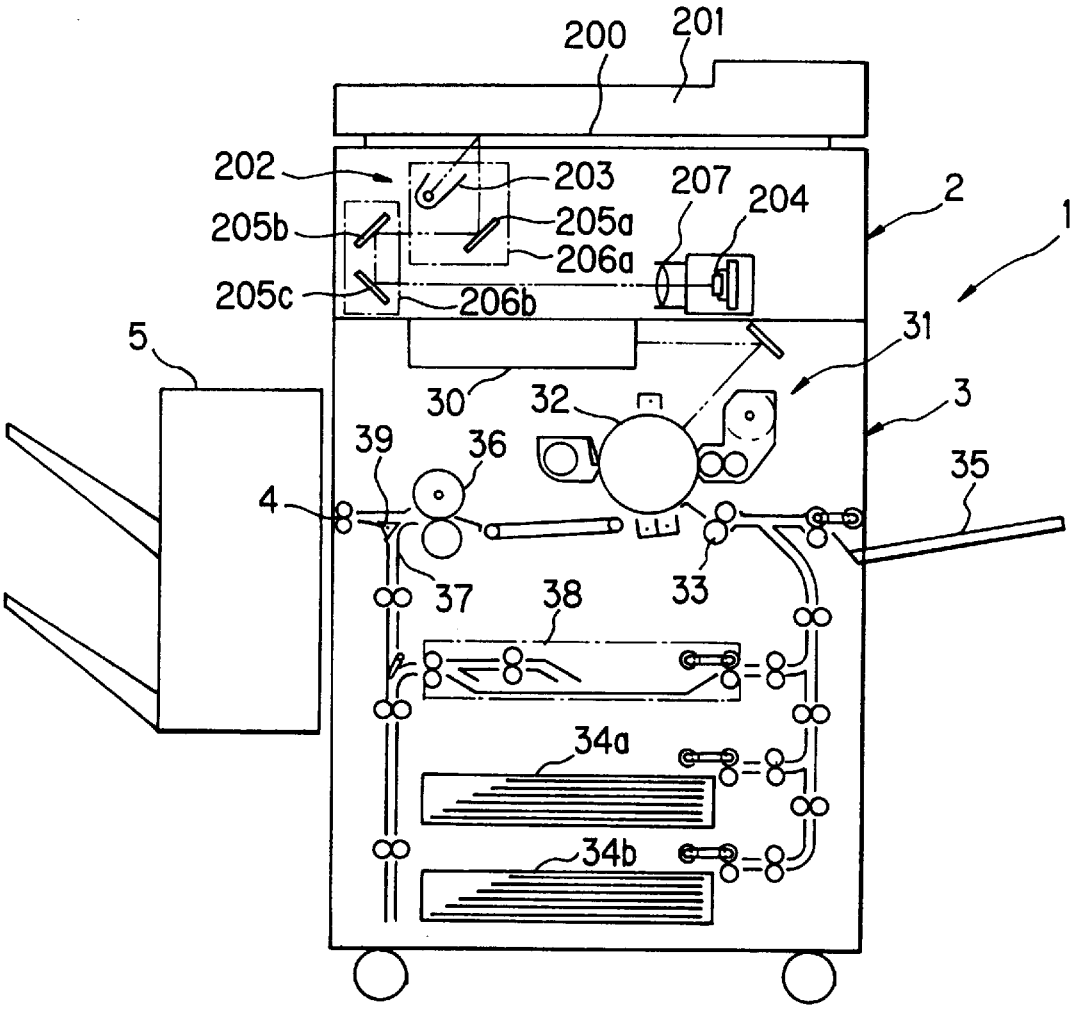
FIG. 2 is a front longitudinal sectional view showing the overall structure of a digital copying machine including the sheet discharge processing device of the present invention.

The present invention relates to a sheet discharge processing device which is mounted in the paper discharge portion of a digital image forming apparatus having the copy mode, the printer mode, the facsimile mode, and the like. FIG. 1 is a front longitudinal sectional view showing an embodiment of the sheet discharge processing device of the present invention. FIG. 2 is a sectional view showing the overall structure of the digital image forming apparatus including the sheet discharge processing device of the present invention.

The structure of the image forming apparatus will be described first with reference to FIG. 2. This digital image forming apparatus is a digital copying machine. The digital copying machine body 1 is mainly constituted by a scanner section 2 and a laser recording section 3.

The scanner section 2 is constituted by an original-placed table 200 made of transparent glass, a reversible automatic document feeder (RADF) 201 for automatically feeding an original onto the original-placed table 200, and an original image read unit, i.e., a scanner unit 202, for scanning and reading an image on an original placed on the original-placed table 200.

The original image read by the scanner section 2 is sent as image data to a image data input section (to be described later), in which predetermined image processing is performed for the image data.

The RADF 201 is a device for automatically feeding originals set on an original tray (not shown), one by one, onto the original-placed table 200. The RADF 201 is constituted by a convey path for one-sided originals, a convey path for double-sided originals, convey path switching means, and the like to allow the scanner unit 202 to read one or two surfaces of an original in accordance with selection made by the operator. With regard to the RADF 201, many patent applications have been filed, and may devices have become commercially available, and hence a further description of this device will be omitted.

The scanner unit 202 as a part of the scanner section 2 for reading an image on an original placed on the original-placed table 200 comprises a first scanning unit 206*a* having a lamp reflector assembly 203 for exposing the original surface and a first reflecting mirror 205*a* for reflecting light reflected by the original to guide the reflected light image from the original to the photoelectric conversion element 204, a second scanning unit 206*b* having second and third reflecting mirrors 205*b* and 205*c* for guiding the reflected light image from the first reflecting mirror 205*a* to the photoelectric conversion element (CCD) 204, a optical lens body 207 for forming the reflected light image from the original on the element (CCD) 204, which serves to convert the reflected light image into an electrical signal, via the reflecting mirrors 205*a*, 205*b*, and 205*c*, and the CCD 204 for converting the reflected light image from the original into an electrical image signal.

In the scanner section 2, while originals to be read are sequentially placed on the original-placed table 200 upon interlocking operation between the RADF 201 and the scanner unit 202, the scanner unit 202 is moved along the lower surface of the original-placed table 200 to read original images. The first scanning unit 206*a* is driven to travel along the original-placed table 200 from left to right at a constant velocity V, and the second scanning unit 206*b* is controlled to travel parallel in the same direction at a velocity V/2. With this operation, an image on an original placed on the original-placed table 200 is sequentially formed on the CCD 204 line by line, thereby reading the image.

The image data obtained by reading the original image with the scanner unit 202 is sent to an image processing unit (to be described later), in which various processes are performed. The resultant data is temporarily stored in the memory of the image processing unit. In response to an output instruction, the image data in the memory is supplied to the laser recording section 3 to form an image on paper.

This laser recording section 3 includes a convey system for a sheet as paper on which image is to be formed, a laser write unit 30, and an electrophotographic process section 31 for forming an image.

The laser write unit 30 includes a semiconductor laser for emitting a laser beam in accordance with image data read by the scanner unit 202 and read out from the memory, or image data transferred from an external apparatus, a polygon mirror for performing constant-angular-velocity deflection of the laser beam, an f-θ lens for correcting the laser beam having undergone constant-angular-velocity deflection to undergo constant-velocity deflection on a photosensitive drum 32 as a part of the electrophotographic process section 31, and the like.

The electrophotographic process section 31 includes a charger, a developing unit, a transfer unit, a peeling unit, a cleaning unit, and a charge remover around the photosensitive drum 32 as a known member.

The sheet convey system includes a convey section 33 for conveying a sheet to the transfer position, of the electrophotographic process section 31 for performing the above image forming operation, at which the transfer unit is placed, cassette paper feeders 34*a* and 34*b* for feeding a sheet into the convey section 33, a manual paper feeder 35 for feeding a sheet of a necessary size, as needed, a fixing unit 36 for fixing the image transferred onto the sheet, i.e., the toner image, on the sheet, a switchback convey path 37 for reversing the sheet to allow an image to be formed on the lower surface of the sheet having undergone the fixing operation, i.e., to allow images to be formed on the upper and lower surfaces of the sheet, and an intermediate tray 38 for storing a sheet which passes through the convey path 37.

A switching pawl 39 for switching the convey path of a sheet to the switchback convey path 37 is placed on the downstream side of the fixing unit 36. The switching pawl 39 switches the convey path of a sheet having undergone image formation to the convey path through which the sheet is conveyed to a sheet discharge processing device 5 via a discharge section 4.

Sheets of predetermined sizes desired by the operator are stored in the cassette paper feeders 34*a* and 34*b* of the above sheet convey system. The manual paper feeder 35 is used to feed a small number of sheets with sizes desired by the operator. The operator selects one of the paper sizes of the paper feed cassettes or the manual paper feeder 35 to feed a sheet of a desired size.

In the laser write unit 30 and the electrophotographic process section 31, image data read out from the image memory is formed as an electrostatic latent image on the surface of the photosensitive drum 32 when a laser beam is scanned by the laser write unit 30, and the latent image is visualized by toner. When a toner image is thus formed on the surface of the photosensitive drum 32, a sheet of a selected size is fed from one of the cassette paper feeders 34*a* and 34*b* or the manual paper feeder 35 to the transfer unit via the convey section 33. As a result, the toner image on the surface of the photosensitive drum 32 is transferred onto the upper surface of the sheet, and the sheet is conveyed to the fixing unit 36, in which a fixing operation is performed. After the image is fixed on the sheet, the sheet having undergone image formation is conveyed to the sheet discharge processing device 5 via the discharge section 4.

The arrangement and function of the image processing unit, in this digital copying machine body 1, which performs image processing for read original image formation will be described next.

Figure 3:
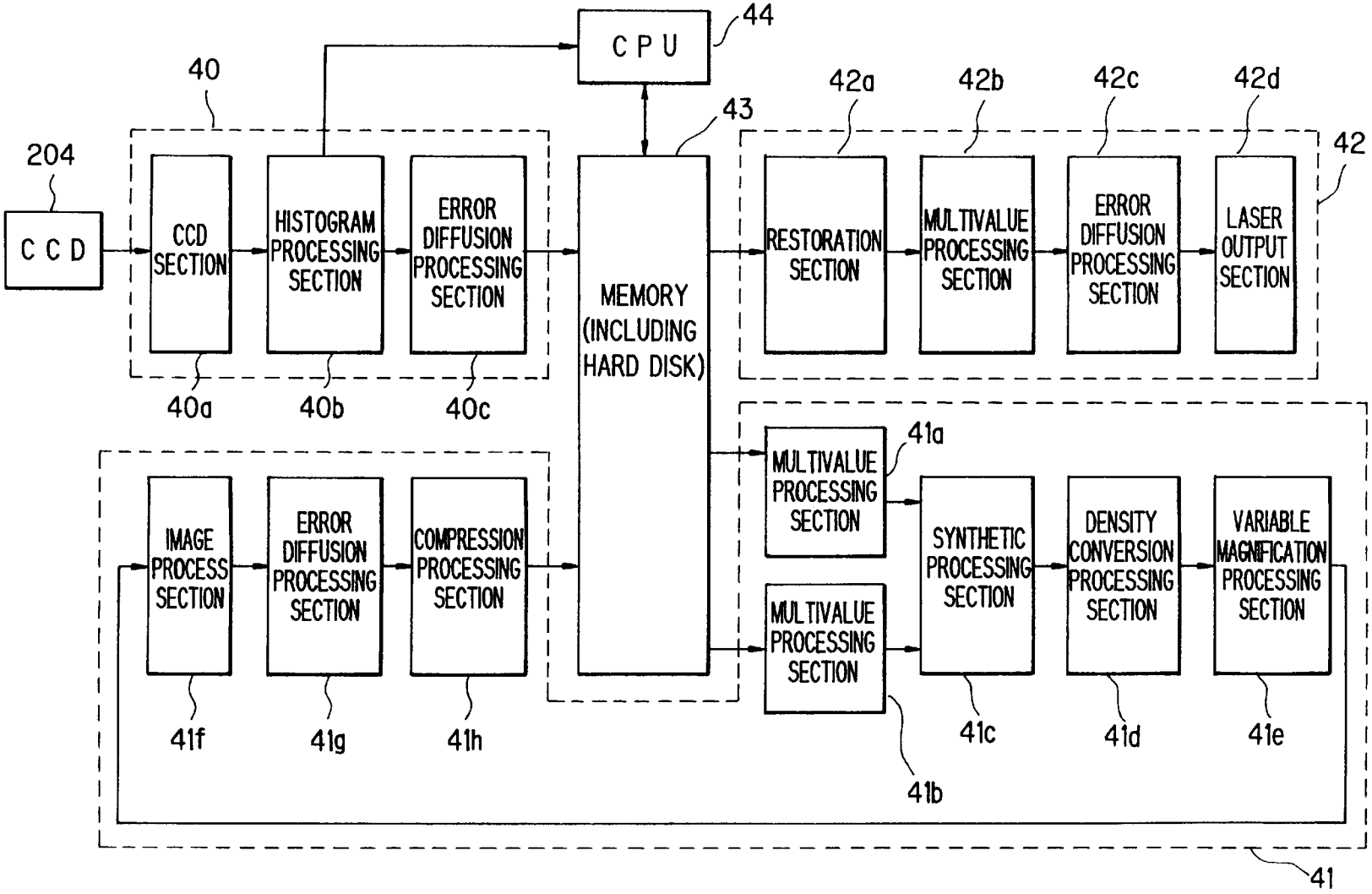
FIG. 3 is a block diagram showing the circuit arrangement of an image processing section of the digital copying machine.

FIG. 3 is a block diagram showing the image processing unit included in the digital copying machine body 1 in FIG. 2. The image processing unit included in the digital copying machine body 1 has an image data input section 40, an image processing section 41, an image data output section 42, a memory 43 constituted by a RAM (random access memory), a hard disk, and the like, and a central processing unit (CPU) 44.

The image data input section 40 includes a CCD section 40*a*, a histogram processing section 40*b*, and an error diffusion processing section 40*c*. The image data input section 40 binarizes the original image data received from the CCD 204, processes the image data by the error diffusion method while generating a histogram as a binary digital amount, and temporarily stores the data in the memory 43.

In the CCD section 40*a*, an analog electrical signal corresponding to the pixel density of each image data is A/D-converted, and MTF correction, black-and-white correction, or gamma correction is performed. The resultant data is outputted as a 256-level (8-bit) digital signal to the histogram processing section 40*b*.

In the histogram processing section 40*b*, density information (histogram data) is obtained by adding digital signals outputted from the CCD section 40*a* for each of the 256-level pixel densities. In addition, the obtained histogram data is sent to the central processing unit 44, or is sent as pixel data to the error diffusion processing section 40*c*, as needed.

In the error diffusion processing section 40*c*, an 8-bit/pixel digital signal outputted from the CCD section 40*a* is converted into 1-bit (binary) data by the error diffusion method as a type of pseudo-halftone processing, i.e., a method of reflecting a binarization error on binarization determination of adjacent pixels, and a re-distribution operation is performed to faithfully reproduce the local area densities of the original.

The image processing section 41 includes multivalue processing sections 41*a* and 41 *b*, a synthetic processing section 40*c*, a density conversion processing section 41*d*, a variable magnification processing section 41*e*, an image process section 41*f*, and error diffusion processing section 41*g*, and a compression processing section 41*h*.

The image processing section 41 serves to finally convert input image data into image data desired by the operator. The image processing section 41 is designed to perform image processing until the processed data is finally stored as converted output image data in the memory 43. Note that the above processing sections includes in the image processing section 41 operate as needed, but may not operate in some case. The multivalue processing sections 41*a* and 41*b* convert data binarized by the error diffusion processing section 40*c* into 256-level data again.

The synthetic processing section 41*c* selectively performs a logical operation for each pixel, i.e., an "or" logical sum operation, an "and" logical product operation, or an exclusive-OR operation. Data to be subjected to this operation includes pixel data stored in the memory 43 and bit data from a pattern generator (PG).

In the density conversion processing section 41*d*, an arbitrary relationship between the input and output densitites is set for the 256-level data signal on the basis of a predetermined gradation conversion table. The variable magnification processing section 41*e* performs interpolation processing with input known data in accordance with a designated magnification to obtain pixel data (density value) for each pixel after variable magnification processing. As a result, after variable magnification processing in the sub-scannig direction, variable magnification processing in the main scanning direction is performed. The image process section 41*f* performs various image processes for input pixel data, and acquires information about a data string by, for example, extracting features. The error diffusion processing section 41*g* performs the same processing as that performed by the error diffusion processing section 40*c* of the image data input section 40. The compression processing section 41*h* compresses binary data by run-length coding. Image data is compressed in the final processing loop when final output image data is completed.

The image data output section 42 includes a restoration section 42*a,* a multivalue processing section 42*b,* an error diffusion processing section 42*c,* and a laser output section 42*d.* The image data output section 42 restores the compressed image data stored in the memory 43, converts the data into the original 256-level data, performs error diffusion of quaternary data as a halftone expression smoother than binary data, and transfers the resultant data to the laser output section 42*d.*

More specifically, the restoration section 42*a* restores the image data compressed by the compression processing section 41*h.* The multivalue processing section 42*b* performs the same processing as that performed by the multivalue processing sections 41*a* and 41*b* of the image processing section 41. The error diffusion processing section 42*c* performs the same processing as that performed by the error diffusion processing section 40*c* of the image data input section 40. In the laser output section 42*d,* digital pixel data is converted into an ON/OFF signal for the laser on the basis of a control signal from a sequence controller (not shown), and the semiconductor laser in the laser write unit 30 is turned on/off to write an electrostatic latent image on the photosensitive drum 32.

Data to be processed by the image data input section 40 and the image data output section 42 are basically stored as binary data in the memory 43 to reduce the capacity of the memory 43. However, data may be processed in the form of quaternary data in consideration of a deterioration in image quality.

Figure 4:
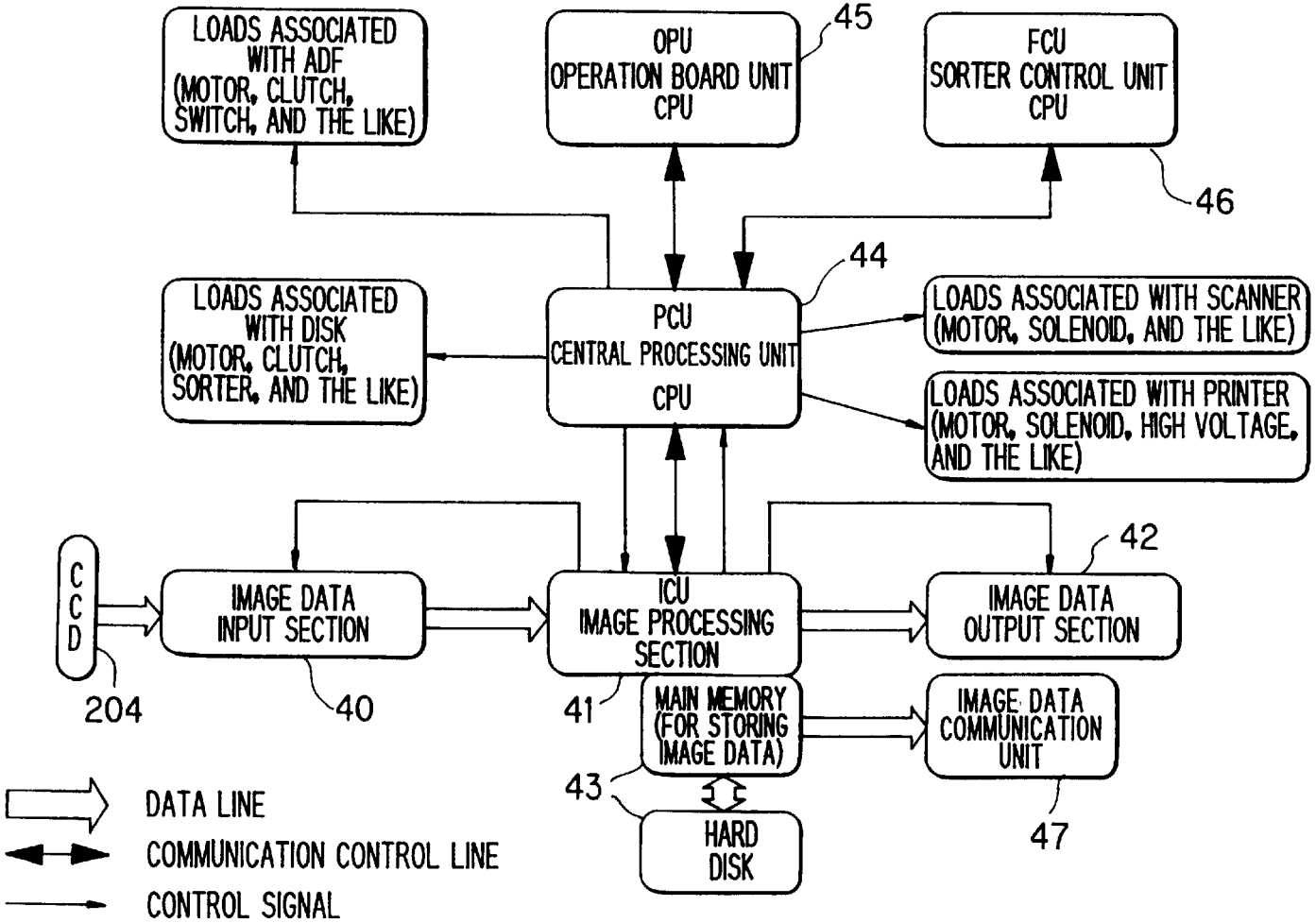
FIG. 4 is a block diagram showing the overall control system associated with image processing and sheet discharge processing, including the image processing section of the digital copying machine.

FIG. 4 shows how the central processing unit (CPU) 44 manages the operations of the respective sections in the overall digital copying machine body 1. The CCD 204, the image data input section 40, the image processing section 41, the image data output section 42, the memory 43, and the central processing unit (CPU) 44 are the same as those described above, and hence a description thereof will be omitted.

The central processing unit 44 manages the respective mechanisms, e.g., the RADF 201, the scanner section 2, and the laser recording section 3 described with reference to FIG. 2, which constitute the digital copying machine by sequence control, and outputs control signals to the respective sections.

An operation board unit 45 constituted by an operation panel is connected to the central processing unit 44 so as to allow mutual communication. The operation board unit 45 transfers a control signal to the central processing unit 44 in accordance with the copy mode set by the operator, thereby controlling the operation of the digital copying machine body 1 in accordance with various set modes.

The central processing unit 44 transfers a control signal indicating the operation state of the digital copying machine body 1 to the operation board unit 45. The operation board unit 45 then causes the display section to display the operation state in accordance with this control signal to show the operator the current state of the apparatus.

A sorter control unit 46 is a control unit for managing the operation of the discharge processing device for sorting copies and the like outputted from the digital copying machine body 1. That is, the sorter control unit 46 is the control unit for performing various control operations in the sheet discharge processing device 5 in FIG. 1.

An image data communication unit 47 serves to communicate pieces of information such as image information and control signals with other digital image devices.

Figure 5:
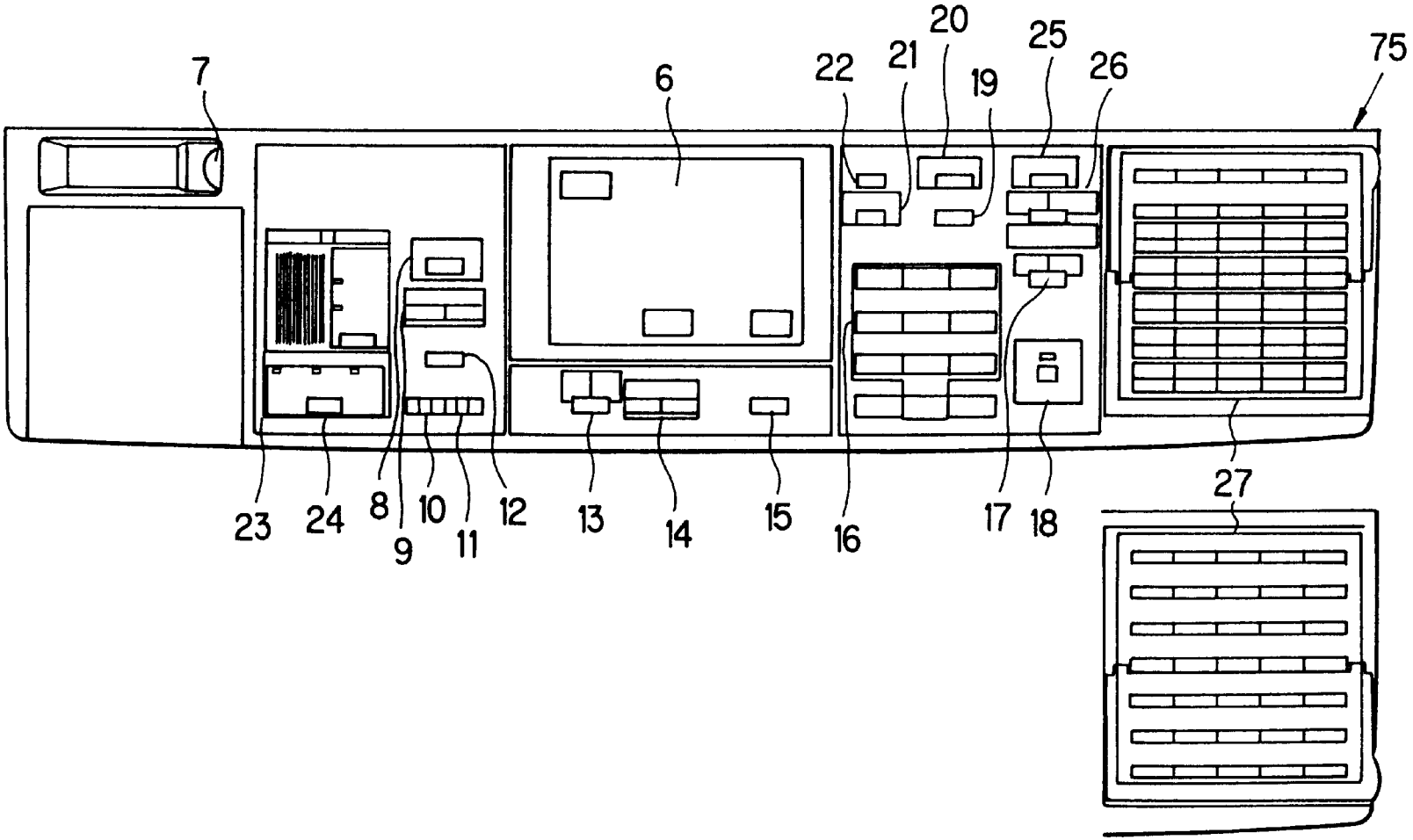
FIG. 5 is a plan view showing an example of the operation panel portion of the digital copying machine.

FIG. 5 is a plan view showing an example of the operation panel of the operation board unit 45 in the digital copying machine body 1. A touch panel liquid crystal display device 6 is placed in the central portion of the operation panel, and various mode setting keys are arranged around the touch panel liquid crystal display device 6.

A screen switching designation area for switching the current screen to a screen for allowing the operator to select an image editing function is always displayed on the screen of the touch panel liquid crystal display device 6. When this area is directly pressed with a finger of the operator, a list of editing functions is displayed on the liquid crystal screen to allow the operator to select an image editing function. When the operator touches an area in which a desired function of the displayed editing functions is displayed, the desired editing function is set.

The setting keys arranged on the operation panel will be briefly described with reference to the appended reference numerals. Reference numeral 7 denotes a dial for adjusting the brightness of the screen of the touch panel liquid crystal display device 6.

Reference numeral 8 denotes an automatic magnification setting key for setting a mode of automatically selecting a magnification; 9, a zoom key for setting a copy magnification in increments of 1%; 10 and 11, fixed magnification keys for reading out and selecting fixed magnifications; and 12, a one-to-one magnification key for restoring the copy magnification to the standard magnification (one-to-one magnification).

Reference numeral 13 denotes a density switching key for switching the copy density adjustment mode from the automatic mode to the manual mode or the photographic mode; 14, a density adjustment key for finely setting a density level in the manual or photographic mode; and 15, a tray selection key for selecting a desired paper size from the paper sizes of sheets set in the paper feed section of the copying machine.

Reference numeral 16 denotes a copy count setting key for setting the number of copies; 17, a clear key to be operated to clear the number of copies or stop a continuous copy operation; 18, a start key for designating the start of a copy operation; 19, an all cancel key for canceling all the currently set modes and restoring the standard state; 20, an interrupt key to be operated to perform a copy operation for another original during a continuous copy operation; 21, an operation guide key which is operated, when the operator does not know how to operate the copying machine, to display an operation method of the copying machine with a message; and 22, a message forward scrolling key for displaying the remaining part of the message displayed upon operation of the operation guide key 21.

Reference numeral 23 denotes a double-sided mode setting key for setting the double-sided copy mode; and 24, a discharge processing mode setting key for setting the operation mode of the sheet discharge processing device 5 for sorting copies discharged from the copying machine.

Reference numerals 25 to 27 denote setting keys associated with the printer and facsimile modes. More specifically, reference numeral 25 denotes a memory transmission mode key for setting a mode of temporarily storing transmission original data in a memory and transmitting the data afterward; 26, a copy/fax•printer mode switching key for switching the mode of the digital copying machine between the copy mode and the fax•printer mode; and 27, a one-touch dial key for allowing the operator to make a call to a destination, the telephone number of which has been stored in advance, with a one-touch operation.

An embodiment of the sheet discharge processing device mounted in the digital image forming apparatus of the present invention will be described in detail below with reference to FIG. 1. The sheet discharge processing device 5 receives sheets having undergone image formation in the above digital copying machine body 1, aligns them in a desired direction, and sorts them in a desired page order. The sheet discharge processing device 5 reverses/conveys sheets in accordance with the printer mode or the facsimile mode. In addition, the sheet discharge processing device 5 reverses/discharges sheets or discharges sheets without changing their postures in accordance with an instruction manually inputted through the above operation panel.

When a sheet having undergone image formation is conveyed from the discharge section 4 (see FIG. 2) on the digital copying machine body 1 side, the sheet is guided into the sheet discharge processing device 5 via a sheet reception opening (inlet) 50.

First convey rollers 51 for conveying a conveyed sheet are arranged at the inlet 50. The discharge processing device 5 has three discharge sections for discharging sheets, conveyed by the first convey rollers 51, to the outside through the discharge processing device 5. One of the discharge sections is a straight convey path 52 for conveying a sheet from the first convey rollers 51 toward the downstream side in the sheet convey direction without changing the posture of the sheet. The straight convey path 52 extends in the horizontal direction. Second convey rollers 53 for conveying a sheet and first discharge rollers 54 for discharging a sheet are arranged midway along the straight convey path 52. A first discharge tray 55 for receiving a sheet with the image-bearing surface facing up is placed in correspondence with the first discharge rollers 54 to protrude from the discharge processing device 5.

The second discharge section is a reverse convey path 56 that branches off from the straight convey path 52. The reverse convey path 56 is used to discharge a sheet with the image-bearing surface facing down, and extends in the vertical direction. Third convey rollers 57 and second discharge rollers 58 are arranged midway along the reverse convey path 56. A second discharge tray 59 for receiving a discharged sheet is placed below the first discharge tray 55 in correspondence with the second discharge rollers 58 to protrude from the discharge processing device 5. The image-bearing surface of a sheet conveyed into the reverse convey path 56 faces left in FIG. 1. In this arrangement alone, when a sheet is discharged onto the second discharge tray 59, it is impossible to define which direction the image-bearing surface faces.

For this reason, a guide plate 82 is vertically placed between the second discharge rollers 58 and the second discharge tray 59. A fan 80 for blowing air to the left in FIG. 1 is placed near the guide plate 82. In addition, an opening portion 81 through which air is blown is formed in the guide plate 82 in correspondence with the fan 80. This opening portion 81 is formed to direct air downward. The fan 80 corresponds to reversing/biasing means for blowing air against the rear surface of a sheet through the opening portion 81 and discharging it onto the second discharge tray 59 in a reversed state. The fan 80 is not always driven, but is driven/controlled as needed.

When an image-bearing sheet is guided into the second discharge section, the fan 80 is driven at the timing when the trailing end of the sheet separates from the second discharge rollers 58 to blow air against the rear surface of the sheet on the opposite side to the image-bearing surface. With this operation, the sheet falls and is discharged onto the second discharge tray 59 with the image-bearing surface facing the second discharge tray 59.

The third discharge section is a post-processing convey path 60 that branches off from the straight convey path 52 between the first convey rollers 51 and the second convey rollers 53, and is used to guide a sheet to a post-processing section. The post-processing convey path 60 extends in the vertical direction to be parallel to the reverse convey path 56. The post-processing convey path 60 has a sheet storing section 61. Fourth convey rollers 62 are arranged on the entrance side of the sheet storing section 61 to convey a sheet into the sheet storing section 61. The sheet storing section 61 has a stapler 63 for stapling a bundle of stored sheets, and a switching pawl 64 for regulating the leading end of a sheet and guiding a bundle of stapled sheets onto a third discharge tray 65 placed below the sheet storing section 61.

As described above, the straight convey path 52 is placed in an almost horizontal state, and the reverse convey path 56 and the post-processing convey path 60 including the sheet storing section 61 vertically extend in a direction perpendicular to the straight convey path 52 so as to be parallel to each other. A switching pawl 66 for switching the feed direction to the reverse route is placed at the branching position between the straight convey path 52 and the reverse convey path 56. A switching pawl 67 for switching the feed direction to the post-processing route is placed at the branching position between the straight convey path 52 and the post-processing convey path 60. First to third detection sensors 68 to 70 are arranged on the respective convey paths. The first detection sensor 68 detects a sheet conveyed from the first convey rollers 51. The second detection sensor 69 detects a sheet before the second discharge rollers 58 in the reverse convey path 56. The third detection sensor 70 detects the entrance of a sheet into the sheet storing section 61 of the post-processing convey path 60.

Each of the detection sensors 68, 69, and 70 is an optical sensor. For example, light-emitting and light-receiving elements are arranged on both sides of a convey path to oppose each other. When a sheet passes between the elements, the optical path is blocked. As a result, the sheet is detected. Alternatively, a microswitch is used to detect a sheet when the operation piece of the switch operates.

A sheet alignment device 71 is the main part of the sheet storing section 61. As shown in FIG. 1, the sheet storing section 61 is constituted by a space defined between first and second guide plates 61*a* and 61*b* which are arranged through a proper gap to oppose the front and back surfaces of a sheet. Guide pieces 72, each consisting of Mylar film or the like, are attached to the first and second guide plates 61*a* and 61*b* such that one end of each guide piece is fixed to the first or second guide plate 61*a* and 61*b*, and the free end of each guide piece faces down. Although the guide pieces 72 are attached to the first and second guide plates such that the free ends are separated from the guide plates, the free ends freely move toward the guide plates upon exertion of external forces.

Figure 6B:
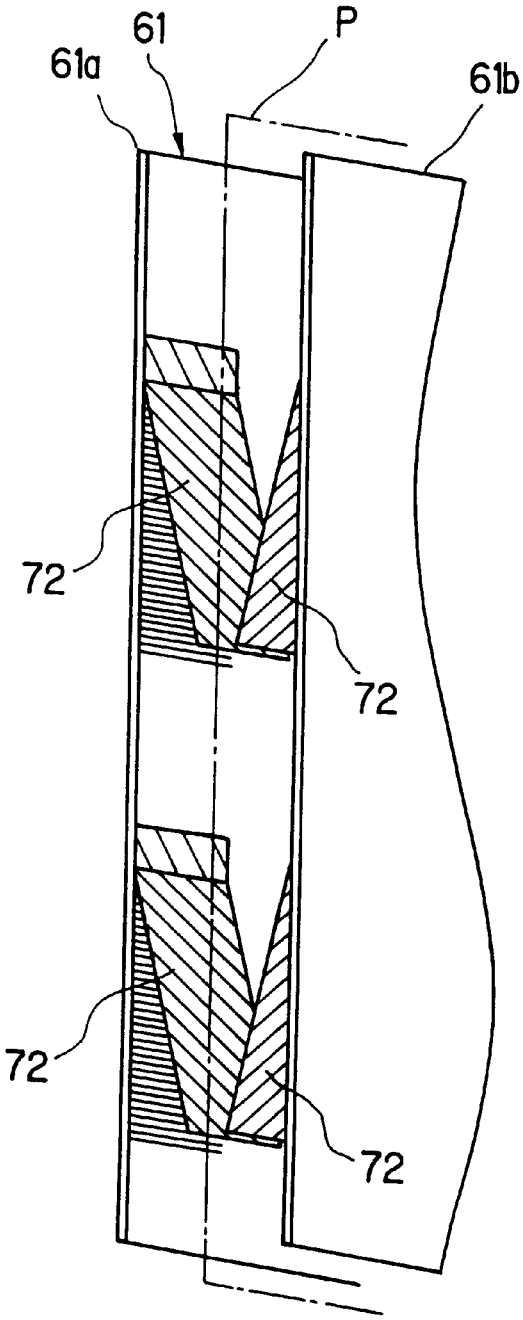
FIG. 6B shows a case wherein guide pieces are arranged at improper positions.
Figure 6A:
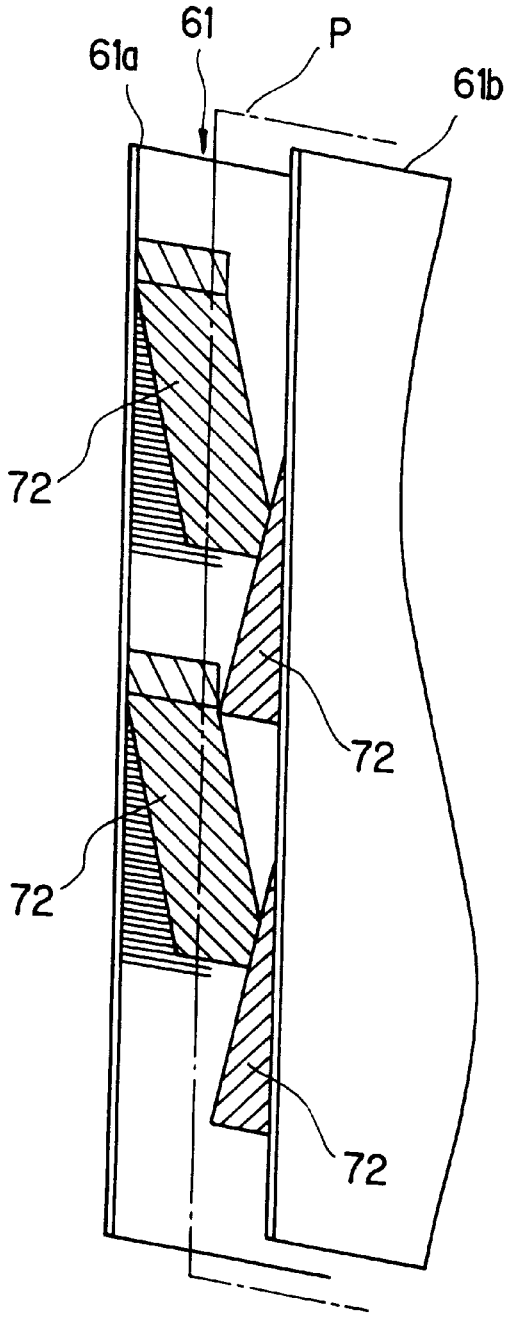
FIG. 6A shows a case wherein the guide pieces are arranged at proper positions in the present invention.

As shown in FIG. 6A, the positions of the guide pieces 72 on the first and second guide plates 61*a* and 61*b* are slightly shifted from each other in the vertical direction. The positions of the guide pieces 72 may be shifted in the horizontal direction, or may be shifted both in the horizontal and vertical directions. This arrangement prevents a sheet P conveyed into the sheet storing section 61 from being clamped between the guide pieces 72 on the two guide plates and blocked by the guide pieces 72, and also serves to guide the entire surface of a sheet.

In this arrangement, therefore, a sheet P conveyed into the sheet storing section 61 is stored therein while the sheet is separated from the first and second guides 61*a* and 61*b* by the guide pieces 72. If, however, the positions of the guide pieces 72 are the same in the vertical and horizontal directions, as shown in FIG. 6B, the sheet P guided into the sheet storing section 61 is clamped between the opposing guide pieces 72 to increase the frictional resistance between the sheet P and the guide pieces. As a result, conveyance of the sheet P is interfered and stopped, resulting in a jam or conveyance failure. In order to solve such a problem, the guide pieces 72 are arranged in the manner shown in FIG. 6A. In this arrangement, since the sheet P is not clamped between the guide pieces 72, the sheet P can be reliably guided while it is separated from the first and second guide plates 61*a* and 61*b*.

Figure 7:
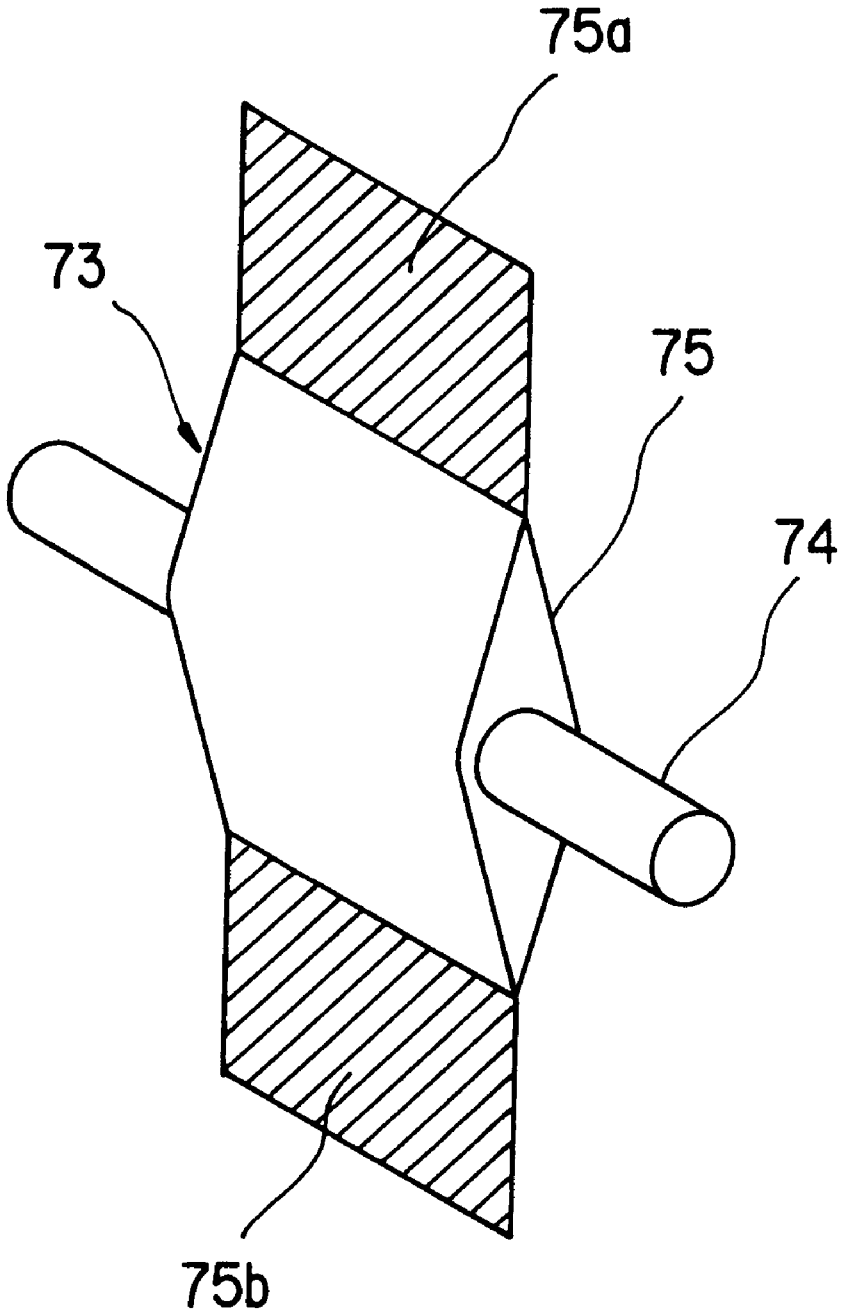
FIG. 7 is a perspective view showing a alignment guide member for aligning sheets in the present invention.

An alignment guide member 73 is rotatably placed in the sheet storing section 61. The alignment guide member 73 is a part of sheet alignment means for reliably guiding a sheet conveyed into the sheet storing section 61 thereinto, and switching the directions in which sheets are stored in the sheet storing section 61 in consideration of the page order of the sheets. As shown in FIG. 7, the alignment guide member 73 has a plurality of rotating members 75 fixed to a rotating shaft 74 at predetermined intervals. The rotating shaft 74 is rotated by a motor (not shown). Each rotating member 75 is made of an elastic member such as a rubber member, and has paddles 75*a* and 75*b* integrally formed to be symmetrical. The paddles 75*a* and 75*b* serve to guide sheets and enable alignment of the sheets. When the paddles 75*a* and 75*b* are rotated, they deform and partly slidably comes into contact with the first and second guide plates 61*a* and 61*b*. The rotating shaft 74 is rotated by a stepping motor (not shown) capable of rotating in the forward and reverse directions. This stepping motor is a part of rotating means and controlled through the sorter control unit 46.

As described above, the sheet alignment device 71 is constituted by the sheet storing section 61, the regulation switching pawl 64 placed at the bottom of the sheet storing section 61 to align the leading ends of sheets, the alignment guide member 73, and the like. The stapler 63 for stapling a bundle of sheets aligned by the sheet alignment device 71 is placed at the bottom of the sheet storing section 61. This stapler 63 has a known mechanism, and hence a detailed description thereof will be omitted. The stapler 63 fastens a bundle of sheets with a staple 63*a*, and is positioned to always drive the staple 63*a* into sheets from the same direction with respect to the sheet storing section 61.

A control operation for discharge processing of the present invention in the discharge processing device 5 will be described below. The digital copying machine body 1 has various modes, e.g., the copy mode, the facsimile mode, and the printer mode.

In general, the digital copying machine body 1 is used to copy an image on an original. In this case, the digital copying machine body 1 sequentially conveys originals by using the RADF 201, reads images, and sequentially stores them. At this time, the RADF 201 generally conveys the original of the last page first, so that images are sequentially read from the image on the original of the last page. The images are then copied. With this operation, sheets on which images are sequentially copied, starting from the image on the original of the last page, are discharged onto the discharge tray in the same page order as that of the originals.

When a copy operation is started to copy originals set in the RADF 201 in the copy mode, the image of the last page is read out from the memory, the image is formed on a conveyed sheet, and the sheet is conveyed into the discharge processing device 5 of the present invention. In this case, as is apparent, the stapler mode is also set in the this embodiment.

Figure 8:
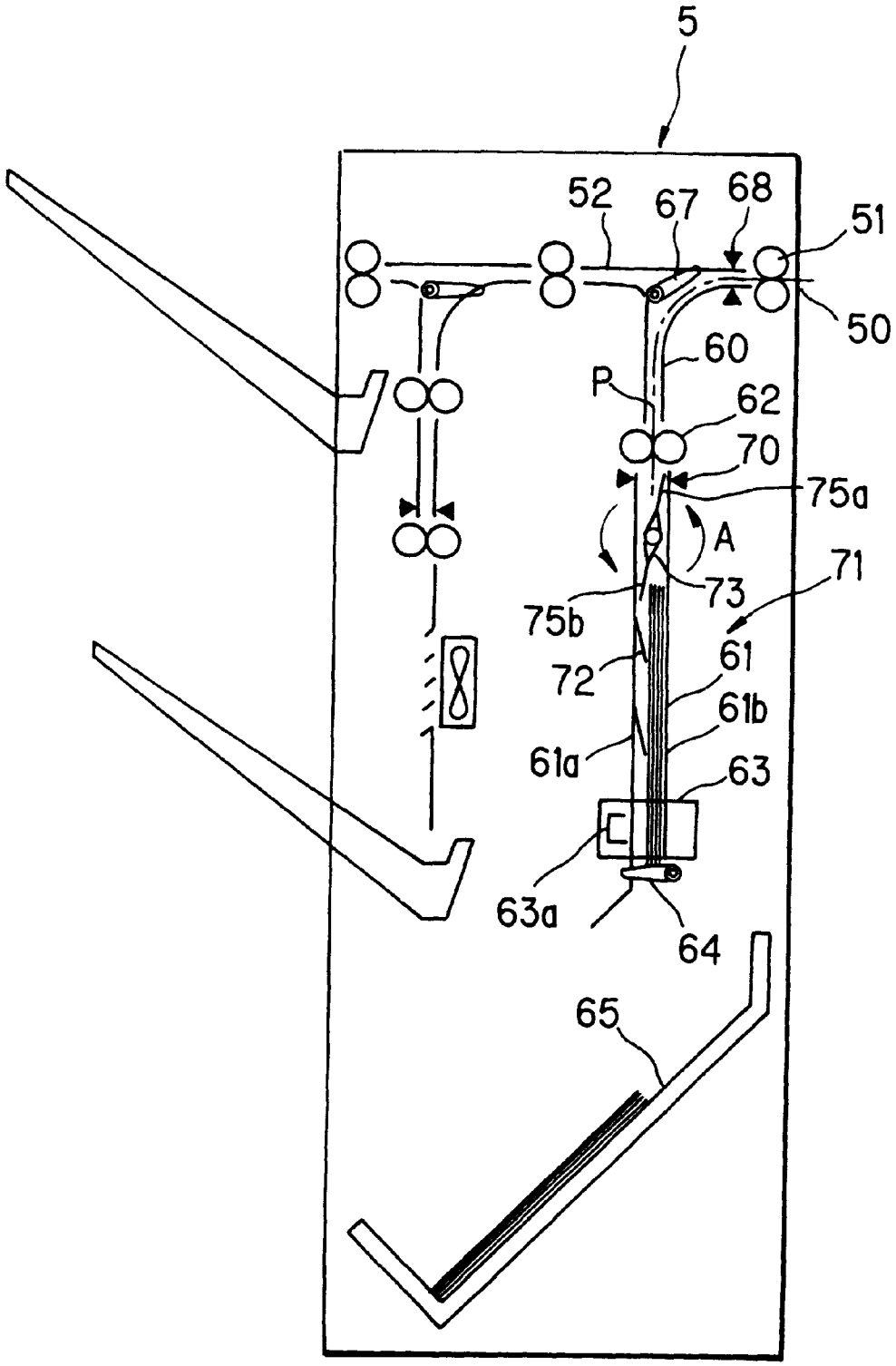
FIG. 8 is a sectional view for explaining the alignment order of sheets in the present invention when sheets are sequentially aligned from the last page.

As shown in FIG. 8, the sheet P on which an image is formed is conveyed into the discharge processing device 5 through the inlet 50 by the first convey rollers 51. The leading end of this sheet is detected by the first detection sensor 68, and a preparation for conveyance of the sheet into the post-processing convey path 60 is made. In this case, the switching pawl 67 closes the straight convey path 52 and opens the post-processing convey path 60. The switching pawl 64 closes the bottom of the sheet storing section 61 to regulate and align the leading ends of sheets. With this operation, the sheet P is guided into the post-processing convey path 60 with the leading end of the sheet P going first, and is guided into the sheet storing section 61 of the sheet alignment device 71 by the fourth convey rollers 62.

The alignment guide member 73 is set in the standby state at the position in FIG. 8 in response to, e.g., detection of the sheet by the first detection sensor 68. That is, the alignment guide member 73 is inclined to an upper right position such that the image-bearing surface is guided along the first guide plate 61*a* of the sheet storing section 61 toward the sheet storing section 61. Referring to FIG. 8, the distal ends of the paddles 75*a* and 75*b* are separated from the first guide plate 61*a* to guide the sheet through the resultant gap. The sheet P is therefore guided into the sheet storing section 61 through the paddles 75*a* and 75*b* of the rotating member 75, and the leading end of the sheet P is detected by the third detection sensor 70.

When the sheet P is further conveyed, and its trailing end is detected by the third detection sensor 70, the rotating member 75 is rotated in the counterclockwise direction (indicated by arrows A). At this time, the paddle 75*b* of the alignment guide member 73 located at a lower position moves to press a trailing end portion of the sheet P stored in the sheet storing section 61 to the right in FIG. 8, i.e., against the second guide plate 61*b*. If the sheet does not drop to the bottom of the sheet storing section 61, the paddle 75*a* strikes and pushes the trailing end of the sheet and is located at a lower position while opposing the image-bearing surface of the sheet. The paddle 75*a* is stopped in this state. That is, the rotating member 75 is rotated a half revolution and stopped. At this stop position, the paddles 75*a* and 75*b* are reversed in the vertical direction to wait for conveyance of the next sheet.

With the above operation, the sheet P is conveyed into the sheet storing section 61 with the image-bearing surface being guided along the first guide plate 61*a*. Finally, when the rotating member 75 is rotated, the last sheet P stored in the sheet storing section 61 is pressed against the second guide plate 61*b* by the paddle 75*a* or 75*b*. As a result, the sheets P are sequentially stored and aligned such that the sheet P is stacked on the image-bearing surface of the preceding sheet P. This aligned state is called "the first alignment order".

Figure 9:
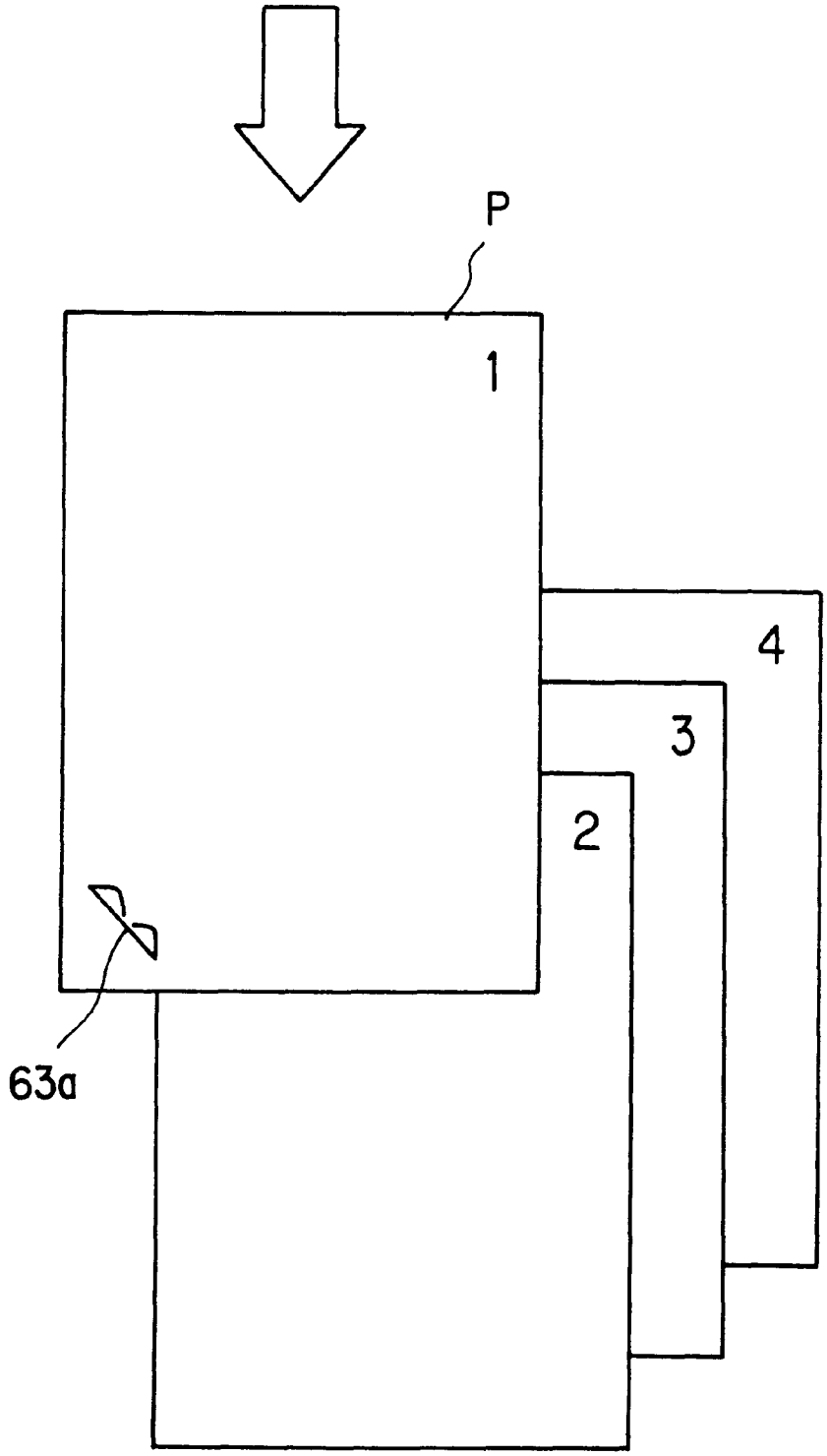
FIG. 9 is a view for explaining the order of sheets to be aligned in FIG. 8.

Assume that the number of originals is four, and images are formed on four sheets. In this case, as shown in FIG. 9, the sheet P on which the image of the last page (fourth page) is formed opposes the first guide plate 61*a* first, whereas the sheet P on which the image of the start page (first page) is formed is about to oppose the first guide plate 61*a*. When the sheet P on which the image of the start page (first page) is formed is stored while opposing the first guide plate 61*a*, alignment of one set of sheets is completed, and the stapler 63 operates to drive the staple 63*a* into a necessary portion.

A bundle of stapled sheets is discharged onto the third discharge tray 65. For this purpose, the switching pawl 64 is rotated to open the bottom of the sheet storing section 61, and the bundle of the stapled sheets is discharged onto the third discharge tray 65 by its own weight.

The above description is about the post-processing for sheets in the copy mode. When a plurality of sets of copies are required, one set of copies is formed first, and the next set of copies is then formed by repeating the above operation. After a discharge operation is completed, therefore, the switching pawl 64 is operated to close the bottom of the sheet storing section 61 and make a preparation for alignment of sheets in order to perform post-processing for the next set of copy sheets.

In general, when the facsimile or printer mode is set, image data are sequentially transferred, starting from the first page, from an external unit, e.g., a facsimile apparatus, a wordprocessor, or a personal computer. When this mode is set, therefore, images are sequentially formed on sheets from the start page to the last page.

Figure 10:
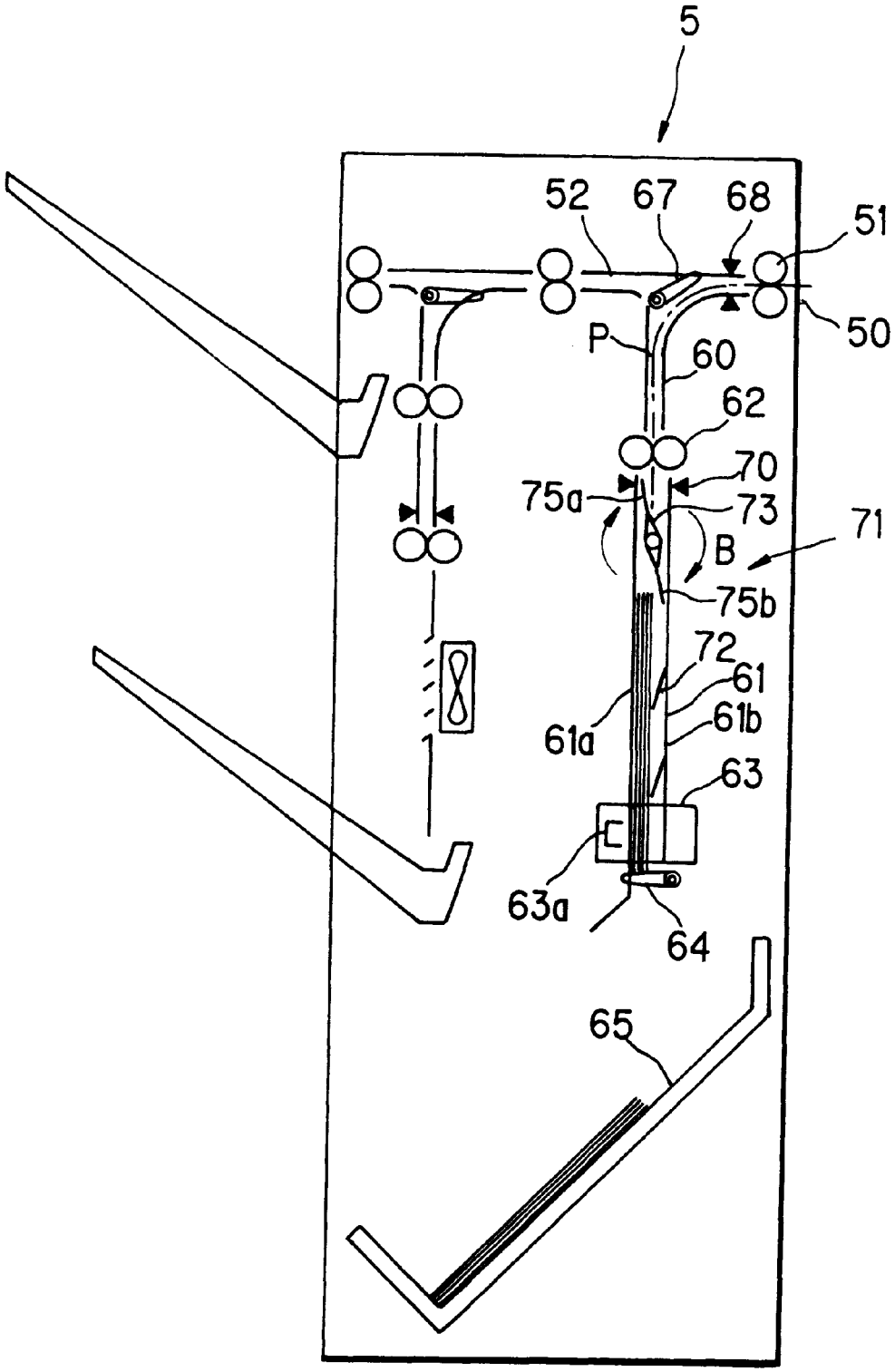
FIG. 10 is a sectional view for explaining the alignment order of sheets in the present invention when sheets are sequentially aligned from the start page.

If the stapler mode is set at the same time, the discharge processing device 5 makes a preparation for reception of sheets. For example, the switching pawl 67 closes the straight convey path 52 and opens the post-processing convey path 60. The alignment guide member 73 is inclined to an upper left position, as shown in FIG. 10. The alignment guide member 73 is positioned to guide the sheet P into the sheet storing section 61 along the second guide plate 61*b*.

The image-bearing sheet P is conveyed by the first and fourth rollers 51 and 62, so that the leading end is guided along the second guide plate 61*b*, and the sheet is gradually conveyed into the sheet storing section 61. When the trailing end of the sheet P is detected by the third detection sensor 70, the alignment guide member 73 is rotated in the clockwise direction (indicated by arrows B). The alignment guide member 73 is rotated a half revolution and stopped at the position in FIG. 10, thus completing the preparation for reception of the next sheet P.

When the next sheet P is conveyed, the sheet P is guided along the second guide plate 61*b* and stored into the sheet storing section 61. When the rotating member 75 is rotated in response to detection of the trailing end of the sheet P by the third detection sensor 70, the surface of the sheet P on which the image of the start page is formed is pressed against the first guide plate 61*a* by the paddle 75*a* or 75*b*. In this manner, the stored sheets P are sequentially aligned. As a result, the sheets P stored in the sheet storing section 61 are aligned in the page order, with the start page opposing the first guide plate 61*a*. The above state is called "the aligned state of sheets in the second order".

Figure 11:
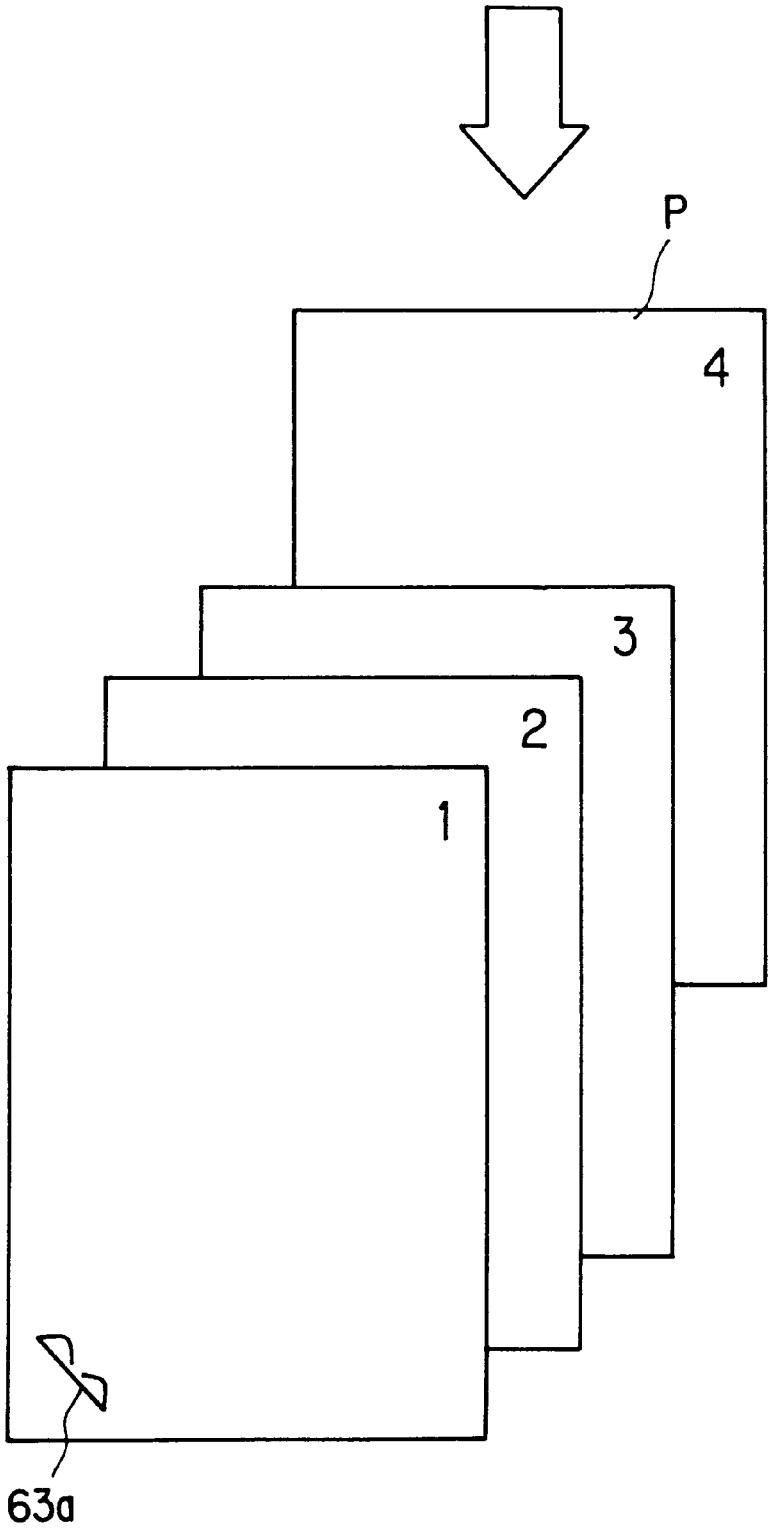
FIG. 11 is a view for explaining the order of sheets to be aligned in FIG. 10.

When the sheet P on which the image of the last page is formed is stored in the sheet storing section 61, and rotation of the alignment guide member 73 is completed, one set of image-bearing sheets P are aligned in the page order. When this alignment is completed, the stapler 63 operates to drive the staple 63*a* into the sheets P at a desired position, thus completing the stapling operation. The bundle of the stapled sheets is discharged onto the third discharge tray 65 upon operation of the switching pawl 64. FIG. 11 shows the alignment order and aligned state of the sheets P in this case. As shown in FIG. 11, the sheets P are sequentially stored and aligned from the first page to the fourth page. The sheets P are fastened with the staple 63*a* upon completion of alignment.

As described above, image-bearing sheets are aligned in the sheet storing section 61 without upsetting the page order. Image formation is performed either from the last page or from the first page. In either case, sheets conveyed into the post-processing convey path 60 and the sheet storing section 61 can be adjusted in the first or second order in accordance with the order in which images are formed on the sheets. For this reason, this device does not require any reverse convey route for sheets, means for selecting this route, and the like which are required in the conventional device. Therefore, the overall size of the sheet discharge processing device can be greatly reduced, and unnecessary convey routes can be omitted, allowing a great reduction in cost.

In addition, since a sheet need not be reversed/conveyed, the sheet convey cycle need not be set to a value equal to or lager than the length of a sheet. The sheet convey cycle can be shortened, and alignment of sheets can be continuously performed, as described above. Even if, therefore, the speed of image formation in the image forming apparatus increases, alignment and post-processing for sheets can be properly performed.

The stapler 63 for performing post-processing for a bundle of sheets can always drive the staples 63*a* into sheets from the same direction. This is very important. In the conventional device, when sheets are to be discharged in different page orders, sheets are reversed, and hence the driven state of the staples 63*a* is also reversed. If sheets are discharged without reversing them, the staple 63*a* is driven from the first page side. In contrast to this, when sheets are reversed and discharged, the staple 63*a* is driven from the last page side. As a result, the driven states of the staples 63*a* become opposite to each other. If staples are to be driven from the same side, another stapler may be used to drive a staple from the same side, or the stapler may be moved to drive a staple from the same side. In this case, very complicated mechanism and arrangement are required, and a space for movement of the stapler is required, resulting in an increase in the size of the device.

With regard to this point, according to the sheet discharge processing device of the present invention, as shown in FIGS. 9 and 11, the staples 63*a* are driven at the same position on the same image-bearing surface, so that bundles of sheets are neither stacked on each other nor catch each other. For this reason, only one stapling mechanism is required, and a reduction in the size of the device can be attained.

Alignment of sheets can be performed by only switching the alignment orders of sheets in accordance with the order of image formation. On the image forming apparatus side, i.e., the digital copying machine body 1 side, images may be formed in the read order or the order in which image data are transferred from an external unit. For this reason, all the image data for image formation need not be stored in the image forming apparatus body, and sheets can be sorted on the discharge processing device 5 side without increasing the capacity of the storage memory.

The sheet alignment device 71 will be further described in detail. The sheet alignment device 71 uses the space defined by the first and second guide plates 61*a* and 61*b* constituting the sheet storing section 61. The guide plates 61*a* and 61*b* are partly notched, and the alignment guide member 73 is placed to oppose the notched portions.

This structure will be described in detail with reference to FIG. 12. Notched portions 76 are formed in the first and second guide plates 61*a* and 61*b* such that lower edges 76*a* are located at a position where the trailing end portion of the sheet P stored in the sheet storing section 61 slightly protrudes therefrom. The rotating shaft 74 of the alignment guide member 73 is positioned in the middle of each notched portion 76. The rotating member 75 is fixed to the rotating shaft 74, and the paddles 75*a* and 75*b* are formed on the upper and lower end portions of the rotating member 75.

The lengths of the paddles 75*a* and 75*b* are set such that the distal ends of the paddles slightly extend beyond the edges 76*a* and 76*b*. With this structure, when the alignment guide member 73 is rotated, the trailing end portion of the stored sheet P can be pressed against one guide plate by the distal end of one paddle 75*a* or 75*b*. On the other paddle 75*b* or 75*a* side, the alignment guide member 73 is rotated at the timing when the trailing end of a sheet is detected. In order to make the alignment guide member 73 have the effect of striking the trailing end of a sheet downward, the lengths of the paddles are set such that the distal end of each paddle is located slightly above the trailing end detection position. For this purpose, the upper edge 76*b* of each notched portion 76 is set slightly above the position where the trailing end of a sheet is detected by the third detection sensor 70, and the lengths of the paddles 75*a* and 75*b* are set such that the distal end of each paddle slightly extends beyond the upper edge 76*b* of each notched portion.

According to the above description, the upper edge 76*b* of each notched portion 76 is located sightly above the position where the trailing end of a sheet is detected by the third detection sensor 70. However, the present invention is not limited to this. It suffices if the distal end of at least one of the paddles 75*a* and 75*b* is located above the position where the trailing end of a sheet is detected by the third detection sensor 70. With this structure, the trailing end of a sheet is detected when the trailing end of the sheet comes below the distal end of one of the paddles, so that the sheet can be struck downward by the paddle.

In the above structure, the alignment guide member 73 is rotated to the position in FIG. 8 (corresponding to FIG. 12A) and set in the standby state in the copy mode, and is rotated to the position in FIG. 10 (corresponding to FIG. 12C) and set in the standby state in the printer/facsimile mode. Every time a sheet is fed and its trailing end is detected by the third detection sensor 70, the alignment guide member 73 is rotated through 180° from the standby/standstill state in the direction indicated by the arrow A and B (this state corresponds to FIG. 12B or 12D). When the alignment guide member 73 is rotated, the lower paddle 75*a* or 75*b* is transformed while it presses the trailing end portion of a bundle of stored sheets against one of the first and second guide plates 61*a* and 61*b*. The paddle then moves onto the trailing edge portion of the bundle of sheets and opposes the fourth convey rollers 62 side through the notched portion 76 so as to guide the conveyed sheet toward the other guide plate, i.e., the second guide plate 61*b* or the first guide plate 61*a*. If the sheet is not completely stored in the sheet storing section 61, the paddle 75*a* or 75*b* which has been located on the fourth convey rollers 62 side strikes the trailing end of the sheet downward, and presses the bundle of stored sheets against the other guide plate. With this operation, the currently stored sheet can be aligned to the bundle of sheets which have already been stored.

Alternatively, as shown in FIGS. 12A to 12D, the paddle 75*a* or 75*b* of the alignment guide member 73 may be extended such that the distal end of the paddle is located slightly below the trailing end of a stored sheet, and the lower edge 76*a* of each notched portion 76 is formed below the trailing end of a sheet. With this structure, stored sheets can be pressed against one of the first and second guide plates 61*a* and 61*b*. That is, the stored sheets can be pressed against one guide plate without attaching the guide pieces 72 to the inner surfaces of the guide plates 61*a* and 61*b*. As is apparent, if the guide pieces 72 are also arranged on the guide plates, stored sheets can be pressed against one guide plate and aligned more reliably.

Figure 13:
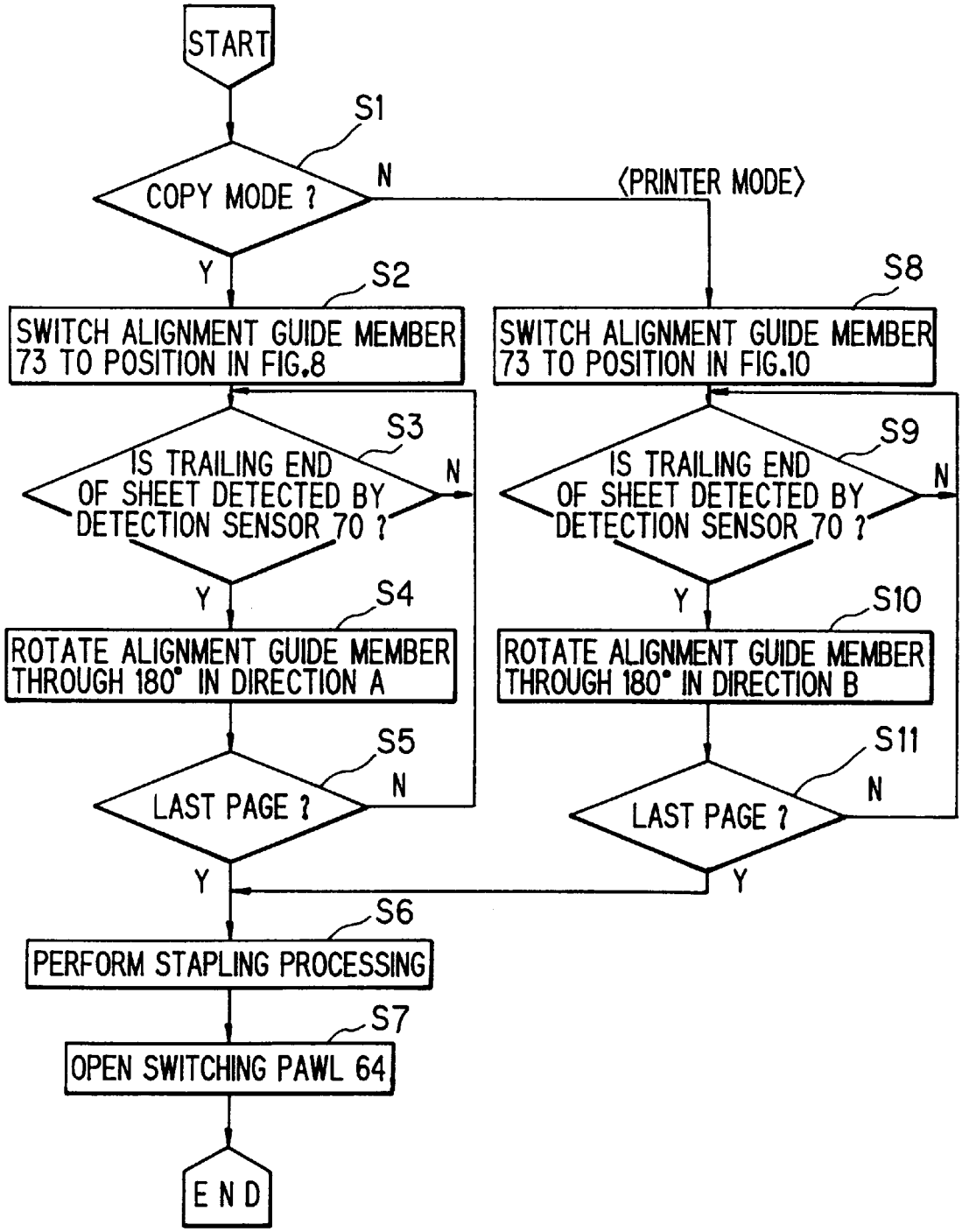
FIG. 13 is a flow chart showing an example of how control is performed in the alignment order of sheets in the present invention.

FIG. 13 is as flow chart showing a procedure for controlling the above operation. The control operation will be described with reference to this flow chart. The current mode is checked by the sorter control unit (FCU) 46 for sheet discharge processing. That is, the sorter control unit 46 checks in step 1 (S1) whether the copy mode is set. If the copy mode is determined (Y in S1), the alignment guide member 73 is set in the standby state at the position in FIG. 8 to guide a sheet conveyed into the sheet storing section toward one guide plate side. If the copy mode is not determined (N in S1), it is determined that the printer mode is set, and the flow advances to step 8 (S8) to switch the alignment guide member 73 to the position in FIG. 10 and set it in the standby mode.

When an image-bearing sheet is conveyed into the sheet storing section 61, and it is determined that the trailing end of the sheet is detected by the third detection sensor 70 (Y in S3 or S9), the alignment guide member 73 is rotated through 180° in a direction A in the copy mode, or rotated through 180° in a direction B in the printer mode (S4 or S10).

In the copy mode, images are sequentially formed on sheets from the last page, and the sheets are conveyed into the discharge processing device 5. In order to align the sheets in the first order, the alignment guide member 73 is set in the standby state at the position in FIG. 8, and is rotated through 180° in the direction A in response to detection of the trailing end of a sheet. In the printer mode (including the facsimile mode), since images are sequentially formed on sheets from the start page, the alignment guide member 73 is set in the standby state at the position in FIG. 10, and is rotated through 180° in the direction B in response to detection of the trailing end of a sheet.

With this rotation, as described above, a bundle of sheets stored in the sheet storing section 61 is pressed against one of the first and second guide plates 61*a* and 61*b*, and the currently conveyed sheet is aligned to the bundle of sheets to wait for reception of a sheet which is conveyed next.

If the sheet stored in the sheet storing section 61 is not the last page (the last image-bearing sheet) (N in S5 or S11), the above operation is repeated. If it is determined that the sheet is the last page (Y in S5 or S11), the stapler 63 operates to complete a stapling operation regardless of whether the current mode is the copy mode or the printer mode (S6). Upon completion of this stapling operation, the switching pawl 64 is opened (S7) to discharge the bundle of sheets having undergone stapling processing onto the third discharge tray 65.

According to the sheet alignment device 71 having the above structure, if sheets to be processed have the same length, i.e., the same length in the feed direction, the sheet can be effectively aligned in accordance with rotation control of the alignment guide member 73. There are demands for a sheet alignment device which can efficiently perform sheet alignment even if sheets to be processed have different lengths.

Figure 14:
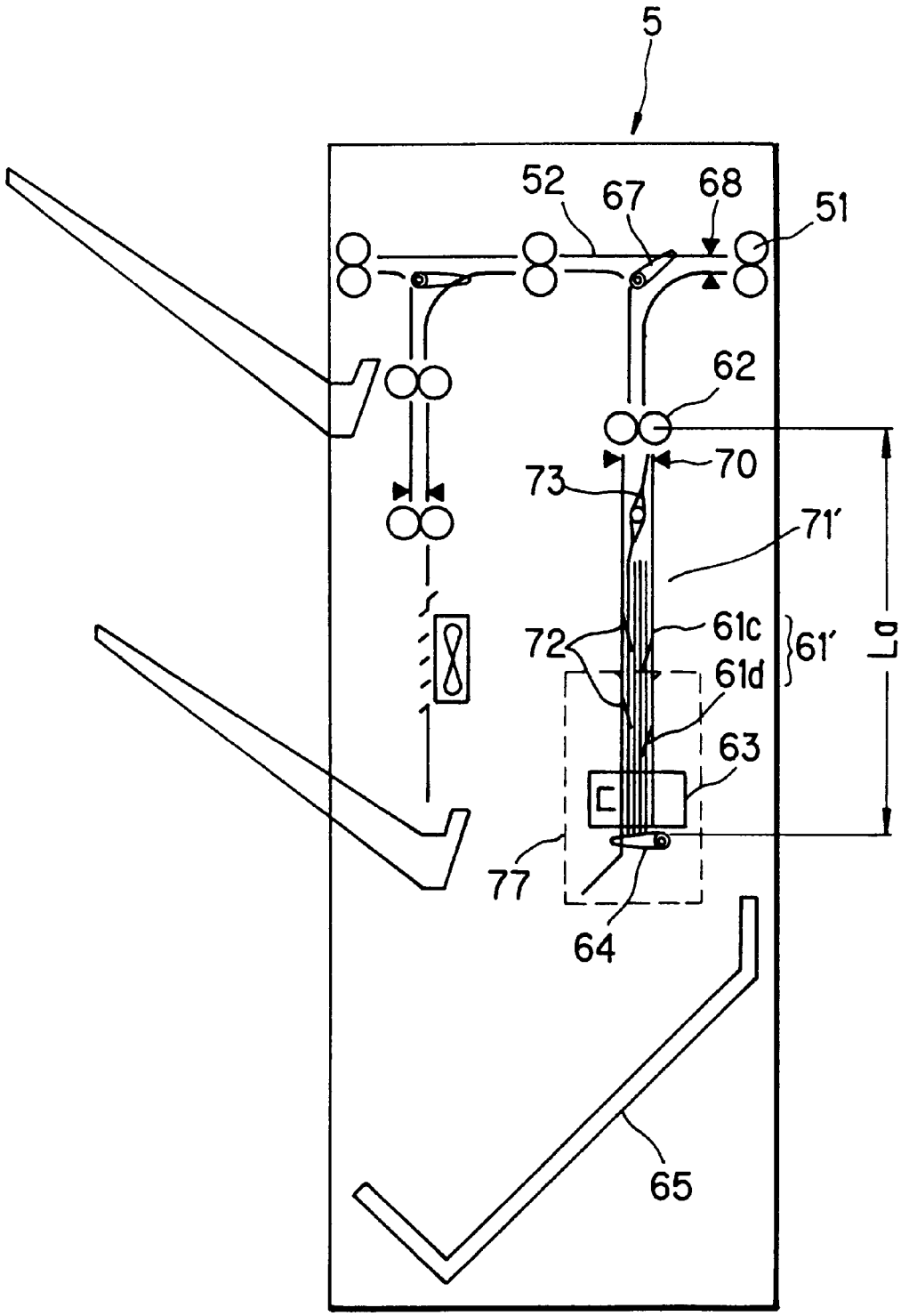
FIG. 14 is a sectional view showing another embodiment of the sheet storing section capable of processing sheets to align them in accordance with the size of each sheet in the present invention, more specifically, the stored state of sheets of the minimum size.
Figure 15:
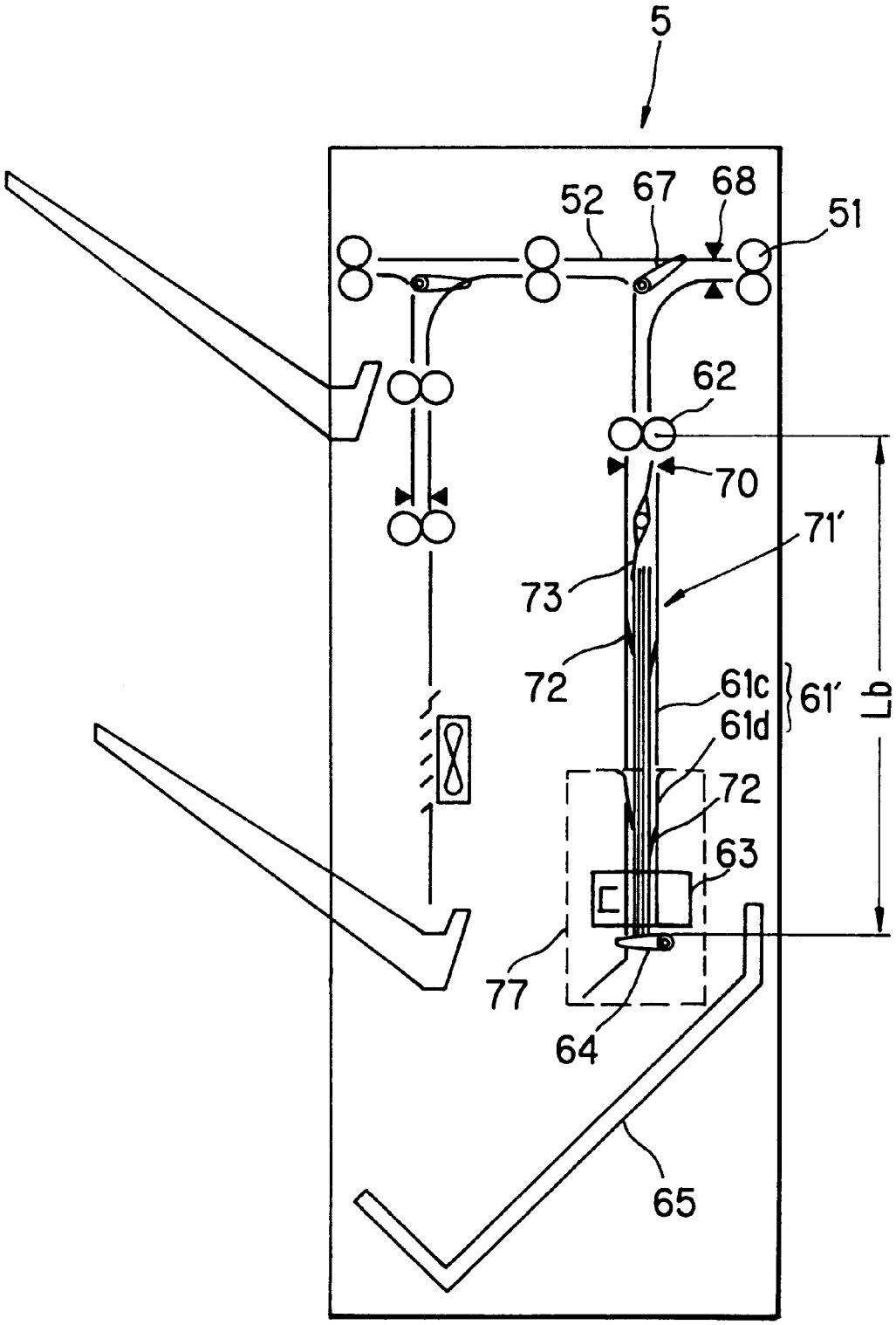
FIG. 15 is a sectional view showing the stored state of sheets of the maximum size in the sheet storing section in FIG. 14.

FIGS. 14 and 15 show another embodiment of the sheet alignment device. In a sheet alignment device 71', a sheet storing section 61' is divided into a fixed, upper sheet storing section 61*c* and a vertically movable, lower sheet storing section 61*d*.

The width of the upper sheet storing section 61*c* (the distance between guide plates 61*a* and 61*b*) is set to be slightly smaller than that of the lower sheet storing section 61*d* such that the upper sheet storing section 61*c* is partly stored in the lower sheet storing section 61*d*. In the lower sheet storing section 61*d*, both a stapler 63 and a switching pawl 64 are supported on a common support member 77. The support member 77 is vertically movable. FIG. 14 corresponds to a shortest (La) sheet. In this state, the upper sheet storing section 61*c* is partly stored in the lower sheet storing section 61*d*. FIG. 15 corresponds to a longest (Lb) sheet. In this state, the upper sheet storing section 61*c* is separate from the lower sheet storing section 61*d*, and the end portions of the two storing sections oppose each other. In this case, since the upper and lower sheet storing section 61*c* and 61*d* have sheet guide pieces 72 for separating a stored sheet from the guide plates 61*a* and 61*b*, even if there is a slight gap between the two end portions of the upper and lower sheet storing sections 61*c* and 61*d*, sheets can be satisfactorily guided into the lower sheet storing section 61*d*.

According to the structure of the sheet alignment device 71' in FIGS. 14 and 15, by controlling the vertical moving position of the lower sheet storing section 61*d*, the trailing ends of stored sheets can be pressed against one of the first and second guide plates 61*a* and 61*b* by the rotating puddle 75*a* or 75*b* of the alignment guide member 73. Therefore, the sheets can be aligned without disturbing the page order.

In this case, the size of a sheet is detected when the sheet is processed in the digital copying machine body 1 as an image forming apparatus. For example, when a sheet of a selected sized is fed from the cassette paper feeder 34*a*, and information of this size is sent to the discharge processing device 5, the vertical position of the lower sheet storing section 61*d* can be easily adjusted/controlled in accordance with the size.

In addition, the discharge processing device 5 has a detection sensor. By using this detection sensor, the size of a sheet is detected on the discharge processing device 5 side. The vertical position of the lower sheet storing section 61*d* can be adjusted/controlled on the basis of the sheet size.

As the above detection sensor, the first detection sensor 68 for detecting conveyance of a sheet can be used to detect the size of a conveyed sheet. More specifically, a time counting operation is started by using a timer when the leading end of a sheet is detected by the first detection sensor 68, and the time counting operation is stopped when the trailing end of the sheet is detected. The size of the sheet can be easily obtained on the basis of the time counted by the timer. Not only the size of a standard sheet but also the size of a non-standard sheet can be detected. Alignment of the vertical position of the lower sheet storing section 61*d* in the vertical position can be controlled on the basis of the detected size so as to reliably cause the lower paddle to press the trailing end of the sheet to be processed against one guide plate.

In the above case, the sheet storing section 61 is vertically divided into two sections, and one sheet storing section 61 is vertically moved on the basis of the size of a sheet to be processed. Alternatively, the size of the sheet storing section 61 may be set in correspondence with the maximum size of a sheet to be processed, and the alignment guide member 73 may be designed to be movable in the vertical direction. With this arrangement, the same effect as described above can be obtained. That is, by moving the alignment guide member 73 in the vertical direction in accordance with the size of a sheet, the trailing end of the stored sheet can be reliably pressed against one of the first and second guide plates 61*a* and 61*b* so as to enable accurate alignment of sheets.

In this case, the length of each notched portion 76 may be determined in accordance with the vertically movable alignment guide member 73. Especially, the lower edge 76*a* of each notched portion 76 may be determined in accordance with a sheet of the minimum size. That is, it suffices if each notched portion 76 is formed such that the lower edge 76*a* is located slightly below the trailing end of a sheet of the minimum size to be stored. If, however, the guide pieces 72 are to be attached to the first and second guide plates 61*a* and 61*b*, the notched portions 76 are not constituent elements. That is, with the guide pieces 72, sheets are stored while they are separated from the guide plates 61*a* and 61*b*, and hence the sheets can be aligned accurately by rotating the alignment guide member 73.

An example of how control is performed to allow the stapler 63 to perform a stapling operation in a good state upon completion of the above sheet alignment will be described next. That is, an example of how control is performed to properly staple aligned sheets without displacing the sheets will be described below.

When a sheet of the last or start page is conveyed and stored in the sheet storing section 61 in the copy or printer mode, the alignment guide member 73 is rotated through 180° in response to detection of the trailing end of the sheet. With this operation, stored sheets are aligned, and the last sheet is also aligned. When the alignment guide member 73 is rotated, the sheets aligned by one of the puddles 75*a* and 75*b* are pressed against one of the first and second guide plates 61*a* and 61*b*. In this state, the rotation of the alignment guide member 73 is stopped. With this operation, a bundle of stored sheets is kept standstill while the trailing end portion of the bundle is clamped between the paddle and the guide plate, the bundle of sheets are not displaced.

Figure 12A:
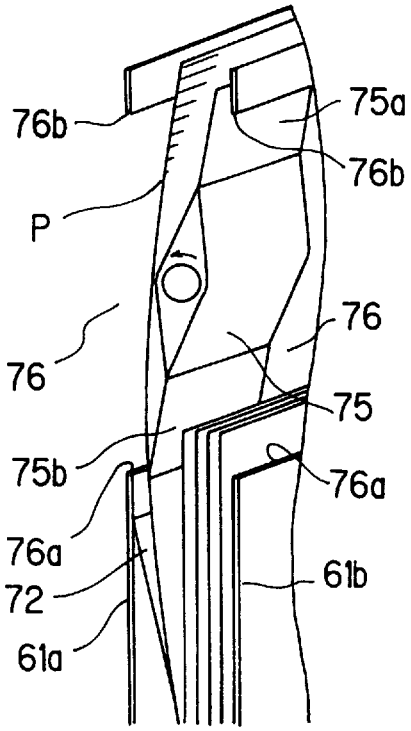
FIG. 12A shows the stored state of sheets in the copy mode.
Figure 12B:
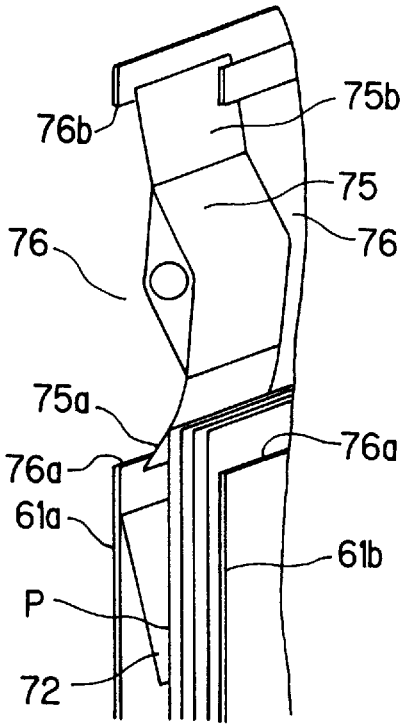
FIG. 12B shows the aligned state of sheets and their state in a stapling operation in the copy mode.

The above operation will be described in detail with reference to FIGS. 12A to 12D. In the copy mode, when the last sheet P is conveyed into the sheet storing section 61 in the state shown in FIG. 12A, and the trailing end of the sheet is detected, the alignment guide member 73 is rotated through 180° in the direction indicated by the arrow. In the process of this rotation, the previously stored sheets P are pressed against the second guide plate 61*b* by the paddle 75*b*. When the alignment guide member 73 is further rotated, the paddle 75*a* opposes the image-baring surface of the last sheet P. In general, after the alignment guide member 73 is rotated through 180°, the rotation of the member is stopped. However, when the last sheet P is conveyed, the alignment guide member 73 is further rotated to cause the paddle 75*a* to press the overall bundle of stored sheets against the second guide plate 61*b*. Thereafter, the rotation of the alignment guide member 73 is stopped. FIG. 12B shows this state. As shown in FIG. 12B, the trailing end portion of the sheets P is clamped between the second guide plate 61*b* and the paddle 75*a*, and the aligned bundle of sheets is kept standstill, thereby allowing the stapler 63 to staple the sheets without displacing them.

Figure 12C:
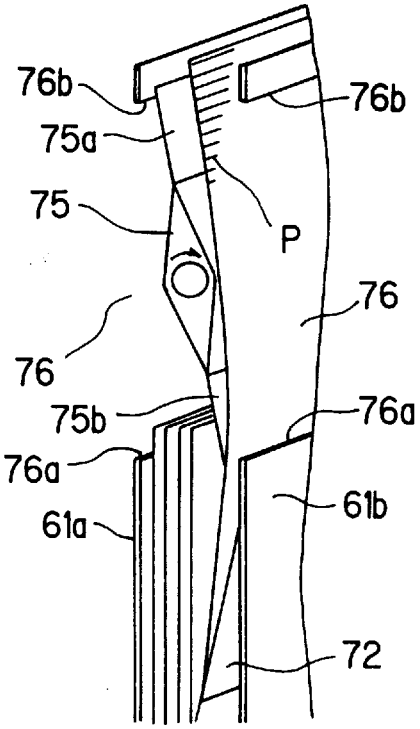
FIG. 12C shows the stored state of sheets in the printer mode.
Figure 12D:
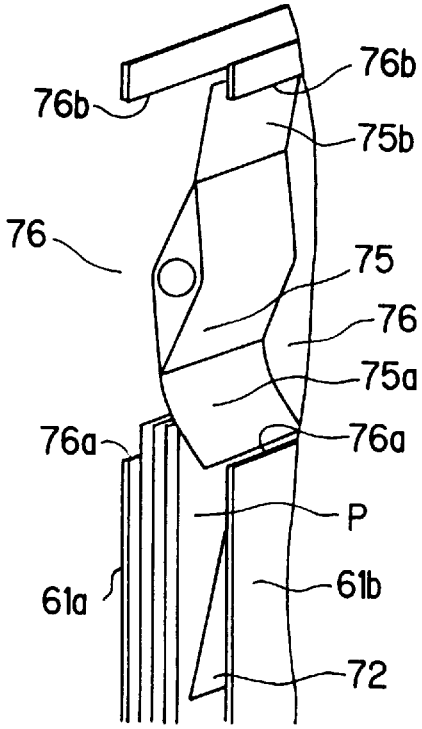
FIG. 12D shows the aligned state of sheets and their state in a stapling operation in the printer mode.

In the printer mode, as shown in FIG. 12C, when the last sheet P is conveyed into the sheet storing section 61, and the trailing end of the sheet is detected, the alignment guide member 73 is rotated in the direction indicated by the arrow. With this operation, the paddle 75*ba* presses a bundle of stored sheets P against the first guide plate 61*a*. When the alignment guide member 73 is further rotated, the paddle 75*a* opposes the surface of the last sheet P opposite to its image-bearing surface. Even after the alignment guide member 73 is rotated through 180°, the member is continuously rotated. As a result, the paddle 75*a* presses the overall sheets including the last sheet P against the first guide plate 61*a* in the manner shown in FIG. 12D. At this pressing position, the rotation of the alignment guide member 73 is stopped, and the aligned bundle of sheets is stapled by the stapler 63 without being displaced.

As described above, at the timing when the alignment guide member 73 is stopped, the stapler 63 is operated to staple a bundle of sheets in a stable state with the staple 63*a*. In stapling processing, therefore, sheets are not stapled while they are displaced from each other, but are stapled while they are kept aligned. The same applies not only to stapling as post-processing but also to punching to be performed to form a punch hole at a predetermined position of each sheet so as to file the sheets. Since the movement of each sheet can be regulated in punching, a hole can be formed in each sheet at an aligned proper position.

Jam processing in the sheet storing section 61 in the present invention which performs post-processing for sheets when a convey failure, especially a jam, occurs in the discharge processing device 5 will be described below.

Figure 16A:
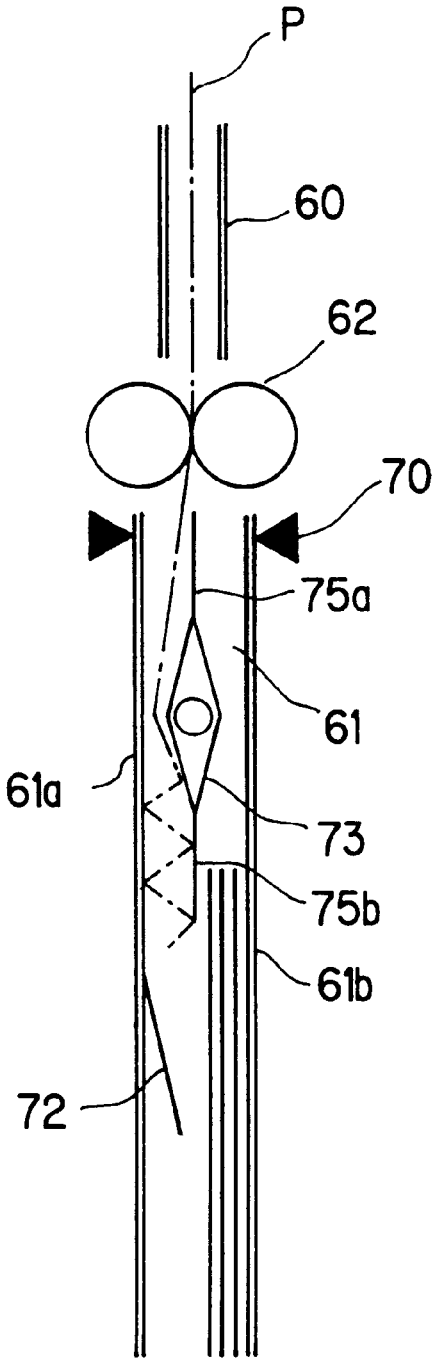
FIG. 16A shows the state of a jam near the convey rollers.

Assume that a sheet P is jammed while it is guided into the sheet storing section 61, as shown in FIG. 16A. In this case, the alignment guide member 73 is rotated and stopped such that the paddles 75*a* and 75*b* become parallel to the guide plates 61*a* and 61*b* of the sheet storing section 61, as shown in FIG. 16A. In this case, the frictional resistance between the alignment guide member 73 and the sheet P decreases to facilitate removal of the sheet P. In addition, since the end portions of the alignment guide member 73 are the paddles 75*a* and 75*b* made of elastic members, even if the sheet P is forcibly removed, the paddles are transformed only, but damage such as breakage of the paddles can be prevented.

Means for detecting a convey failure of a sheet P will be described below. The third detection sensor 70 detects a sheet P while it is conveyed to the sheet storing section 61 by the fourth convey rollers 62. This detection state, i.e., the time taken for the trailing end of the sheet P to pass through the third detection sensor 70 after detection of the leading end of the sheet P is determined in accordance with the size of the sheet subjected to discharge processing. Since the sheet size is detected in advance, as described above, if the sheet P is detected by the third detection sensor 70 after the lapse of the time taken to detect the leading end of the sheet P to the trailing end thereof, a convey failure in the state shown in FIG. 16A can be detected. In response to detection by this convey failure detection means, the alignment guide member 73 may be driven to rotate to a position where it does not interfere with the sheet to be processed.

Figure 16B:
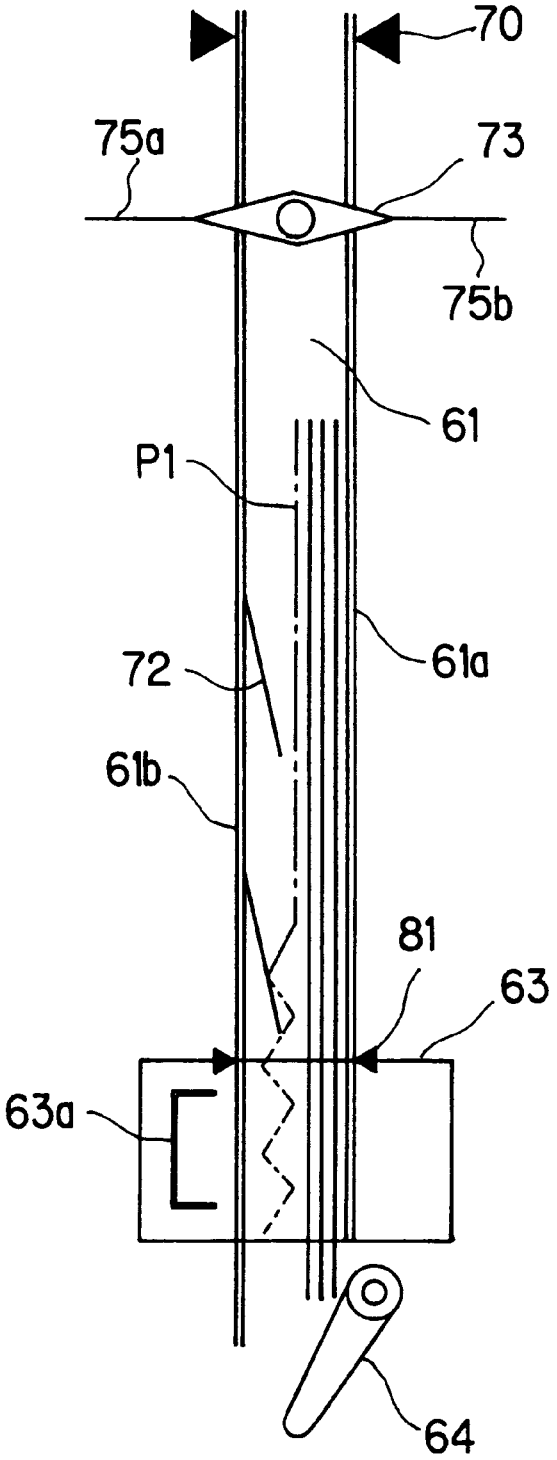
FIG. 16B shows a convey failure near a stapling mechanism.

If the trailing end of the sheet P has already passed through the third detection sensor 70, as shown in FIG. 16B, a convey failure of the sheet P cannot be detected by the third detection sensor 70. Accordingly, when a convey abnormality of a sheet P1 occurs near the stapler 63, a bundle of sheets may remain in the sheet storing section 61 after stapling processing as final processing. Furthermore, even if the switching pawl 64 is opened, and normal sheets P are discharged onto the third discharge tray 65, the failed sheet P1 does not drop. In order to detect such a state, a fourth detection sensor 81 is placed on a lower portion of the sheet storing section 61. If the fourth detection sensor 81 detects the sheet P1 a predetermined period of time after the switching pawl 64 is operated, a sheet convey failure can be detected.

In response to this detection, the alignment guide member 73 is retracted to a position where it does not regulate the trailing end of the sheet, i.e., in the horizontal direction. With this operation, the sheet P1 or a bundle of sheets can be removed from the sheet storing section 61. In addition, since the alignment guide member 73 does not interfere with the sheet to be removed, no damage to the member 73 is caused by removal processing.

As described above, when a sheet convey failure in the sheet storing section 61 is detected, the alignment guide member 73 can be retracted to the position where it does not regulate the sheet in response to the detection. With this operation, the failed sheet can be removed, and damage to the alignment guide member 73 can be prevented.

When a sheet P is conveyed into the sheet storing section 61, a jam as described above may occur. A structure for preventing such a jam will be described below.

Figure 17:
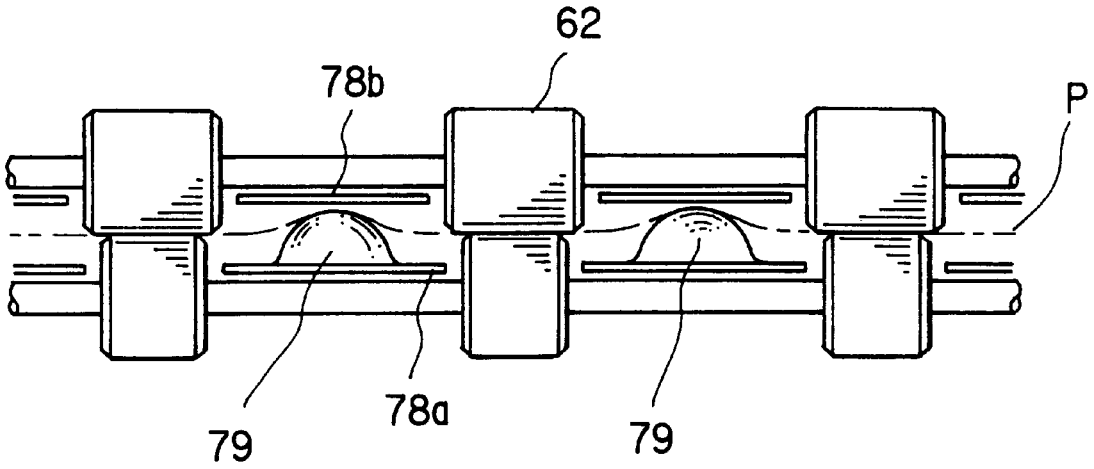
FIG. 17 is a plan view showing an embodiment of a sheet correction device for increasing the stiffness of a sheet to reliably convey the sheet.

FIG. 17 shows such a structure. According to this structure, the sheet alignment device 71 has correction means or letting a sheet itself reinforce its stiffness in the feed direction. Referring to FIG. 17, guide members 78 for guiding a sheet to the sheet storing section 61 are arranged to oppose the fourth convey rollers 62 arranged at the entrance of the sheet storing section 61. A convex projection 79 is placed on one guide member 78*a* of the guide members 78.

Figure 18:
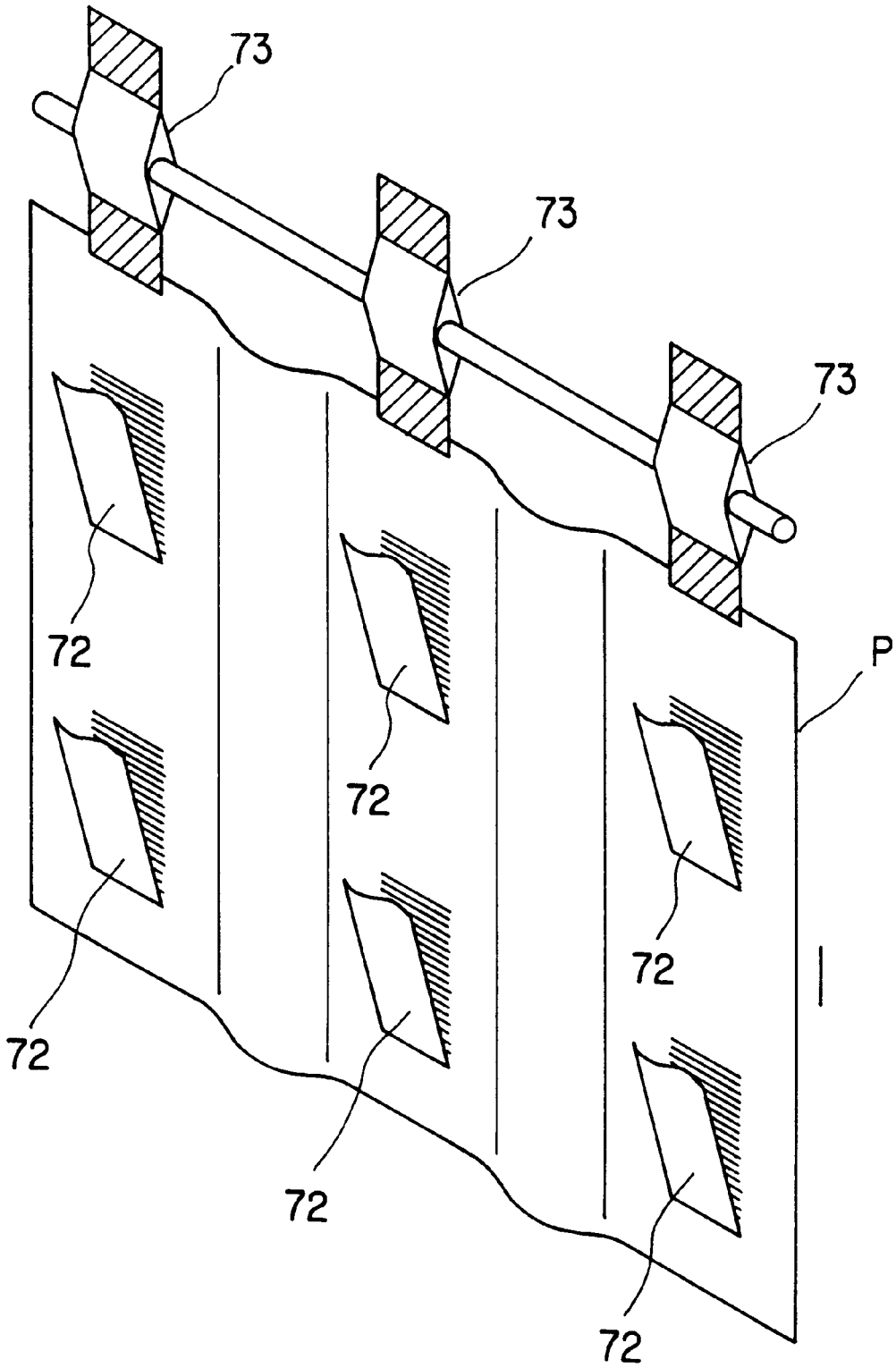
FIG. 18 is a perspective view showing how a sheet is conveyed in FIG. 17.

In the above structure, the sheet P conveyed by the fourth convey rollers 62 passes between the guide members 78*a* and 78*b* first, and part of the sheet P rides on the projections 79 on the guide member 78*a* side. The sheet P is then continuously conveyed in a rubbed state. For this reason, as shown in FIG. 18, the sheet P is conveyed while it has wavy recesses (or projections) in the longitudinal direction at portions corresponding to the projections 79. As a result, the stiffness of the sheet P is reinforced, and the sheet P has not flection. Therefore, occurrence of a jam caused by bending of the sheet or the like is suppressed, and the sheet can be reliably conveyed into the sheet storing section 61.

By forming a plurality of wavy portions, i.e., rubbed portions, on the sheet P in the widthwise direction, the holding force of the sheet in the longitudinal direction can be increased to allow more reliably conveyance of the sheet.

In this case, the guide plates 61*a* and 61*b* constituting the sheet storing section 61 may substitute for the guide members 78. For this purpose, convex projections may be formed on upper portions of the guide plate 61*a* which correspond to the fourth convey rollers 62. With this structure as well, a sheet can be conveyed in a wavy state, as shown in FIG. 18.

As shown in FIG. 18, the guide pieces 72, each having one end fixed to the first or second guide plate 61*a* or 61*b*, are not arranged at positions corresponding to the wavy portions of the sheet P conveyed to the sheet storing section 61 but are arranged at positions corresponding to flat portions of the sheet P. That is, it is important to arrange the guide pieces 72 at positions where they do not overlap the projections 79 in the convey direction. Such an arrangement is employed to reduce the frictional resistance between the guide pieces 72 and the sheet P rubbed by the projections 79. If the rubbed portions of the sheet are brought into contact with the guide pieces 72, the contact force increases. As a result, the holding force of the conveyed sheet decreases to interfere with conveyance, and a convey failure is expected to occur. For this reason, the guide pieces 72 are perfectly arranged at positions shifted from the positions of the projections 79 in the convey direction.

In addition, for the same reason as described above, the alignment guide members 73 are preferably arranged at positions shifted from the positions of the projections 79 in the convey direction.

In the above cases in this embodiment of the present invention, in performing alignment of sheets, the first and second orders are automatically switched depending on whether the image forming apparatus is set in the copy mode or the printer mode (including the facsimile mode). It is, however, important to switch the alignment orders depending on whether images are formed from the start page to the last page or from the last page to the start page in the image forming apparatus. When image formation is performed from the start page in the copy mode, alignment is performed from the start page, e.g., alignment is performed in the second order in the printer mode as in the above case. When image formation is performed from the last page in the printer mode, alignment is performed in the first order in the copy mode as in the above case.

If information indicating whether the image forming apparatus executes image formation from the last page or the start page is sent from the image forming apparatus to the discharge processing device 5, the above alignment control can be performed. According to the present invention, therefore, by inputting information indicating the order of image formation, switching control of the alignment guide member 73 and control of the rotation direction thereof are performed to align sheets in the first or second order. With this control, image-bearing sheets stored in the sheet storing section 61 are sequentially aligned in the page order.

In addition, in the discharge processing device 5 of the present invention, since sheets are only sequentially conveyed into the sheet storing section 61, the sheet convey cycle need not be kept to a value equal to or larger than the size of a sheet unlike a case wherein the sheet is reversed. The sheet convey cycle can therefore be reduced. However, since the alignment guide member 73 as sheet alignment means must be rotated when sheets are to be stored and aligned, the next sheet may be conveyed into the sheet storing section 61 while the alignment guide member 73 is rotated. That is, such a trouble occurs when the sheet convey cycle is very short.

In order to solve this problem, in the discharge processing device 5 in FIG. 1, the convey speed of the first convey rollers 51 is made coincide with the speed at which a sheet is conveyed from the digital copying machine body 1. The convey speed of the fourth convey rollers 62 for conveying a sheet to the sheet storing section 61 is therefore set to be higher than the convey speed of the first convey rollers 51. Owing to conveyance by the fourth convey rollers 62, the sheet convey cycle can be substantially prolonged as compared with the cycle in which sheets are conveyed from the digital copying machine body 1. Consequently, a sufficient time can be ensured to rotate the alignment guide member 73.

Although a short rotation time for the alignment guide member 73 will cope with a short sheet convey cycle, the rotational speed must be increased as the rotation time is shortened. In some cases, therefore, sheets cannot be accurately aligned. In order to perform accurate alignment, the sheet convey cycle can be prolonged at the fourth convey rollers 62. When sheets are to be conveyed in the same direction, no serious problem is posed in terms of sheet convey failures and jams. When the sheet feed direction is reversed, the probability of a jam or the like increases as the convey speed increases. However, when sheets are to be conveyed into the linear sheet storing section 61, as shown in FIG. 1, the frequency of a jam or the like does not increase as the convey speed increases.

If, therefore, the speed at which a sheet is conveyed by the fourth convey rollers 62 is set to be higher than the convey speed of the first convey rollers 51, a sufficient time can be ensured to rotate the alignment guide member 73 so as to reliably align stored sheets without posing any problem in terms of a sheet convey failure.

As described above, according to the sheet discharge processing device of the present invention, since the stored state of sheets in the sheet storing section is changed in accordance with the order of image formation, the use of only one sheet storing section enables alignment without upsetting the page order of image-bearing sheets and allows post-processing in the aligned state.

For this reason, this device need not have another convey route for, e.g., reversing and sorting sheets as in the conventional device, and the overall structure can be simplified, allowing a reduction in size and a great reduction in cost.

By adjusting the sheet storing section for sheet alignment in accordance with the sheet size, alignment can be reliably performed regardless of the size of a sheet to be processed.

Since sheets can be shifted and aligned at the same time by only rotating the alignment guide members for the sheet alignment, the sheets can be reliably aligned. In addition, the mechanism for alignment can be greatly simplified.

When post-processing is to be performed after sheets are aligned, since post-processing is performed while the trailing ends of the aligned sheets are regulated, accurate post-processing can be performed without displacing the sheets.

Even if images are formed on sheets in the read or transfer order, since the sheets can be aligned accordingly, all the image data on the image forming apparatus side need not be stored, and the sheets can be easily aligned on the sheet discharge processing device side.

The above description is associated with discharge processing in the case wherein a stapling operation is performed in discharging sheets. Embodiments of the sheet discharge processing device for performing a control operation for sheet discharge processing in the present invention which does not perform stapling (post-processing), i.e., receiving sheets having undergone image formation in the image forming apparatus, and discharging the sheets in the page order, will be described with reference to the accompanying drawings.

When the stapling mode is not set but only the above copy mode is set, sheets are sequentially conveyed to the discharge processing device 5 from the sheet on which the image of the page is formed.

In this case, the switching pawls 66 and 67 are switched to the states shown in FIG. 1 so a sheet conveyed by the first convey rollers 51 travels straight in the straight convey path 52 and is discharged onto the first discharge tray 55 by the second convey rollers 53 and the first discharge rollers 54 with the image-bearing surface facing up. That is, sheets are sequentially stacked on the first discharge tray 55 with the image-bearing surfaces facing up.

When the images of the same pages are to be continuously and sequentially formed on sheets to produce a plurality of sets of copies, for example, the first discharge tray 55 is constituted by many trays constituting a sorter. When a plurality of sets of copies are to be produced from a bundle of set originals, images are formed on sheets one by one from the last page to the start page. When this operation is to be repeated by the number of times corresponding to the desired number of sets, sheets are stacked on the first discharge tray 55 without being reversed.

The sheets are therefore stacked on the first discharge tray 55 with the sheet on which the image of the last page is formed located at the lowermost position and the sheet on which the image of the start page is formed being located at the uppermost position. These sheets are stacked with the image-bearing surfaces facing up, and are discharged onto the first discharge tray 55 in the page order.

Figure 19:
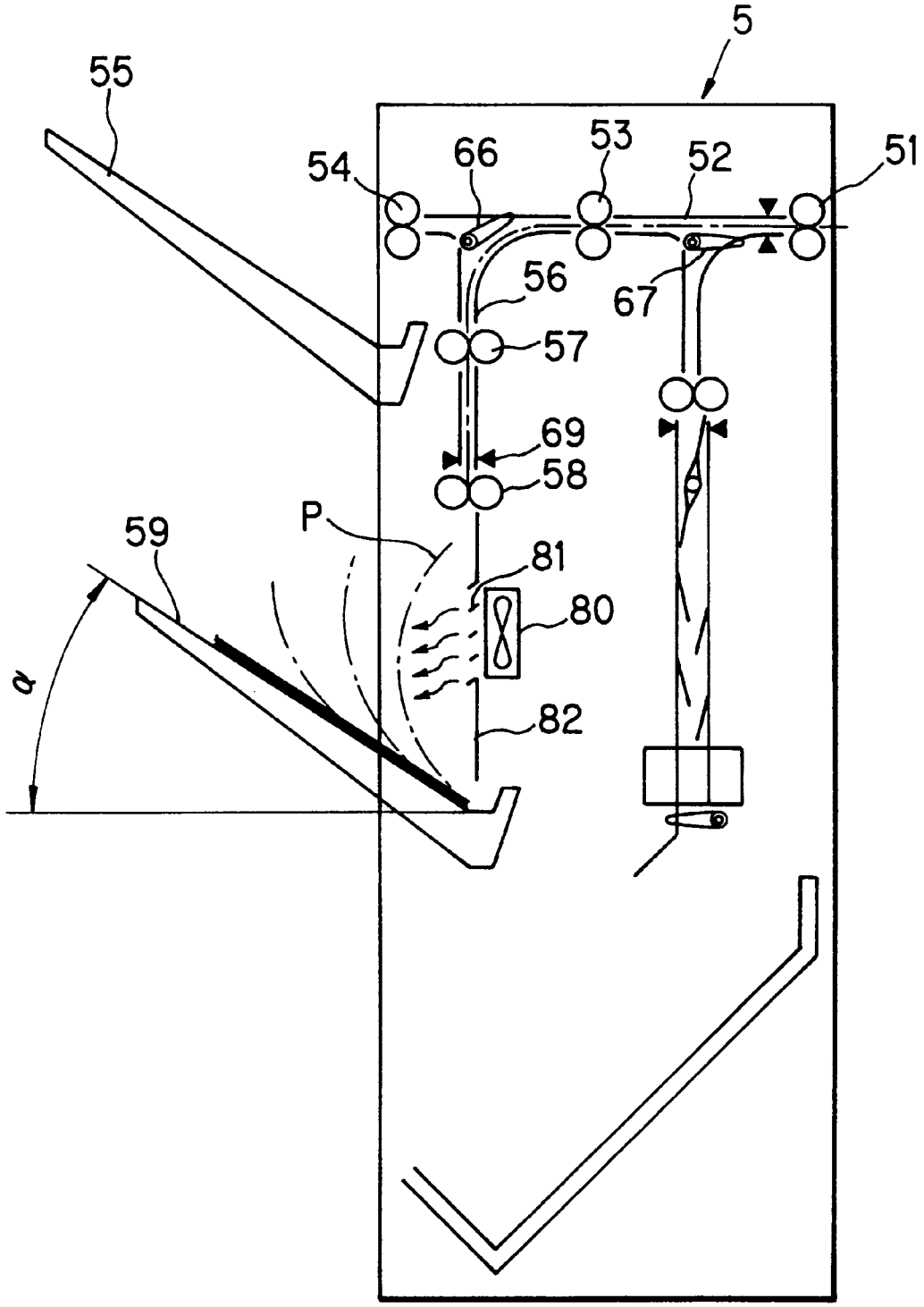
FIG. 19 is a sectional view for explaining an operation of performing reversing processing of a sheet in the sheet discharge processing device of the present invention.

If the printer or facsimile mode is selected instead of the copy mode, the switching pawls 66 and 67 in the discharge processing device 5 are switched as follows. As shown in FIG. 19, the switching pawl 67 is positioned to open the straight convey path 52, and the switching pawl 66 is positioned to close the convey path to the first discharge rollers 54 and open the reverse convey path 56.

In this mode, as described above, images are formed on sheets in the digital copying machine body 1 in the order starting from the start page transferred from another unit. That is, the sheet on which the image of the start page is formed is conveyed into the discharge processing device 5 first. This sheet is guided to the reverse convey path 56 at the position of the switching pawl 66 and conveyed by the third convey rollers 57 to be discharged onto the second discharge tray 59 by the second discharge rollers 58. In this case, since the reverse convey path 56 extends vertically, when the sheet is to be directly discharged onto the second discharge tray 59, the sheet may fall in any direction. If, however, some external force is applied to the opposite surface of the sheet to the image-bearing surface, the sheet falls onto the second discharge tray 59 with the image-bearing surface facing down.

As the above external force, air blown from the fan 80 is used in this embodiment. When the fan 80 is driven at a predetermined timing, air is blown against the opposite surface of the sheet to the image-bearing surface. As a result, the sheet is discharged onto the second discharge tray 59 with the image-bearing surface facing down, as shown in FIG. 19.

When this operation is repeated, sheets on which the images of the start to last pages are formed are stacked on the second discharge tray 59 with the image-bearing surfaces facing down. As a result, discharge processing of the sheets is completed in a sorted state.

In reversing a sheet in the reverse convey path 56, air is blown against the rear surface (opposite to the image-bearing surface) of the sheet to discharge the sheet onto the second discharge tray 59 with this external force. If an external force is applied to the rear surface of a sheet in the direction of the second discharge tray 59 at the timing when the trailing end of the sheet is released from the second discharge rollers 58, i.e., the trailing end of the sheet passes through the second discharge rollers 58, the sheet falls onto the second discharge tray 59.

In order to reliably perform this operation, it is important to detect the passage of a sheet through the second discharge rollers 58 and drive/control the fan 80. For this reason, the second detection sensor 69 is placed on the upstream side of the second discharge rollers 58 in the convey direction. The fan 80 is driven in response to detection of the trailing end of the sheet by the second detection sensor 69.

At the timing when the leading end of a sheet reaches the second discharge tray 59, and the trailing end of the sheet passes through the second discharge rollers 58, the fan 80 is driven to blow air in the direction of the second discharge tray 59. With is operation, the leading end of the sheet comes into contact with the second discharge tray 59, and the sheet is discharged as if it fell/rotated about the contact portion as a fulcrum toward the second discharge tray 59.

In this case, when the trailing end of the sheet is detected by the second detection sensor 69, the trailing end of the sheet is clamped between the second discharge rollers 58. For this reason, control is performed to start rotating the fan 80 a predetermined time t after the detection of the trailing end. This time t may be set to the time taken for a sheet to travel the distance between the second detection sensor 69 and the second discharge rollers 68. That is, the time t may be set to the sum of the time obtained by dividing the above distance by the convey speed of a sheet and a time set in consideration of an error.

As described above, a sheet is discharged onto the second discharge tray 59 in a reversed state at the timing when the fan 80 is started. In this manner, a sheet undergoes a reversing effect when it is only conveyed into the reverse convey path 56, and is discharged on the second discharge tray 59 in a reversed state. Unlike in the conventional device, therefore, switchback conveyance of a sheet need not be performed in a reverse convey path, i.e., the convey direction of a sheet in a reversed state need not be reversed. For this reason, even if the sheet convey cycle is short, sheets can be sequentially reversed/discharged, and the device can copy with high-speed processing without increasing the convey speed at the reverse convey path 56.

In performing a reverse convey operation in the present invention, a sheet needs to be discharged by the second discharge rollers 58 along the guide plate 82 placed in a vertical posture and serving as a part of the reverse convey path 56 without any curl. Assume that the sheet P is discharged such that its leading end is separated from the guide surface of the guide plate 82 (to the left in FIG. 19). In this case, even if air is blown from the fan 80, the possibility that the leading end of the sheet P is biased in the direction to further separate from the guide plate 82 increases. As a result, the sheet P may be discharged without being reversed.

It is important to bias a central portion or higher portion of the rear surface of the sheet P to prevent the leading end portion of the sheet P which has dropped along the guide plate 82 from being biased by air blown from the fan 80 as reversing/biasing means and being separated from the guide plate 82. For this reason, the fan 80 needs to be placed in the middle of the vertical distance between the second discharge rollers 58 and the second discharge tray 59 or an upper position.

In addition, increasing the stiffness of the sheet P to discharge it along the guide plate 82 is effective in preventing the sheet P from being discharged in such a manner that the leading end is separated from the guide plate 82 owing to a curl or the like. That is, correction means for increasing the stiffness of a sheet is preferably placed near the second discharge rollers 58.

Figure 20:
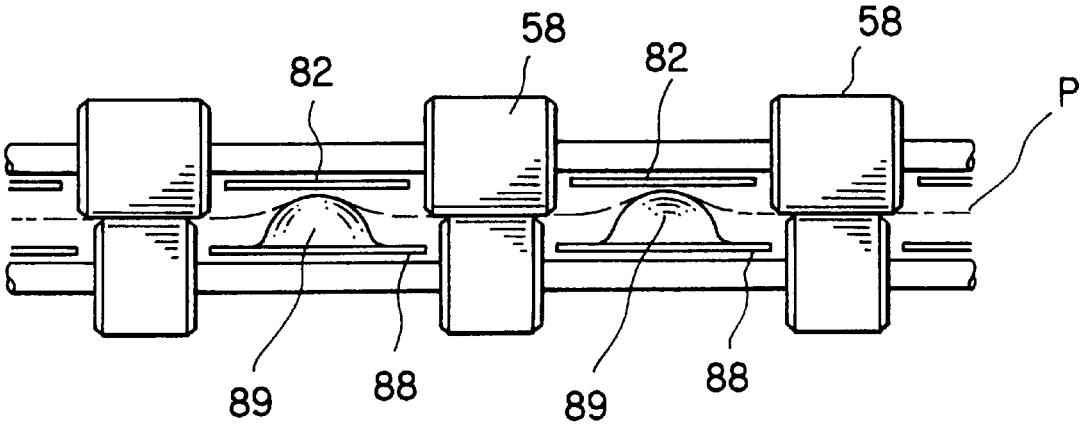
FIG. 20 is a plan view showing an example of correction means for increasing the stiffness of a sheet to be discharged.

FIG. 20 shows an example of this correction means. Referring to FIG. 20, guide members 88 for guiding the sheet P to the guide plate 82 in the process of discharging the sheet P onto the second discharge tray 59 are arranged at the exit portions between the second discharge rollers 58. The guide members 88 between the second discharge rollers 58 arranged on the reverse convey path 56 have convex projections 89 on the surface opposing the guide plate 82.

Figure 21:
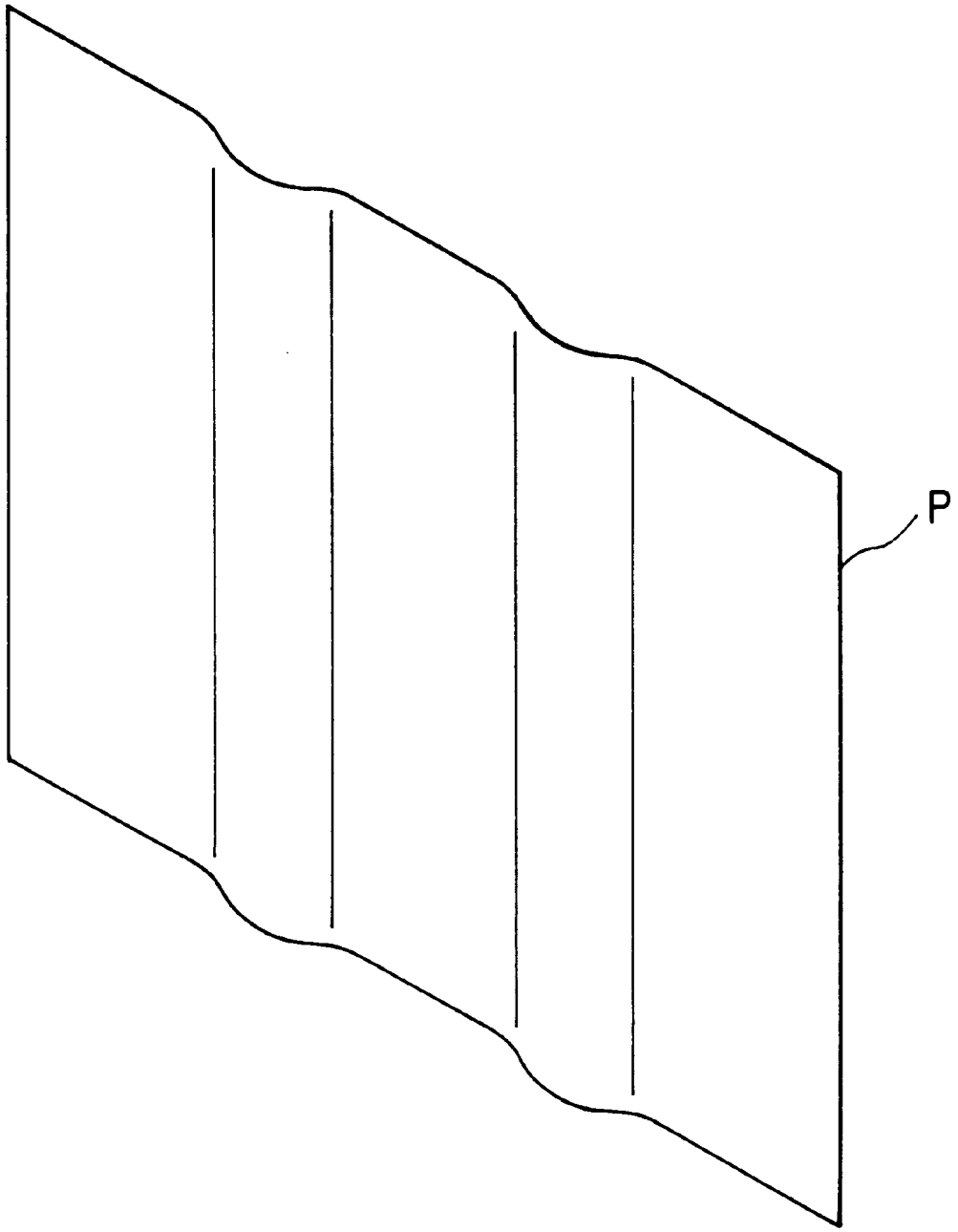
FIG. 21 is a perspective view showing the state of a sheet discharged through the correction means in FIG. 20.

With this structure, the sheet P discharged by the second discharge rollers 58 is guided first along the guide members 88, and gradually rides on the projections 89 of the guide members 88. The sheet P is rubbed by the projections 89 while the sheet is discharged. As a result, as shown in FIG. 21, the sheet P is conveyed while the portions of the sheet which correspond to the projections 89 form wavy recesses (or projections) in the longitudinal direction. As result, the stiffness of the sheet P is reinforced, and the sheet P has no flection. Therefore, occurrence of a jam causes by bending of the sheet P or the like is suppressed, and the sheet P can be reliably conveyed along the guide plate 82 in the vertical direction.

By forming a plurality of wavy portion, i.e., rubbed portions, on the sheet P in the widthwise direction, the holding force of the sheet in the longitudinal direction can be increased to allow more reliably conveyance of the sheet. With the above structure, since the sheet P has wavy recesses (or projections) parallel to the feed direction, any curl of the sheet P can be corrected in a direction perpendicular to the recesses, thereby preventing the sheet P from separating from the guide plate 82 owing to the curl. With this operation, the sheet P is discharged downward along the guide plate 82 with the leading end dropping vertically, and hence can be reliably discharged onto the second discharge tray 59 in a reversed state upon driving of the above fan 80 for blowing air.

In order to guide a sheet along the guide plate 82 without being influenced by the curl of the sheet, the sheet may be drawn to the guide plate 82 before it is discharged, instead of using the above means for reinforcing the stiffness of a sheet. This operation can be easily performed by rotating the fan 80 in the reverse direction, as shown in FIG. 1.

When the motor for driving the fan 80 is capable of rotating in the forward and reverse directions, and is rotated in the reverse direction, air is drawn to draw a sheet toward the guide plate 82. When the trailing end of the sheet is detected by the second detection sensor 69, the fan 80 is rotated in the forward direction to blow air. With this operation, the sheet is vertically discharged along the guide plate 82, and is finally reversed/discharged onto the second discharge tray 59.

In this case, air is drawn, i.e., the sheet is drawn to the guide plate 82 by rotating the fan 80 in the reverse direction. If, however, the suction force is too strong, the sheet cannot be conveyed in a drawn state. For this reason, the suction force is set so as not to interfere with conveyance of a sheet. That is, the suction force is set to allow a sheet to be fed by the second discharge rollers 58.

Figure 22:
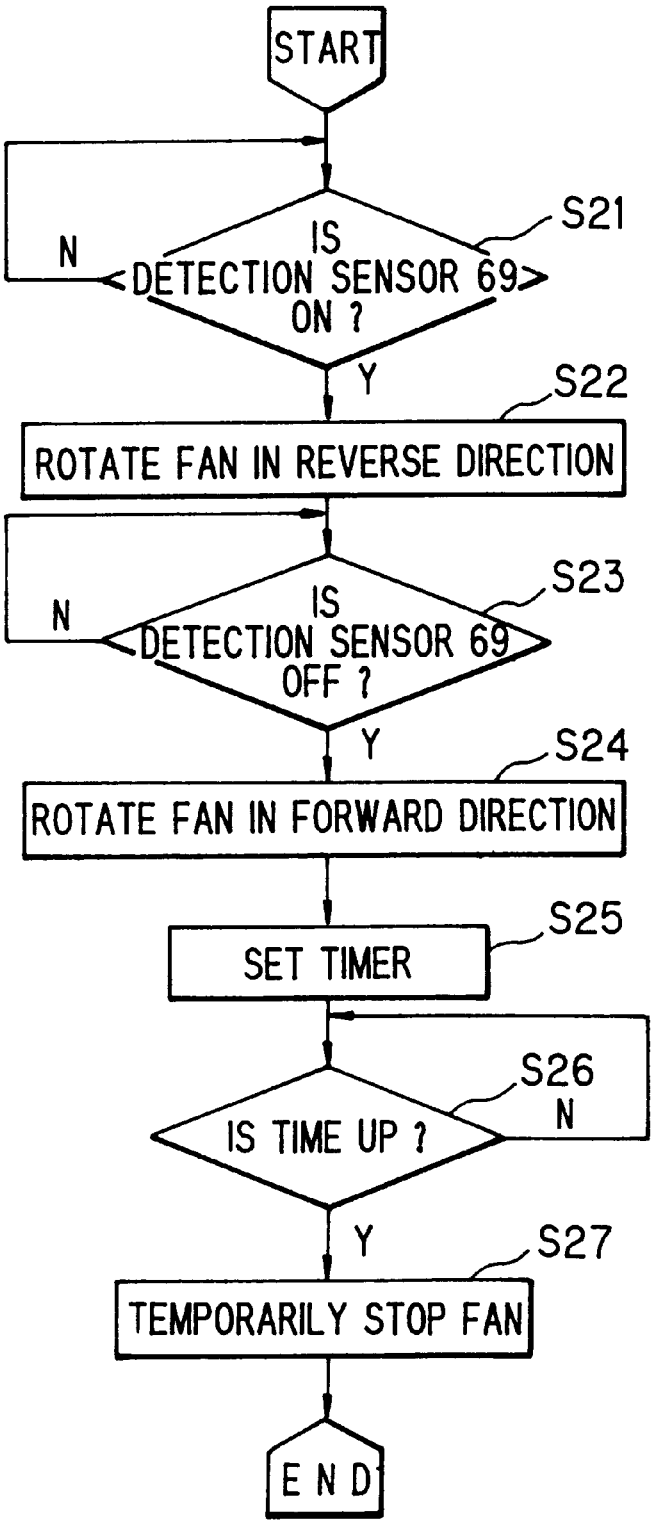
FIG. 22 is a flow chart for control for reversing a sheet in the present invention.

FIG. 22 is a flow chart showing a procedure for controlling the above operation. This control operation will be described with reference to this flow chart. This control is equivalent to the control performed by the sorter control unit 46 in FIG. 4, and is performed to control the operation of the fan 80.

First of all, the current mode is checked by the sorter control unit (FCU) 46 for sheet discharge processing. That is, the sorter control unit 46 checks whether the copy mode is set. If the copy mode is determined, the switching pawls 66 and 67 are set in the states shown in FIG. 1.

If it is determined that the copy mode is not set, the printer or facsimile mode is determined. When the current mode is checked in this manner, the switching pawls 66 and 67 are position-controlled to the states shown in FIG. 19. When an image-bearing sheet is conveyed into the discharge processing device 5, the sheet is conveyed into the reverse convey path 56 by the first and second convey rollers 51 and 53. If it is determined that the leading end of the sheet is detected (ON) by the second detection sensor 69 (Y in S21), the fan 80 is rotated in the reverse direction (S22). The suction force at this time is set in the above manner, so air is drawn without interfering with a discharge operation for the sheet.

With the above operation, while the sheet is discharged by the second discharge rollers 58, the sheet is gradually drawn to the guide plate 82 by suction and discharged. When the trailing end of the sheet is detected (OFF) by the second detection sensor 69 (Y in S23), the rotation of the fan 80 is temporarily stopped. The fan 80 is driven in the forward direction at the timing when the trailing end of the sheet passes through the second discharge rollers 58 (S24). This driving operation is performed to reverse the sheet and discharge it onto the second discharge tray 59.

The fan 80 is not rotated in the forward direction for a long period of time but is rotated for predetermined period of time. A predetermined time T is therefore set in the timer at the same time the fan 80 is rotated in the forward direction (S25). More specifically, this predetermined time T is a short period of time and set to the time required to reverse a sheet. For example, the time T is one second or less and set to the time taken for a sheet to fall onto the second discharge tray 59 after air is blown against the rear surface of the sheet. For this reason, the predetermined time T which is a short period of time during which air is blown is set in the timer. If this time is too long, a discharged sheet may float in the air and moves out of the second discharge tray 59.

If air is blown in the above manner, and the lapse of the predetermined time T is determined by the timer (S26), the fan 80 is stopped (S27), and a preparation for a discharge operation of the next sheet is made. In this manner, sheets are sequentially discharged along the guide plate 82 while air is blown. When the trailing end of each sheet passes through the second discharge rollers 58, air is blown against the rear surface of the sheet to discharge the sheet onto the second discharge tray 59 with the image-bearing surface facing down.

In this case, since a sheet is drawn to the guide plate 82 by suction, the conveyance of the sheet may be interfered, and the sheet may bend in a direction perpendicular to its convey direction. As described above, however, this problem can be solved by decreasing the force of suction air. By using the correction means for forming wavy portions on a sheet in a direction perpendicular to the bending direction of the sheet, i.e., in the convey direction, as described with reference to FIG. 20, together with the above air drawing operation, the problem of sheet bending can be solved, and the sheet can be satisfactorily conveyed even with a light strong suction force, thereby solving the problem of a convey failure. In addition, the suction forces can be set within a wide range, and hence adjustment is facilitated.

As described above, when air is to be used, means for reliably conveying a sheet along the guide plate 82 can also serve as means for reversing the sheet. Therefore, a reduction in the size of the device can be satisfactorily attained, and the factor that causes an increase in cost can be eliminated.

The above description is based on the assumption that sheets having the same size are to be discharged. A distance L between the second discharge rollers 58 and the second discharge tray 59 is set to be almost equal or slightly larger than the length of a sheet to be discharged, i.e., the length of a sheet in the convey direction. For this reason, when the leading end of a sheet passes through the second discharge rollers 58 and reaches the second discharge tray 59, the trailing end of the sheet is passing through the second discharge rollers 58. When the rear surface of the sheet is biased by, for example, biasing means for blowing air in this state, the sheet is reversed/rotated about the contact position as a fulcrum where the leading end of the sheet is in contact with the second discharge tray 59, and is discharged onto the second discharge tray 59.

The distance between the second discharge rollers 58 and the second discharge tray 59 is set to be not less than the minimum size that allows processing of a sheet and not more than the maximum size that allows processing of a sheet. With this setting, when the trailing end of a sheet passes through the second discharge rollers 58, the leading end of the sheet is falling onto the second discharge tray 59. When air is blown against the rear surface of the sheet in this state, the sheet can be reversed.

For this reason as well, air is preferably blown at a position near the middle of the distance between the second discharge rollers 58 and the second discharge tray 59 or an upper position. If, however, air is blown against a portion near the leading end of the sheet, the leading end of the sheet is greatly separated from the guide plate 82. Consequently, the sheet may not be reversed/rotated about the leading end as a fulcrum, and may be subjected to discharge processing without being properly reversed. In order to eliminate such an inconvenience, the position of the fan 80 is determined in the above manner.

The distance between the second discharge rollers 58 and the second discharge tray 59 is set in the above manner, and the position of the reversing/biasing means constituted by the fan 80 is fixed. More preferably, however, the above distance is changed in accordance with the size of a sheet to be processed.

If air is blown against the rear surface of a sheet while the leading end of the sheet is spaced apart from the second discharge tray 59 by a considerable distance, the sheet may float before it falls onto the second discharge tray 59. Consequently, the probability that the sheet is accurately discharged with the image-bearing surface facing down decreases, or the sheet may float and move out of the second discharge tray 59. For this reason, the distance between the second discharge rollers 58 and the second discharge tray 59 is preferably set in accordance with the size of a sheet to be processed.

Figure 23:
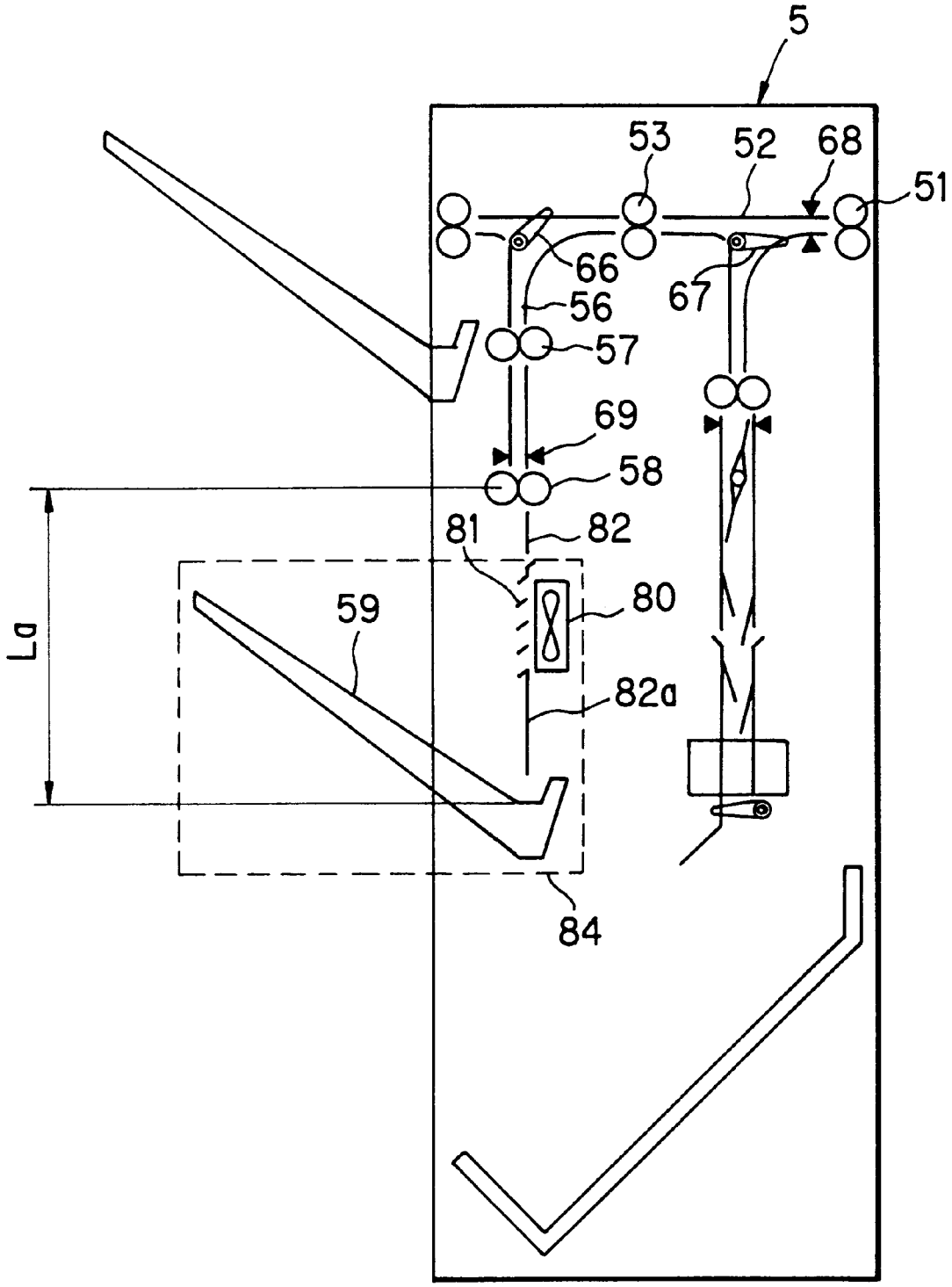
FIG. 23 is a front longitudinal sectional view showing an embodiment of executing discharge processing in accordance with the size of each sheet in a sheet reversing/discharge operation in the present invention, more specifically, an embodiment of performing discharge processing for sheets with the minimum sheet size.
Figure 24:
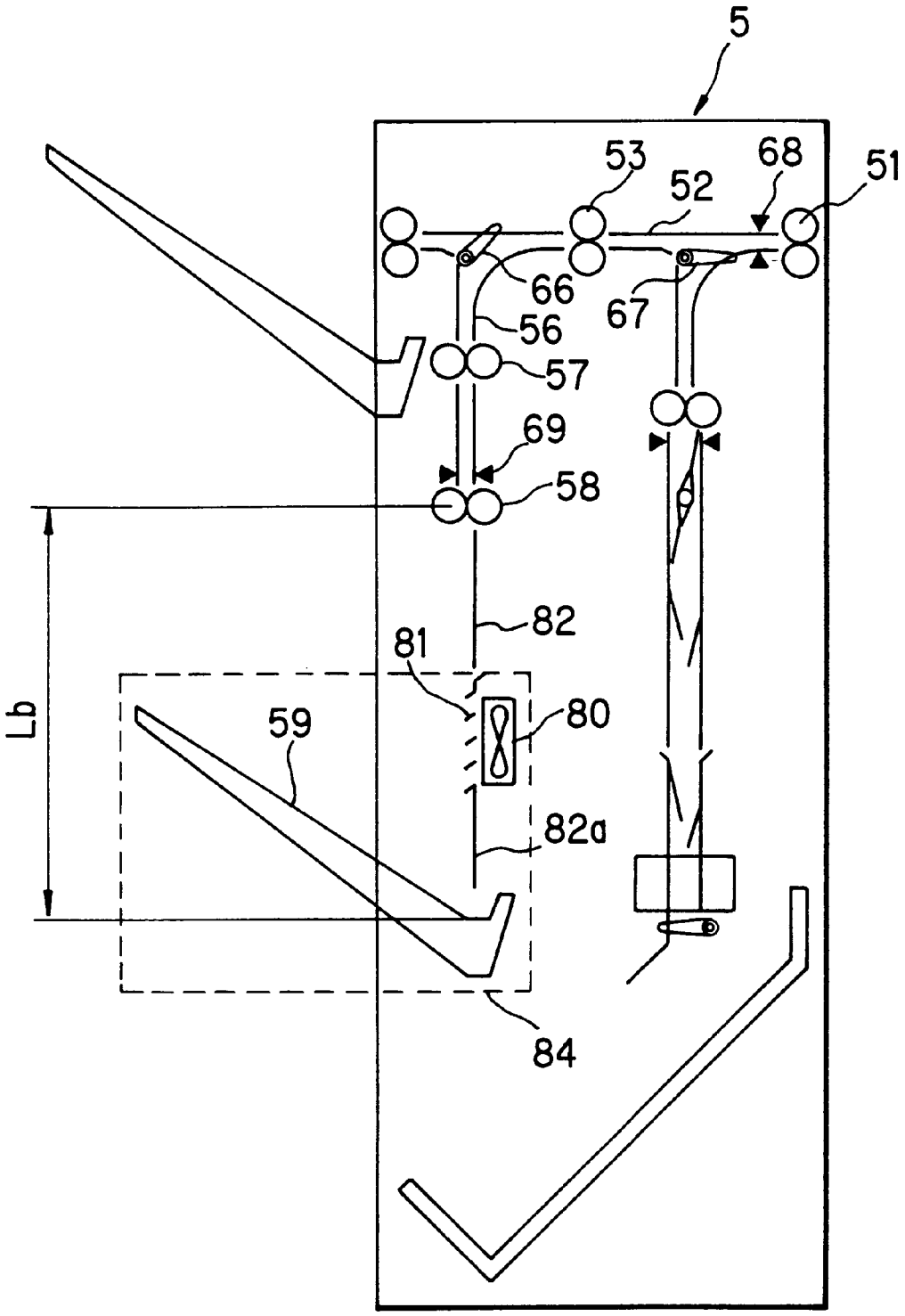
FIG. 24 is a front longitudinal sectional view showing an embodiment of performing discharge processing of a sheet having the maximum size in sheet reversing processing in FIG. 23.

In order to realize such a setting operation, as shown in FIGS. 23 and 24, the second discharge tray 59, the fan 80, and the guide plate 82 are supported on a single support member 82 to be movable in the vertical direction. The setting in FIG. 23 corresponds to the minimum size (La) of a sheet to be processed. The setting in FIG. 24 corresponds to the maximum size (Lb) of a sheet to be processed.

According to this structure shown in FIGS. 23 and 24, by controlling the moving position of the support member 84 in the vertical direction in accordance with the size of a sheet, the distance L between the second discharge rollers 58 and the second discharge tray 59 can be set in accordance with the sheet size.

In this case, the size of a sheet is detected when the sheet is processed in the digital copying machine body 1 as an image forming apparatus. When, for example, a sheet of a selected size is to be fed from the cassette paper feeder 34*a* or 34*b*, and information indicating this sheet size is sent to the discharge processing device 5, the vertical position of the support member 84 can be easily adjusted/controlled in accordance with the sheet size.

The discharge processing device 5 has a detection sensor. By using this detection sensor, the sheet size is detected on the discharge processing device 5 side, and the vertical position of the support member 84 is adjusted/controlled on the basis of the detected size.

As the above detection sensor, the first detection sensor 68 for detecting conveyance of a sheet can be used to detect the size of a conveyed sheet. More specifically, a time counting operation of the timer is started when the leading end of a sheet is detected by the first detection sensor 68, and the time counting operation is stopped when the trailing end of the sheet is detected thereby. The size of the sheet can be easily obtained on the basis of the time counted by the timer not only the size of standard sheet but also the size of a non-standard sheet can be detected. The vertical position of the support member 84 can be adjusted in advance on the basis of the detected size.

The support member 84 is vertically moved on the basis of the size of a sheet to be processed. In this case, the fan 80 is also supported on the support member 84 and vertically moved. The fan 80 is preferably located at least in the middle of the distance between the second discharge rollers 58 and the second discharge tray 59 or an upper position when a sheet of the maximum size is to be processed. If the fan 80 is located below the middle of the above distance, the leading end of sheet may separate from the second discharge tray 59, and the sheet may not be accurately reversed/rotated about the leading end. If the fan 80 is located above the middle position in the mode of processing a sheet of the maximum size, the fan 80 is located above even the center of a sheet smaller in size than a sheet of the maximum size.

In addition, since the fan 80 is mounted on the support member 84, the distance between the fan 80 and the second discharge tray 59 is constant. That is, even if the position of the fan 80 changes, the distance between the fan 80 and the second discharge tray 59 is constant regardless of the size of a sheet. Therefore, when the fan 80 is rotated in the reverse direction, a sheet can be discharged with its leading end being guided along the guide plate 82. That is, a sheet can be discharged along the guide plate 82 until the leading end of the sheet almost comes into contact with the second discharge tray 59. Therefore, more stable reversing processing can be performed.

Figure 25:
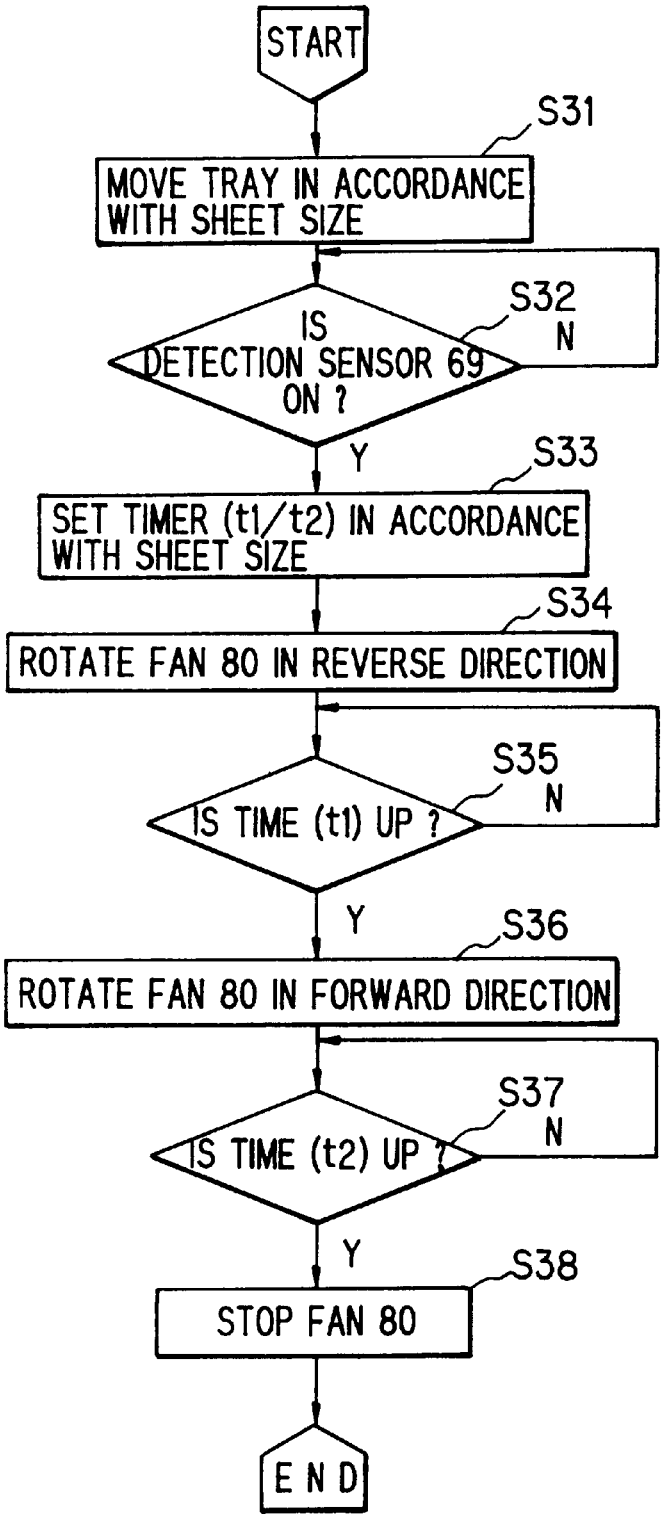
FIG. 25 is a flow chart showing an example of how sheet reversing processing in FIGS. 23 and 24 is performed.

An example of how control is performed to vertically move the second discharge tray 59 will be described with reference to the flow chart of FIG. 25. Referring to FIG. 25, in this control operation, the movement of the support member 84 is controlled by the control means constituted by the sorter control unit 46 of the discharge processing device 5 described with reference to FIG. 4 on the basis of sheet size information sent to the discharge processing device 5, and the distance L between the second discharge rollers 58 and the second discharge tray 59 is adjusted in accordance with the sheet size (S31).

When the leading end of the sheet to be discharged by the second discharge rollers 58 is detected by the second detection sensor 69 (Y in S32) in this state, predetermined times t1 and t2 are set in the timer in accordance with the size of the sheet to be discharged (S33). The predetermined time t1 is the time taken for the trailing end of the sheet to pass through the second discharge rollers 58. The predetermined time t2 is the driving time of the fan 80 in the forward direction which is taken to step the fan 80 in a predetermined time after in particular a reverse operation is performed using the fan 80. That is, the time t1 is determined in accordance with the size of a sheet, and the time t2 is the sum of the time t1 and the time taken to continuously operate the fan 80 for the predetermined time.

When the above time times t1 and t2 are set, the corresponding time counting operation is started. At the start of this operation, the fan 80 is rotated in the reverse direction to draw air (S34). The leading end of the sheet to be discharged is drawn to the guide plate 82 by suction, and a discharge operation is gradually continued in this state.

When the lapse of the predetermined time t1 is determined by the timer (Y in S35), the fan 80 is temporarily stopped and immediately rotated in the forward direction (S36). This timing corresponds to the time point at which the trailing end of the sheet passes through the second discharge rollers 58. When the trailing end of the sheet passes through the second discharge rollers 58 while the sheet is discharged along the guide plate 82, the fan 80 blows air against the rear surface of the sheet. As a result, the sheet falls onto the opposite side to the rear surface to be discharged onto the second discharge tray 59.

The fan 80 operates to reverse the sheet for the predetermined time. When the lapse of the predetermined time t2 is determined by the timer (Y in S37), the fan 80 is stopped (S38) to wait for discharge processing of the next sheet. In the above flow chart, the predetermined times t1 and t2 are set in the timer in accordance with the size of the sheet to be processed in step 33 (S33). However, similar control can be performed by using the second detection sensor 69. In this case as well, the fan 80 is rotated in the reverse direction when the leading end of a sheet is detected by the second detection sensor 69. However, no time needs to be set in the timer at this time.

When the trailing end of the sheet is detected by the second detection sensor 69, the rotation of the fan 80 in the reverse direction is stopped, and rotation of the fan 80 in the forward direction is immediately started. After the fan 80 is rotated in the forward direction for a predetermined period of time (e.g., t2-t1), the rotation of the fan 80 is stopped. With this control as well, the sheet can be discharged onto the second discharge tray 59 in a reversed state.

The present invention is not limited to the structure shown in FIGS. 23 and 24. For example, the fan 80 need not be mounted on the support member 84 together with the second discharge tray 59. That is, only the second discharge tray 59 may be mounted to be vertically movable. In this case, the same effect as described above can be obtained by vertically moving a guide plate 82*a* below an opening portion 81 of the fan 80 in addition to the second discharge tray 59.

With this structure, only the second discharge tray 59 is vertically moved in accordance with the size of a sheet to set the distance (gap) L between the second discharge rollers 58 and the second discharge tray 59 in accordance with the size of the sheet to be processed.

The sheet can be reversed more reliably by fixing the fan 80 to a position corresponding to the center of the sheet to be processed or an upper position. If the fan 80 s fixed at a position higher than the second discharge tray 59 by La/2 or more (where La is the distance between the second discharge rollers 58 and the second discharge tray 59 in the mode of processing a sheet of the minimum size), the fan 80 can perform reversing processing of sheets of any sizes at upper positions.

In the above embodiment, the reversing/biasing means for reversing a sheet by blowing air is used to reverse a sheet by biasing the rear surface of the sheet. This reversing/biasing means is not limited to the means for blowing air using the fan 80. For example, a rotating member 85 which rotates in the manner shown in FIG. 26 may be operated at the driving time of the fan 80. With this operation as well, a sheet can be reversed.

Figure 26:
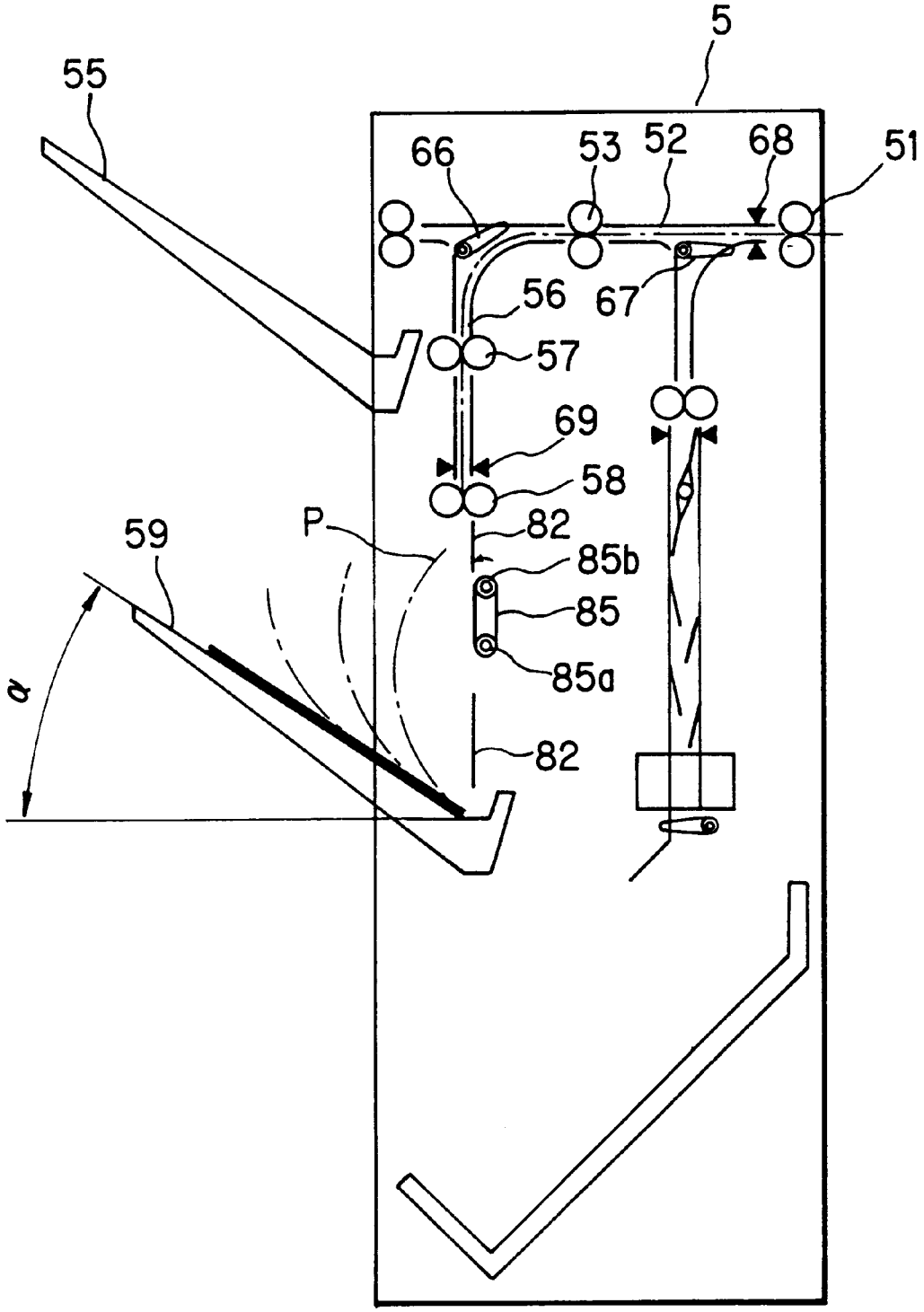
FIG. 26 is a front longitudinal sectional view showing another embodiment of the sheet reversing processing portion of the sheet discharge processing device of the present invention.
Figure 27:
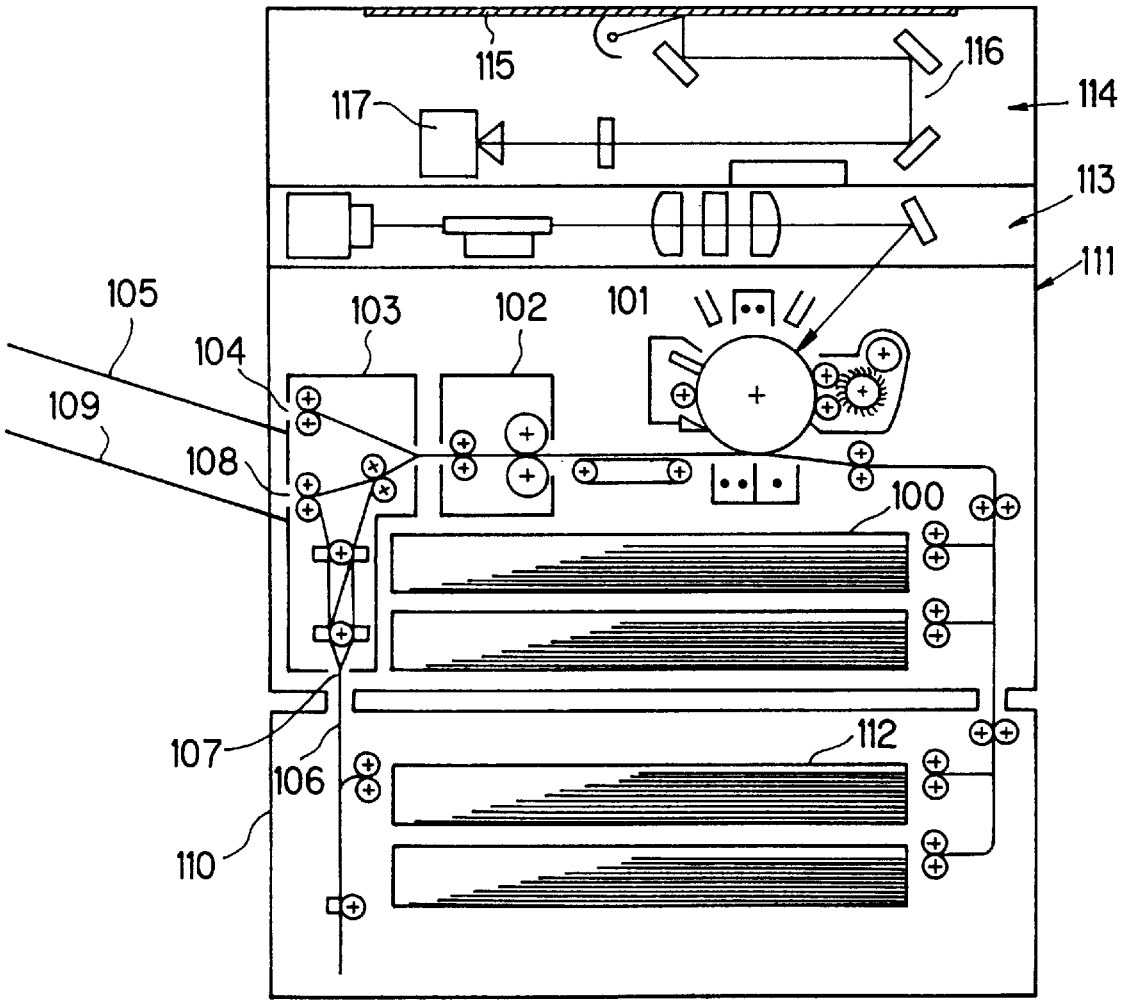
FIG. 27 is a front longitudinal sectional view showing a conventional sheet discharge processing, together with an image forming device.
Figure 28:
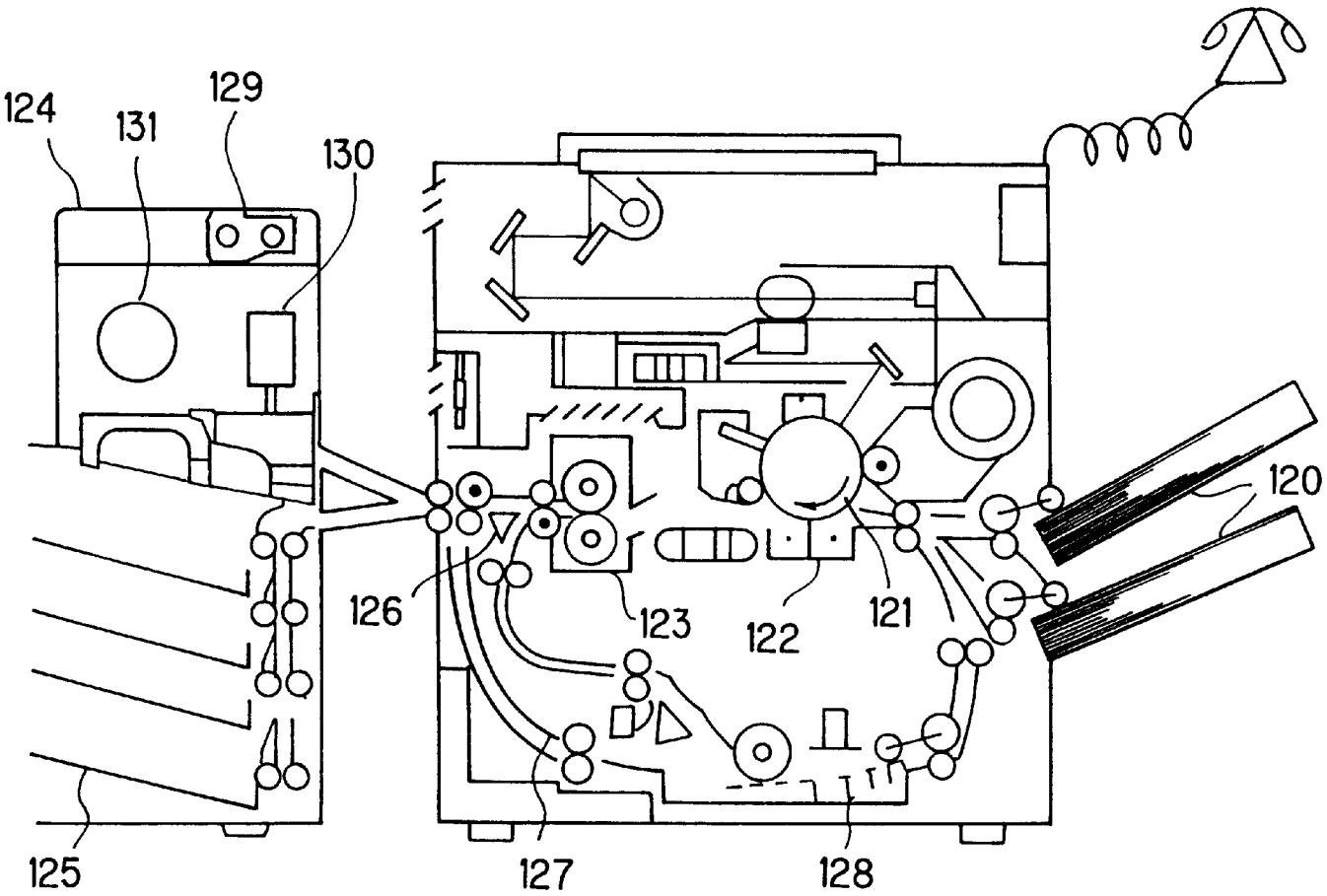
FIG. 28 is a front longitudinal sectional view showing another conventional sheet discharge processing, together with the image forming apparatus.

Referring to FIG. 26, one end 85*a* of the rotating member 85 is axially rotatably supported, and a free end 85*b* is located in correspondence with the rear surface of a sheet. When the rotating member 85 makes one revolution in the counterclockwise direction (indicated by the arrow) in FIG. 26, the rear surface of the sheet P to be discharged is pushed to the left by the free end 85*b* of the rotating member 85. As a result, the sheet falls onto the second discharge tray 59 in the same manner as in the case of an air blowing operation.

The rotating member 85 need not make one revolution, and may be reciprocally driven to be restored to the original position after it rotates through a necessary angle. It suffices if this angle is set to 90°. Alternatively, this angle may be set to at least 30° at which the free end 85*b* protrudes from the guide plate 82 and can apply a biasing force to the rear surface of a sheet.

If the second discharge tray 59 is set in a horizontal position, a sheet may float while it falls onto the tray. As a result, the discharged sheets may not be aligned, or a sheet may float and move out of the second discharge tray 59. For this reason, an angle $\alpha$ at which the second discharge tray 59 is placed is preferably set to 30° or more with respect to the horizontal position, as shown in FIGS. 19 or 26. If, however, the angle $\alpha$ is set to 90°, sheets are not reversed and cannot be discharged in the order of image formation. For this reason, the angle $\alpha$ needs to be smaller than 90°. Even if, however, the angle $\alpha$ is set to above 80°, a reversed sheet may be reversed again owing to an external force so as to fall onto the guide plate 82. Therefore, the angle $\alpha$ is preferably set to 70° or less. If, for example, the stiffness of a sheet is low, the discharged sheet may slip off. For this reason, it is more preferable that the angle $\alpha$ be set to be smaller than 70°.

As has been described above, according to the sheet discharge processing device of the present invention, a sheet can be reversed without using any switchback convey path through which the feed direction of a sheet is reversed after the sheet is reversed as in the conventional device. For this reason, the overall device can be reduced in size, and at the same time, the cost can be greatly reduced.

In addition, since no switchback convey operation is required, discharge processing of sheets can be performed without setting the convey cycle to a value equal to or larger than the size of a sheet to be processed. For this reason, the sheet convey cycle can be shortened to allow the device to easily cope with high-speed processing. Since the convey speed need not be set to be higher than the image formation sped, in particular, discharge processing can be performed at a speed corresponding to the convey speed for high-speed image processing without posing problems associated with a sheet convey failure, a jam, and the like.

Discharged sheets can be sorted in the order of image formation. In addition, processing of sheets can be performed in accordance with the size of each sheet without decreasing the processing speed.

Furthermore, since a reversing operation is executed at the timing when the leading end of sheet comes into contact with the discharge tray, the sheet can be readily reversed. If adjustment is performed in accordance with the size of a sheet in order to process the sheet with its leading end in contact with the discharge tray, sheet reversing processing can be reliably performed regardless of the size of a sheet.

When the leading end of a sheet is to be conveyed in a direction perpendicular to the discharge tray, the means for performing a reversing operation is used to guide the sheet in a vertical state so as to reliably perform a reversing operation. In addition, since the above means have the two function, an increase in the size of the sheet discharge processing device can be prevented. Furthermore, with the use of the correction means for reinforcing the stiffness of a sheet to be discharged, the sheet can be reliably discharged and accurately reversed.

What is claimed is:

1. A sheet discharge processing device for sequentially discharging sheets, conveyed through image forming means for forming images on the sheets on the basis of image data, onto a discharge tray with image-bearing surfaces facing up or down, comprising:

a straight convey path for discharging sheet conveyed through the image forming means onto a first discharge tray, with image-bearing surfaces facing up, such that the sheets are stacked sequentially on each other from a last page;

a reverse convey path for discharging the sheets conveyed through the image forming means onto a second discharge tray located substantially parallel to the first discharge tray, with image-bearing surfaces facing down, such that the sheets are stacked sequentially on each other from a start page, said reverse convey path branching from said straight convey path;

reversing-biasing means, placed on said reverse convey path, for applying an external force to a rear surface of a sheet to reverse and discharge the sheet onto the second discharge tray;

switching means for switching a convey route of a sheet to said straight convey path or said reverse convey path; and control means for controlling said switching means and said reversing-biasing means depending on whether an image-bearing surface of a sheet conveyed through the image forming means faces in a first direction and a second direction which is parallel and opposite to the first direction.

2. The sheet discharge processing device according to claim 1, wherein said reverse convey path is placed in a vertical direction perpendicular to said straight convey path.

3. The sheet discharge processing device according to claim 1, wherein said reversing-biasing means comprises air biasing means for blowing air.

4. The sheet discharge processing device according to claim 1, wherein said reverse/biasing means includes a rotating member.

5. A sheet discharge processing device for sequentially discharging sheets, conveyed through image forming means for forming images on the sheets on the basis of image data, onto a discharge tray with image-bearing surfaces facing in a first direction and a second direction which is parallel and opposite to the first direction, comprising:

a straight convey path for discharging sheets conveyed through the image forming means onto a first discharge tray, with image-bearing surfaces facing up, such that the sheets are stacked sequentially on each other from a last page;

a reverse convey path for discharging the sheets conveyed through the image forming means onto a second discharge tray located substantially parallel to the first tray, with image-bearing surfaces facing down, such that the sheets are stacked sequentially on each other from a start page, said reverse convey path branching from said straight convey path;

discharge rollers arranged on said reverse convey path to convey a sheet onto the second discharge tray;

reversing-biasing means, arranged on said reverse convey path, for applying an external force to a rear surface of a sheet discharged through said discharge rollers to reverse and discharge the sheet onto the second discharge tray;

detection means, arranged on said reverse convey path, for detecting a trailing end of a sheet which passes through said discharge rollers; and control means for controlling said switching means depending on whether an image-bearing surface of a sheet conveyed through the image forming means faces in a first direction and a second direction which is parallel and opposite to the first direction, and controlling and operation of said reversing-biasing means in response to detection of a trailing end of a sheet by said detection means.

6. The sheet discharge processing device according to claim 4, further comprising a support member which supports said second discharge tray and said reversing-biasing means and is vertically movable, and wherein said control means controls said support member to adjust a distance between said discharge tray in accordance with a size of a sheet to be processed.

7. The sheet discharge processing device according to claim 4, wherein said revering-biasing means comprises air biasing means set to blow air downward, and said air biasing means is placed near a middle point between said discharge rollers and a lower end of the second discharge tray.

8. A sheet discharge processing device for sequentially discharging sheets, conveyed through image forming means for forming images on the sheets on the basis of image data, onto a discharge tray with image-bearing surfaces facing in a first direction a second direction which is parallel and opposite to the first direction, comprising:

a straight convey path for discharging sheets conveyed through the image forming means onto a first discharge tray, with image-bearing surfaces facing up, such that the sheets are stacked sequentially on each other from a last page;

a reverse convey path for discharge the sheets conveyed through the image forming means onto a second discharge tray, with image-bearing surfaces facing down, such that the sheets are stacked sequentially on each other from a start page, said reverse convey path branching from said straight convey path;

discharge rollers arranged on said reverse convey path to convey a sheet onto the second discharge tray;

air biasing means, arranged on said reverse convey path, for blowing air against a rear surface of sheet discharged through said discharge rollers to reverse and discharge the sheet onto the second discharge tray;

detection means, arranged on said reverse convey path, for detecting leading and trailing ends of a sheet which passes through said discharge rollers; and control means for controlling said switching means depending on whether an image-bearing surface of a sheet conveyed through the image forming means faces in a first direction and a second direction which is parallel and opposite to the first direction, and controlling said air biasing means to draw a sheet in response to detection of the leading end of the sheet by said detection means and to blow air against a rear surface of the sheet in response to detection of the trailing end of the sheet by the detection means.

9. The sheet discharge processing device according to claim 6, further comprising correction means for forming recesses and projections on a sheet in a direction perpendicular to a convey direction of the sheet to increase stiffness of the sheet discharged from said discharge rollers along the convey direction.

10. A sheet discharge processing device for sequentially for discharging sheets, conveyed through image forming means for forming images on the sheets on the basis of image date, onto a discharge tray with image-bearing surfaces facing up or down, comprising:

only a single straight convey path for discharging sheets conveyed through the image forming means onto a first discharge tray located substantially parallel to the first tray, with image-bearing surfaces facing up, such that the sheets are stacked sequentially on each other from a last page;

a reverse convey path for discharging the sheets conveyed through the image forming means onto a second discharge tray located substantially parallel to said first tray, with image-bearing surfaces facing down, such that the sheets are stacked sequentially on each other from a start page, said reverse convey path branching from said straight convey path;

reversing-biasing means, placed on said reverse convey path, for applying an external force to a rear surface of a sheet to reverse and discharge the sheet onto the second discharge tray;

switching means for switching a convey route of a sheet to said straight convey path or said reverse convey path; and control means for controlling said switching means and said reversing-biasing means depending on whether an image-bearing surface of a sheet conveyed through the image forming means faces in a first direction and a second direction which is parallel and opposite to the first direction.

11. The sheet discharge processing device according to claim 10, wherein said reverse convey path is placed in a vertical direction perpendicular to said straight convey path.

12. The sheet discharge processing device according to claim 10, wherein said first and second trays extend from a same side of the device in the same direction.

* * * * *